US007334318B2

(12) United States Patent
Hashimoto et al.

(10) Patent No.: US 7,334,318 B2
(45) Date of Patent: Feb. 26, 2008

(54) METHOD FOR FABRICATING A RESISTOR

(75) Inventors: Masato Hashimoto, Fukui (JP); Yoshiro Morimoto, Osaka (JP); Akio Fukuoka, Fukui (JP); Hiroaki Kaito, Osaka (JP); Hiroyuki Saikawa, Fukui (JP); Toshiki Matsukawa, Fukui (JP); Junichi Hayase, Fukui (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 332 days.

(21) Appl. No.: 11/037,935

(22) Filed: Jan. 18, 2005

(65) Prior Publication Data

US 2005/0153515 A1 Jul. 14, 2005

Related U.S. Application Data

(62) Division of application No. 10/181,306, filed as application No. PCT/JP01/00251 on Jan. 17, 2001, now Pat. No. 6,935,016.

(30) Foreign Application Priority Data

Jan. 17, 2000 (JP) ..... 2000-7407
Feb. 22, 2000 (JP) ..... 2000-43913
Feb. 23, 2000 (JP) ..... 2000-45507

(51) Int. Cl.
*H01C 17/00* (2006.01)

(52) U.S. Cl. ..... 29/619; 29/620; 29/621; 257/724; 338/203; 338/309

(58) Field of Classification Search ..... 29/610.1, 29/619, 620, 621; 257/724; 338/203, 309
See application file for complete search history.

(56) References Cited

U.S. PATENT DOCUMENTS 5,757,076 A 5/1998 Kambara (Continued)

FOREIGN PATENT DOCUMENTS

JP 03-142904 6/1991

(Continued)

OTHER PUBLICATIONS

Japanese search report for PCT/JP01/00251 dated Apr. 24, 2001.

(Continued)

*Primary Examiner*—Tim Phan
(74) *Attorney, Agent, or Firm*—RatnerPrestia

(57) ABSTRACT

A method of manufacturing an inexpensive fine resistor which do not require dimensional classifications of discrete substrates is disclosed. The method eliminates a process of replacing a mask according to a dimensional ranking of each discrete substrate. The method includes: dividing an insulated substrate sheet along a first slit dividing portion and a second dividing portion perpendicular to the first dividing portion; forming a top electrode layer on a top face of the discrete substrate; forming a resistor layer such that a part of the resistor layer overlaps the top electrode layer; forming protective layers so as to cover the resistor layer; and forming side electrode layer on a side face of the discrete substrate such that the side electrode layer is electrically coupled to the top electrode layer.

3 Claims, 54 Drawing Sheets

U.S. PATENT DOCUMENTS

| | | | | |
|---|---|---|---|---|
| 6,150,920 | A | 11/2000 | Hashimoto et al. | |
| 6,304,167 | B1 | 10/2001 | Nakayama | |
| 6,636,143 | B1 * | 10/2003 | Hashimoto et al. | 338/309 |

FOREIGN PATENT DOCUMENTS

| | | |
|---|---|---|
| JP | 04-102302 | 4/1992 |
| JP | 07-074001 | 3/1995 |
| JP | 07-086012 | 3/1995 |
| JP | 07-245228 | 9/1995 |
| JP | 09-050901 | 2/1997 |
| JP | 09-120902 | 5/1997 |
| JP | 11-016762 | 1/1999 |
| JP | 11-026204 | 1/1999 |
| JP | 11-307304 | 11/1999 |

OTHER PUBLICATIONS

English translation of Form PCT/ISA/210.
Form PCT/IPEA/408 (Written Opinion).

* cited by examiner

21

21
22
22

23
21
22
22

24
22
21
24
22
23
24

25
24
22
21
22
23
24
25
24

FIG. 35
FIG. 35(a)
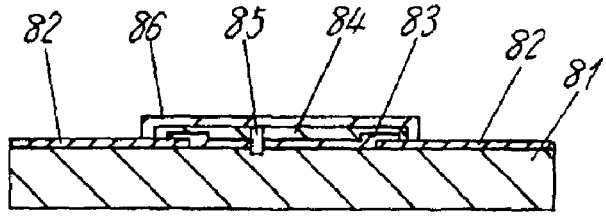
FIG. 35(b)
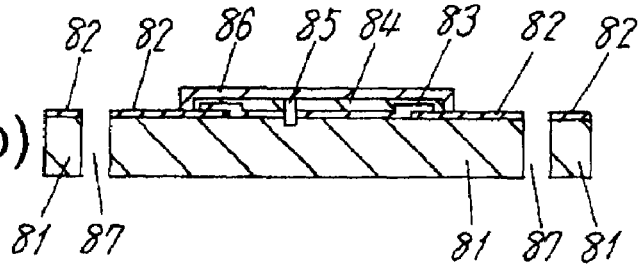
FIG. 35(c)
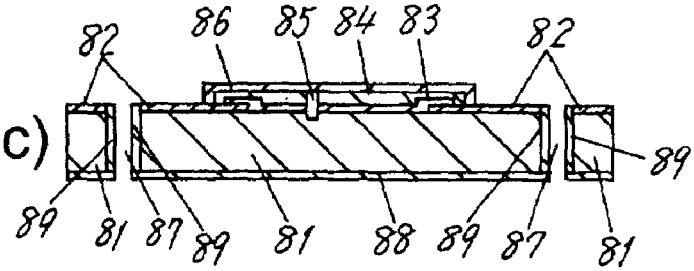

FIG. 45(a)
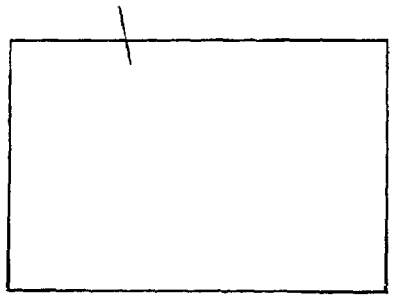
FIG. 45(d)
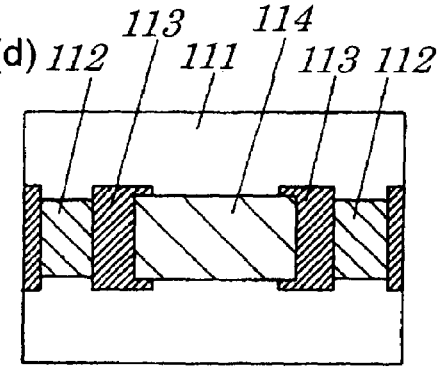
FIG. 45(b)
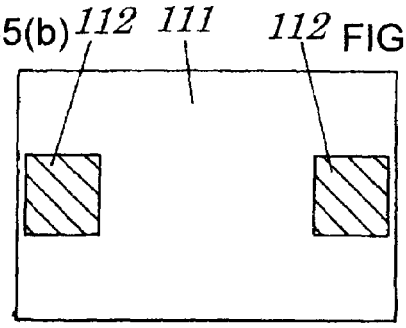
FIG. 45(e)
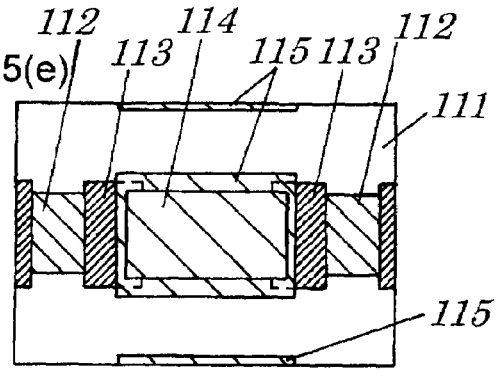
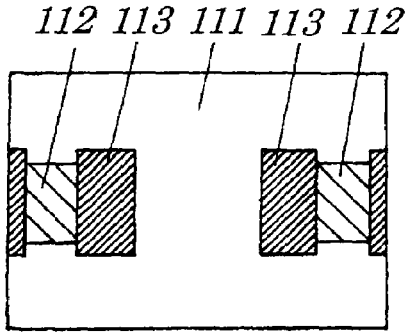
FIG. 45(c)
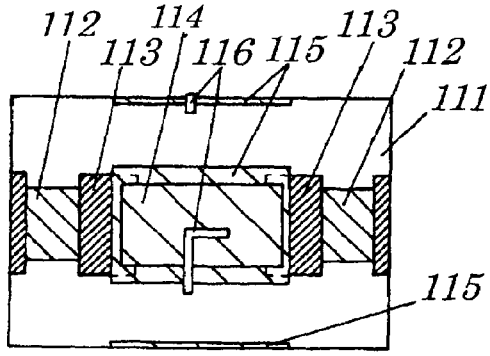
FIG. 45(f)

METHOD FOR FABRICATING A RESISTOR

This is a divisional of application Ser. No. 10/181,306, filed Oct. 22, 2002, now issued as U.S. Pat. No. 6,935,016 which is a National Phase Application of PCT International Application No. PCT/JP01/00251, filed Jan. 17, 2001.

TECHNICAL FIELD

The present invention relates to resistors and their manufacturing methods, and more particularly to fine resistors and their manufacturing methods.

BACKGROUND ART

One known resistor of this type is disclosed in Japanese Laid-open Patent No. H4-102302.

The conventional resistor and its manufacturing method are described below with reference to drawings.

FIG. 53 is a section view of this conventional resistor.

In FIG. 53, discrete substrate 1 made of ceramic such as alumina has insulation resistance. A pair of first upper electrode layers is provided on both left and right ends of the top face of discrete substrate 1. Resistor layer 3 is provided on the top face of discrete substrate 1 such that a part of resistor layer 3 overlaps the pair of first top electrode layers 2. First protective layer 4 is provided such as to cover only and all resistor layer 3. Trimming groove 5 is created on resistor layer 3 and first protective layer 4 for adjusting a resistance. Second protective layer 6 is provided only on the top face of first protective layer 4. A pair of second top electrode layers 7 is provided on the top face of the pair of first top electrode layers 2 such that second top electrode layers 7 extend fully to the width of substrate strip 1. A pair of side electrode layers 8 is provided on both side faces of discrete substrate 1. A pair of nickel-plated layers 9 and a pair of solder-plated layers 10 are provided on the surface of the pair of second top electrode layers 7 and the pair of side electrode layers 8. Solder-plated layers 10 are at a lower level than second protective layer 6.

A method for manufacturing the conventional resistor as configured above is described next with reference to drawings.

FIGS. 54(*a*) to 54(*f*) are process charts illustrating how to manufacture the conventional resistor.

As shown in FIG. 54(*a*), the pair of first top electrode layers 2 is applied on both left and right ends of the top face of discrete substrate 1 having insulation resistance.

Then, as shown in FIG. 54(*b*), resistor layer 3 is applied on the top face of discrete substrate 1 such that a part of resistor layer 3 is overlaid on the pair of first top electrode layers 2.

Next, as shown in FIG. 54(*c*), first protective layer 4 is applied so as to cover only and all resistor layer 3, and then trimming groove 5 is created on resistor layer 3 and first protective layer 4, typically using a laser, such that the total resistance at resistor layer 3 falls into a predetermined resistance range.

Then, as shown in FIG. 54(*d*), second protective layer 6 is applied only on the top face of first protective layer 4.

As shown in FIG. 54(*e*), the pair of second top electrode layers 7 is applied to the top face of the pair of first top electrode layers 2 to fully cover the width of substrate strip 1.

As shown in FIG. 54(*f*), the pair of side electrode layers 8 is applied to the pair of first top electrode layers 2 and both left and right side faces of discrete substrates 1 such that side electrode layer 8 are electrically coupled to the pair of first and second top electrode layers 2 and 7.

Lastly, the surfaces of the pair of second top electrode layers 7 and the pair of side electrode layers 8 are nickel plated, and then soldered to form a pair of nickel-plated layers and a pair of solder-plated layers 10 to complete the conventional resistor.

The above resistor has been radically downsized, and a very small resistor of L 0.6 mm×W 0.3 mm×T 0.25 mm is currently being manufactured.

Problems with the above conventional configuration and method in manufacturing a very small resistor of L 0.6 mm×W 0.3 mm×T 0.25 mm are described next.

In the conventional insulated substrate sheet made of ceramic such as alumina, a substrate-splitting groove is created on the insulated substrate sheet before baking; the substrate is then baked to form the insulated substrate sheet. Accordingly, the substrate-splitting groove previously made on the insulated substrate sheet may have variations in its dimensions due to minute variations in the composition of the insulated substrate sheet and minute variations in the baking temperature of the insulated substrate sheet. (These dimensional variations may reach about 0.5 mm in an insulated substrate sheet of about 100 mm×100 mm.)

When an extremely fine resistor is manufactured using an insulated substrate sheet having such dimensional variations, the dimensions of each substrate need to be classified lengthwise and widthwise into extremely minute dimensional ranks, and screen printing masks corresponding to each dimensional rank need to be prepared for top electrode layer 2, resistor layer 3, and first protective layer 4. In addition, individual masks need to be used so as to match the dimensional rank of each substrate. As a result, the manufacturing process becomes very complicated. (If the dimensions in horizontal and vertical directions are classified in 0.05 mm steps, there will be 25 ranks widthwise and lengthwise respectively, resulting in about 600 ranks in total for lengthwise and widthwise classification.)

The present invention aims to solve the above problem by eliminating the need for dimensional classifications of substrates. Accordingly, one step, that of replacing a mask according to the dimensional rank of the substrate required in the prior art, may be eliminated, offering an inexpensive fine resistor.

SUMMARY OF THE INVENTION

In order to achieve the above objective, a resistor of the present invention includes a discrete substrate which is divided into pieces by cutting an insulated substrate sheet along a first slit dividing portion and a second dividing portion perpendicular to the first dividing portion; a pair of top electrode layers formed on the top face of the discrete substrate; a resistor layer formed such that it partially overlaps the pair of top electrode layers; a protective layer formed to cover the resistor layer; and a pair of side electrode layers comprising nickel electrodes formed on the side faces of individual discrete substrates such that they are electrically coupled to the pair of top electrode layers.

The above resistor employs a substrate which is made by dividing the insulated substrate sheet along the first slit dividing portion and the second dividing portion perpendicular to the first dividing portion. This eliminates the need for any dimensional classification of substrates. Accordingly, the present invention abolishes the process of using a mask specific to the dimensional rank of each discrete substrate as in the case of the prior art, thus offering an inexpensive fine resistor.

BRIEF DESCRIPTION OF THE DRAWINGS

FIGS. 35(*a*) to 35(*c*) are section views illustrating manufacturing processes of the resistor in accordance with the fourth exemplary embodiment of the present invention.

FIGS. 45(*a*) to 45(*f*) are plan views illustrating manufacturing processes of the resistor in accordance with the fifth exemplary embodiment of the present invention.

DETAILED DESCRIPTION OF THE PREFERRED EMBODIMENTS

First Exemplary Embodiment

A resistor and its manufacturing method in a first exemplary embodiment of the present invention are described below with reference to drawings.

Figure 1:
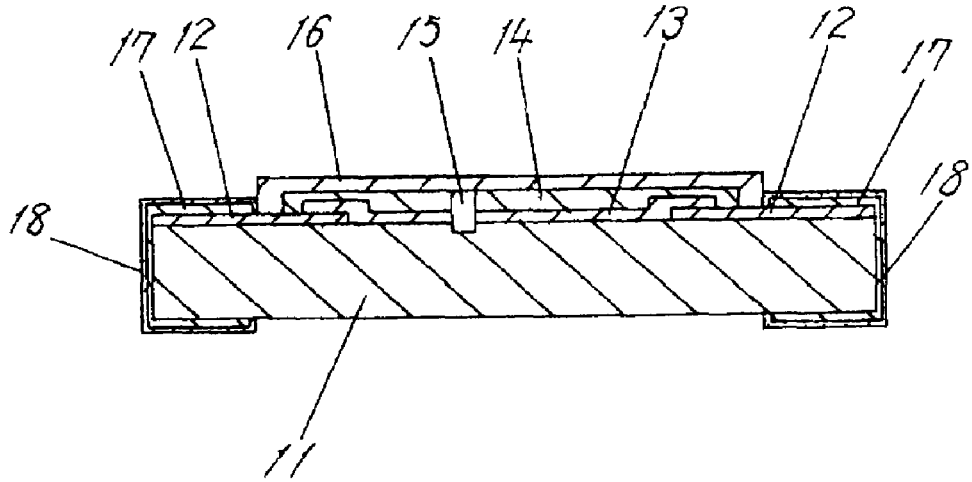
FIG. 1 is a section view of a resistor in accordance with a first exemplary embodiment of the present invention.

FIG. 1 is a section view of the resistor in the first exemplary embodiment of the present invention.

In FIG. 1, a prebaked insulated substrate sheet is made of alumina of 96% purity. Discrete substrate 11 is made by cutting this substrate sheet along a first slit dividing portion and a second dividing portion perpendicular to the first dividing portion. A pair of top electrode layers 12, made mainly of silver, is formed on the top face of discrete substrate 11. Resistor layer 13, made of ruthenium oxide system, is formed on the top face of discrete substrate 11 such that it partially overlaps the pair of top electrode layers 12. First protective layer 14, which is a precoat glass layer, is formed on the top face of resistor layer 13. Trimming groove 15 is provided to adjust a resistance of resistor layer 13 between the pair of top electrode layers 12. Second protective layer 16, made mainly of resin, is formed to cover first protective layer 14 which is a precoat glass layer. A pair of side electrode layers 17 is formed so as to partially overlap the pair of top electrode layers 12 and also cover both side faces and both ends of the rear face of discrete substrate 11. Solder layer 18, made of tin, is formed so as to cover the pair of side electrode layers 17 and a part of the pair of top electrode layers 12.

A method for manufacturing the resistor in the first exemplary embodiment as configured above is described next with reference to drawings.

Figure 2:
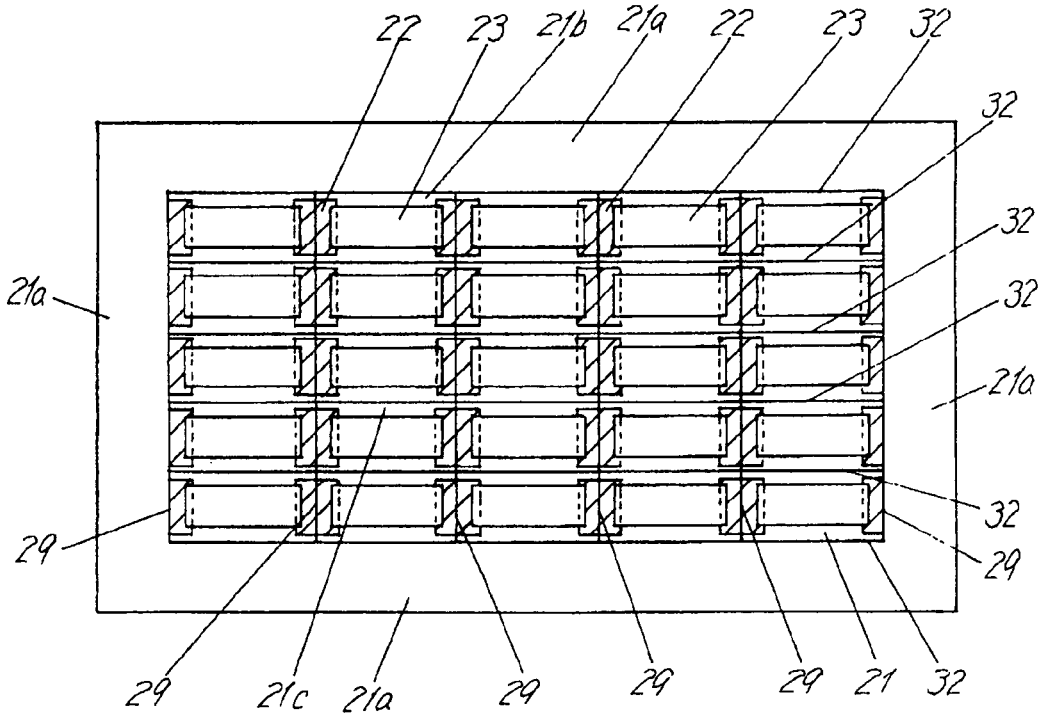
FIG. 2 is atop view illustrating the state in which an ineffective area is formed on the entire periphery of the insulated substrate sheet used for manufacturing the resistor in accordance with the first exemplary embodiment of the present invention.
Figure 3A:
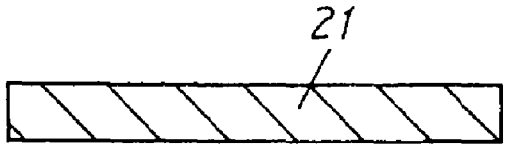
FIGS. 3(*a*) to 3(*e*) are section views illustrating manufacturing processes of the resistor in accordance with the first exemplary embodiment of the present invention.
Figure 3B:
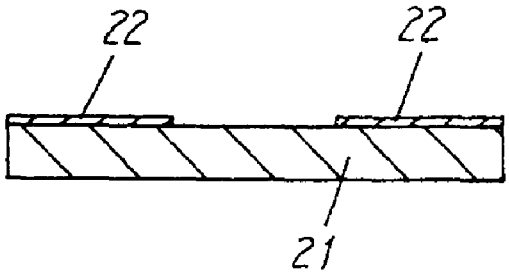
Figure 3C:
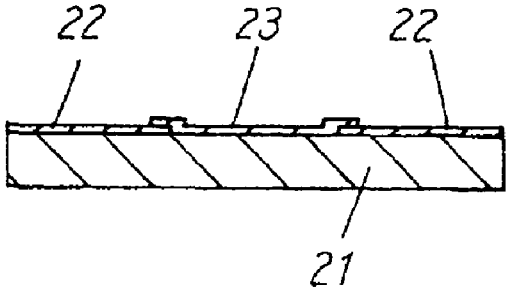
Figure 3D:
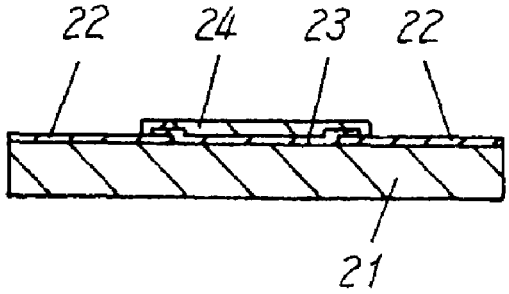
Figure 3E:
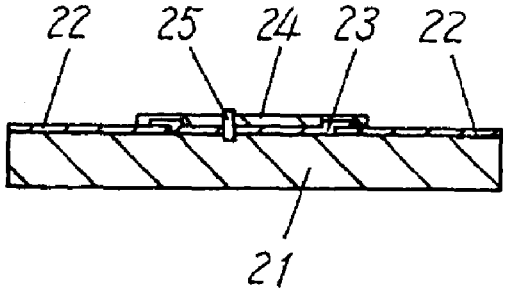
Figures 4A, 4B, 4C, 4D, 4E:
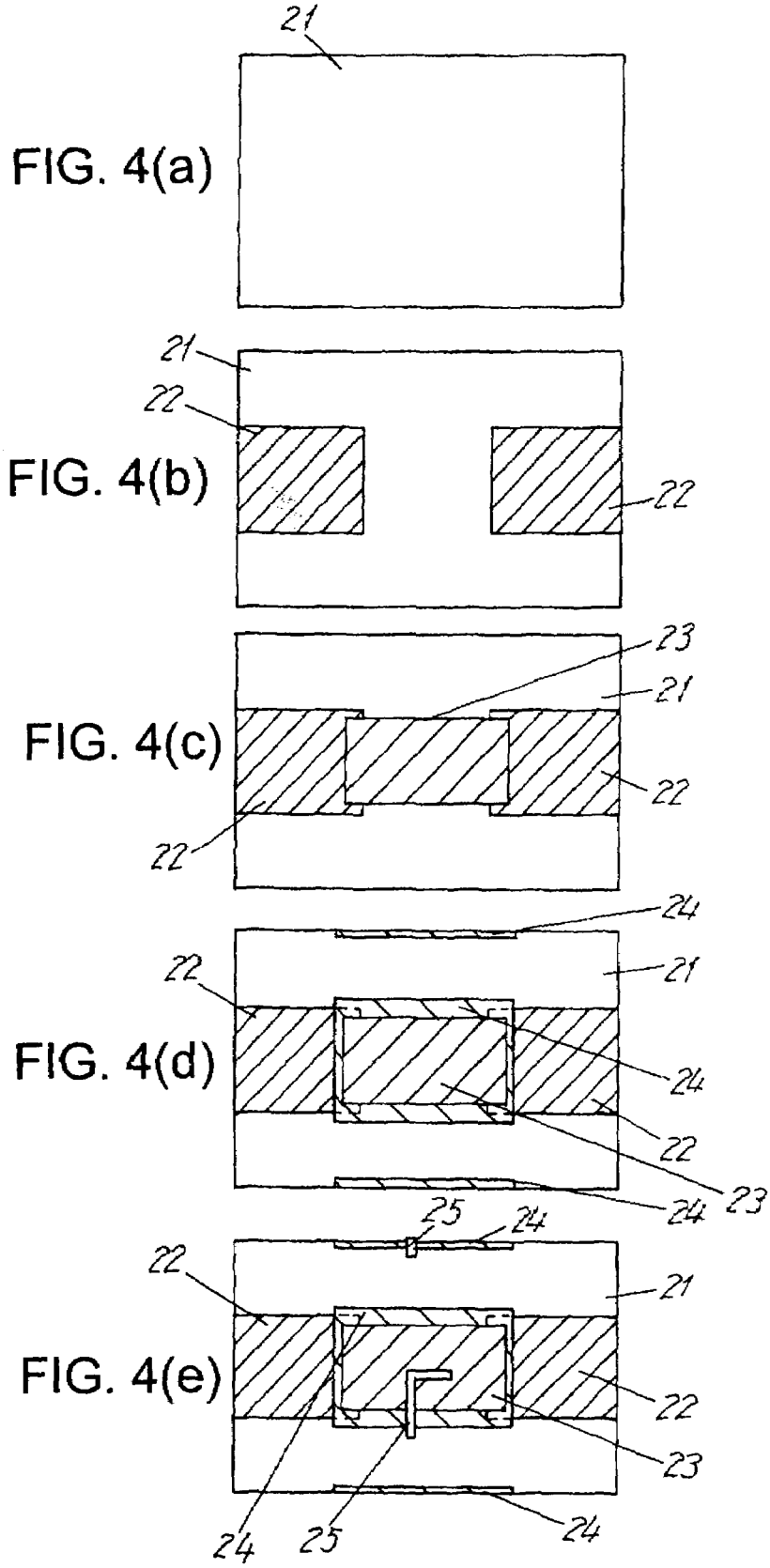
FIGS. 4(*a*) to 4(*e*) are plan views illustrating manufacturing processes of the resistor in accordance with the first exemplary embodiment of the present invention.
Figure 5A:
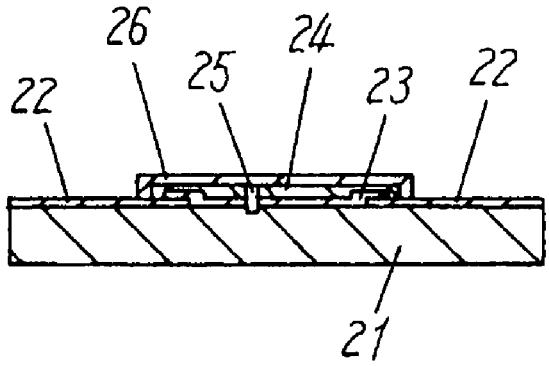
FIGS. 5(*a*) to 5(*d*) are section views illustrating manufacturing processes of the resistor in accordance with the first exemplary embodiment of the present invention.
Figure 5B:
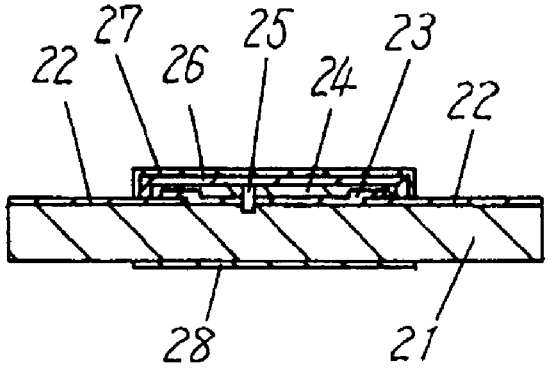
Figure 5C:
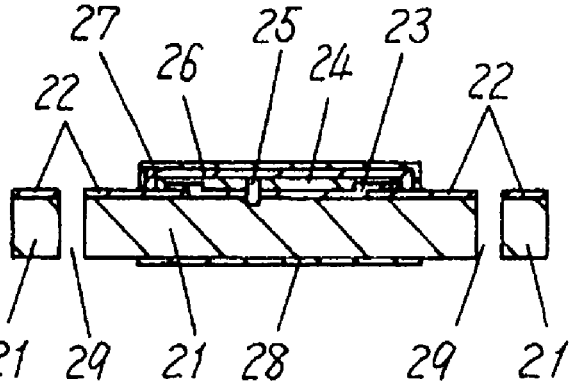
Figure 5D:
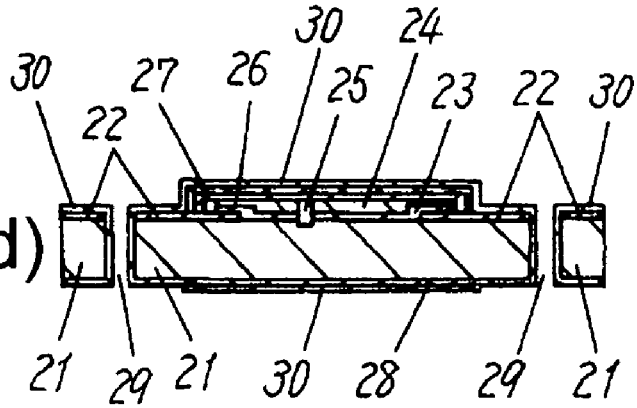
Figure 6A:
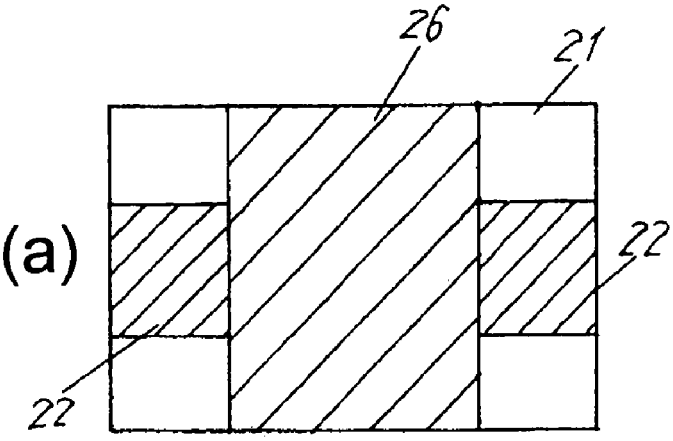
FIGS. 6(*a*) to 6(*d*) are plan views illustrating manufacturing processes of the resistor in accordance with the first exemplary embodiment of the present invention.
Figure 6B:
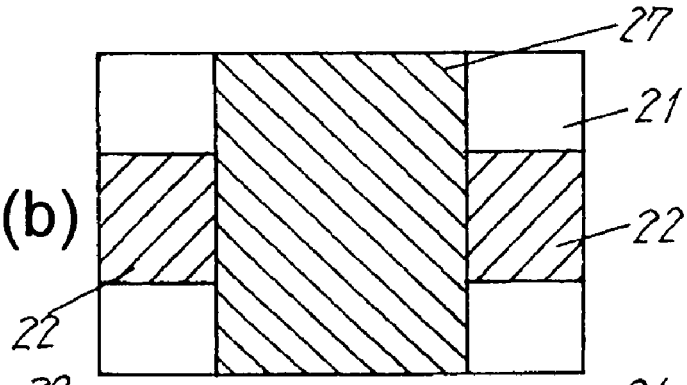
Figure 6C:
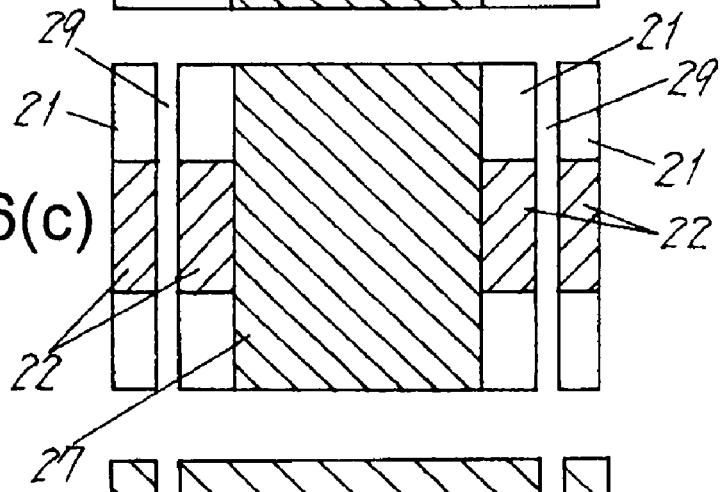
Figure 6D:
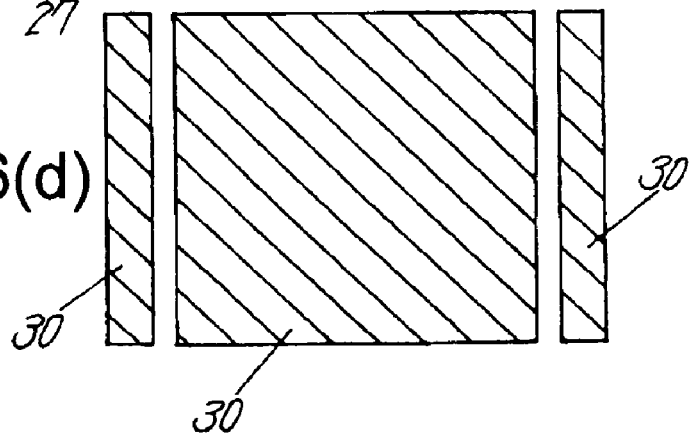

FIG. 2 is a top view illustrating the state in which a ineffective area is formed on the entire periphery of the insulated substrate sheet used for manufacturing the resistor in the first exemplary embodiment of the present invention. FIGS. 3(*a*) to 3(*e*), FIGS. 4(*a*) to 4(*e*), FIGS. 5(*a*) to 5(*d*), FIGS. 6(*a*) to 6(*d*), FIGS. 7(*a*) to 7(*c*), and FIGS. 8(*a*) to 8(*c*) are process charts of the manufacturing method of the resistor in the first exemplary embodiment of the present invention.

As shown in FIGS. 2, 3(*a*), and 4(*a*), prebaked insulated substrate sheet 21 which is 0.2 mm thick, made of alumina of 96% purity, is prepared. Here, insulated substrate sheet 21, as shown in FIG. 2, has ineffective area 21*a* which will not become products, on its periphery. This ineffective area 21*a* is configured in a frame shape.

Next, as shown in FIGS. 2, 3(*b*), and 4(*b*), two or more pairs of top electrode layers 22, made mainly of silver, are screen-printed on the top face of insulated substrate sheet 21. Insulated substrate sheet 21 is then baked according to a baking profile with a peak temperature of 850° C. to stabilize top electrode layers 22.

Next, as shown in FIGS. 2, 3(*c*), and 4(*c*), two or more resistor layers 23 made of ruthenium oxide system are screen-printed so as to bridge two or more pairs of top electrode layers 22. Insulated substrate sheet 21 is then baked according to a baking profile with a peak temperature of 850° C. to stabilize resistor layers 23.

Then, as shown in FIGS. 3(*d*) and 4(*d*), first protective layer 24 made of two or more precoat glass layers is screen-printed to cover resistor layers 23. Insulated substrate sheet 21 is baked again following a baking profile with a peak temperature of 600° C. to stabilize first protective layer 24 made of the precoat glass layers.

Next, as shown in FIGS. 3(*e*) and 4(*e*), two or more trimming grooves 25 are made using a laser trimming method for adjusting the resistance of resistor layers 23 between pairs of top electrode layers 22 to a predetermined value.

Next, as shown in FIGS. 5(*a*) and 6(*a*), two or more second protective layers 26, mainly made of resin, are screen-printed to cover first protective layer 24, consisting of precoat glass layers, aligned vertically on the drawing.

The substrate sheet is cured following a curing profile with a peak temperature of 200° C. for stabilizing second protective layers 26.

Next, as shown in FIG. 5(*b*) and FIG. 6(*b*), two or more first resist layers 27 are screen-printed to cover second protective layers 26, and first resist layers 27 are stabilized by UV-ray curing. Furthermore, two or more second resist layers 28 are screen-printed on the rear face of insulated substrate sheet 21, and second resist layers 28 are stabilized also by UV-ray curing.

Next, as shown in FIGS. 2, 5(*c*), and 6(*c*), two or more first slit dividing portions 29 are formed by dicing on insulated substrate sheet 21, on which first resist layers 27 and second resist layers 28 are formed, except on ineffective area 21*a* formed over the entire periphery of insulated substrate sheet 21. First slit dividing portions 29 are used for dividing insulated substrate sheet 21 into substrate strips 21*b* by separating pairs of top electrode layers 22. In this case, first slit dividing portions 29 are formed at a pitch of 700 μm, with a width of 120 μm. In addition, first slit dividing portions 29 are through holes which pass vertically through insulated substrate sheet 21. Insulated substrate sheet 21 still remains as a sheet even after first slit dividing portions 29 are formed by dicing except on ineffective area 21*a*, because substrate strips 21*b* are connected by ineffective area 21*a*.

Next, as shown in FIGS. 5(*d*) and 6(*d*), insulated substrate sheet 21 is entirely plated with nickel, using electroless plating, by dipping insulated substrate sheet 21 into a plating bath to form side electrode layer 30 of about 4 to 6 μm thick. When side electrode layer 30 is formed by plating nickel onto the entire face of insulated substrate sheet 21 by electroless plating, side electrode layer 30 is also formed on the rear face of insulated substrate sheet 21 through the entire inner face of first slit dividing portions 29 which is a through hole from the top face of insulated substrate sheet 21. This is because first slit dividing portions 29 are through holes which pass vertically through insulated substrate sheet 21. In addition, side electrode layer 30 covers a part of top electrode layer 22 exposed and first resist layer 27 on the top face of insulated substrate sheet 21. On the rear face of insulated substrate sheet 21, side electrode layer 30 covers second resist layer 28.

Figure 7A:
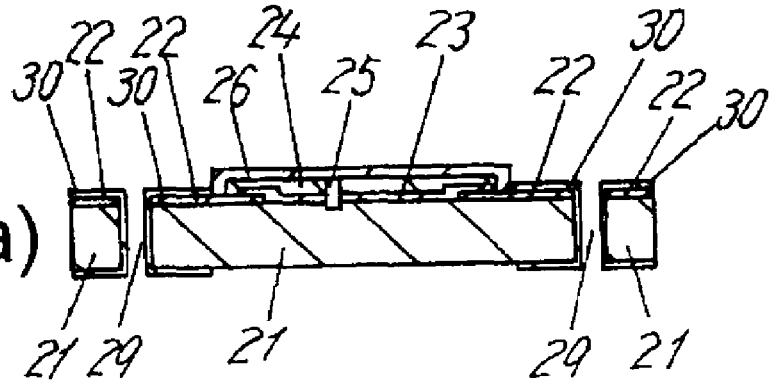
FIGS. 7(*a*) to 7(*c*) are section views illustrating manufacturing processes of the resistor in accordance with the first exemplary embodiment of the present invention.
Figure 7B:
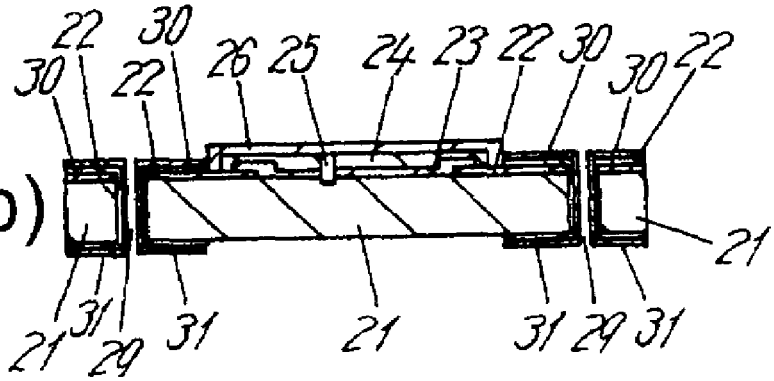
Figure 7C:
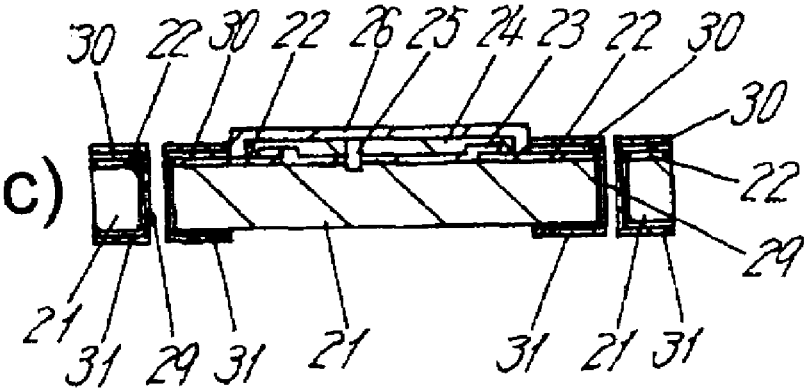
Figure 8A:
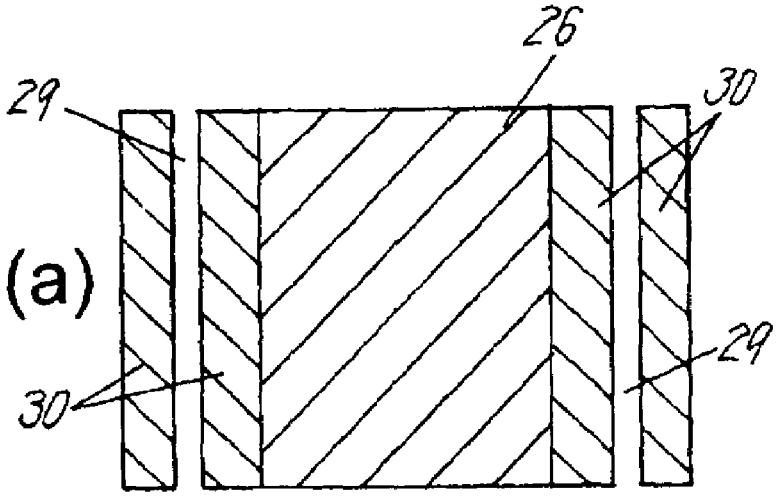
FIGS. 8(*a*) to 8(*c*) are plan views illustrating manufacturing processes of the resistor in accordance with the first exemplary embodiment of the present invention.
Figure 8B:
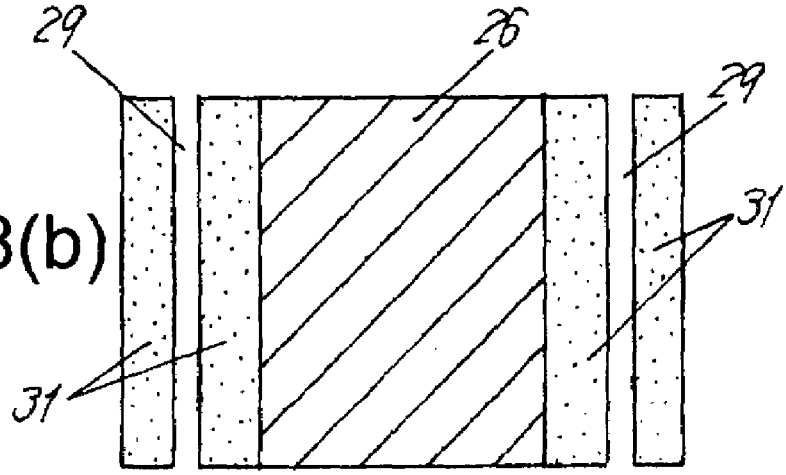
Figure 8C:
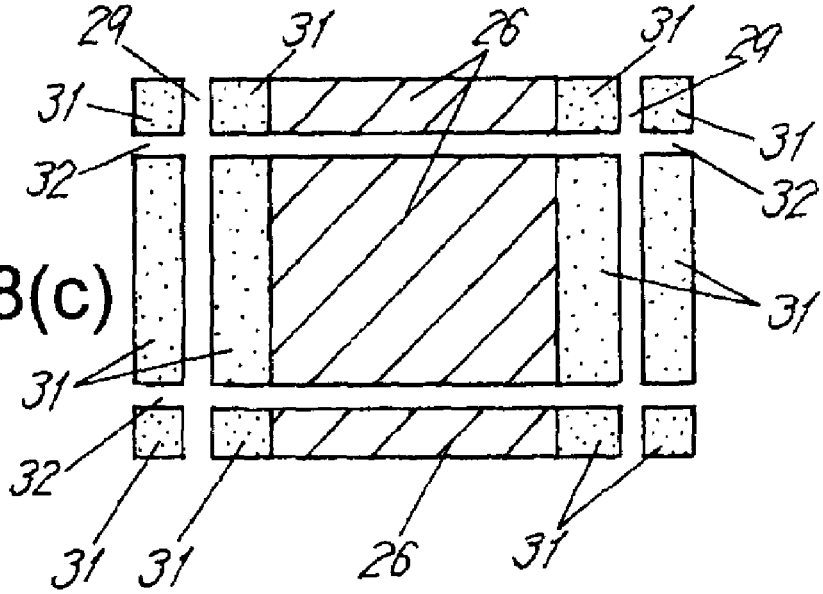

Next, as shown in FIGS. 7(*a*) and 8(*a*), first resist layers (not illustrated) and second resist layers (not illustrated) are peeled for patterning two or more pairs of side electrode layers 30.

Next, as shown in FIGS. 7(*b*) and 8(*b*), two or more pairs of solder layers 31, made of tin, of about 4 to 6 μm in thickness, are electroplated to cover pairs of side electrode layers 30 exposed and a part of pairs of top electrode layers 22 exposed by peeling off first resist layers (not illustrated).

Thickness of side electrode layer 30 is about 4 to 6 μm, but this is not limited. Appropriate thickness of side electrode layer 30 is 1 to 15 μm. Since side electrode layer 30 is nickel plated by electroless plating, a layer which does not have magnetic properties is formed. Accordingly, side electrode layer 30 with extremely high dimensional accuracy is achievable. Improved reliability of vacuum-holding the resistor with a suction pin for mounting in an automated mounter also assures high mountability.

Solder layer 31 in the first exemplary embodiment is made of tin. However, the present invention is not limited to tin Solder layer 31 may be made of a tin alloy material. In this case, reliable soldering is achievable by reflow soldering.

Moreover, top electrode layer 22 is made of a silver material and resistor layer 23 is made of a ruthenium oxide material in the first exemplary embodiment. These assure resistance characteristics with good heat resistance and durability.

Furthermore, the protective layer which covers resistor layer 23 is configured with two layers: i) first protective layer 24 which is a precoat glass layer covering resistor layer 23 and ii) second protective layer 26, mainly made of resin, which covers first protective layer 24 and trimming groove 25. First protective layer 24 prevents occurrence of cracking during laser trimming to reduce current noise, and second protective layer 26, mainly comprising resin, secures resistance characteristics with good humidity resistance by covering the entire resistor layer 23.

Lastly, as shown in FIGS. 2, 7(*c*), and 8(*c*), two or more second dividing portions 32 are diced in a direction perpendicular to first slit dividing portions 29 except on ineffective area 21*a* formed on the entire periphery of the insulated substrate sheet. This allows resistor layers 23 on substrate strips 21*b* in insulated substrate sheet 21 to be separated into individual discrete substrates 21*c*. In this case, second dividing portions 32 are formed at a pitch of 400 μm, with a width of 100 μm. Since these second dividing portions 32 are formed by dicing on substrate strips 21*b* except on ineffective area 21*a*, substrate strips 21*b* are divided into discrete substrates 21*c* every time second dividing portion 32 is formed. Substrate strips divided into individual products are separated from ineffective area 21*a*.

The resistor in the first exemplary embodiment is manufactured using the above processes.

The total length and total width of the resistor, which is a product, made through the above processes are precisely 0.6 mm L×0.3 mm W. This is because the pitch of first slit dividing portions 29 and second dividing portions 32 made by dicing are accurate (within ±0.005 mm) and the thicknesses of side electrode layer 30 and solder layer 31 are also accurate. Moreover, the patterning accuracy of top electrode layers 22 and resistor layers 23 eliminates the need for dimensional ranking of discrete substrates, and also the need to take into account dimensional variations in discrete substrates within the same dimensional ranking. The effective area of resistor layer 23 is thus broader than that of the prior art. More specifically, the resistor layer in the prior art is about 0.20 mm L×0.19 mm W. Resistor layer 23 of the resistor in the first exemplary embodiment of the present invention is about 0.25 mm L×0.24 mm W, which is about 1.6 times larger in area.

Since first slit dividing portions 29 and second dividing portions 32 are formed by dicing, insulated substrate sheet 21 which does not require dimensional ranking of discrete substrates may be used. This eliminates the need for classifying discrete substrates by dimensions as in the prior art, thereby eliminating the complicated process of replacing a mask in the prior art. Dicing can also be performed easily using a general dicing machine for semiconductors or the like.

Insulated substrate sheet 21 is framed by ineffective area 21*a* which does not become a product. In addition, first slit dividing portions 29 and second dividing portions 32 are not formed on this ineffective area 21*a*. Accordingly, substrate strips 21*b* are connected to ineffective area 21*a* even after forming first slit dividing portions 29. This prevents insulated substrate sheet 21 from being separated into individual substrate strips 21*b*. Remaining processes are thus implemented on insulated substrate sheet 21 with ineffective area 21*a* even after first slit dividing portions 29 are formed, thereby contributing to the simplification of process design. Furthermore, when second dividing portions 32 are formed, insulated substrate sheet 21 is cut into discrete substrates 21*c* every time second dividing portion 32 is formed. Each discrete substrate 21*c*, which is a product, is thus separated from ineffective area 21*a*, thereby eliminating the process of sorting ineffective area 21*a* and products afterwards.

Still more, side electrode layers 30 are formed on insulated substrate sheet 21 because pairs of side electrode layers 30 and pairs of solder layers 31 are formed on insulated substrate 21 in the form of a sheet before being divided. Potential difference during the formation of solder layers 31 by electroplating may also be reduced, thereby allowing the formation of stable solder layer 31.

Figure 9:
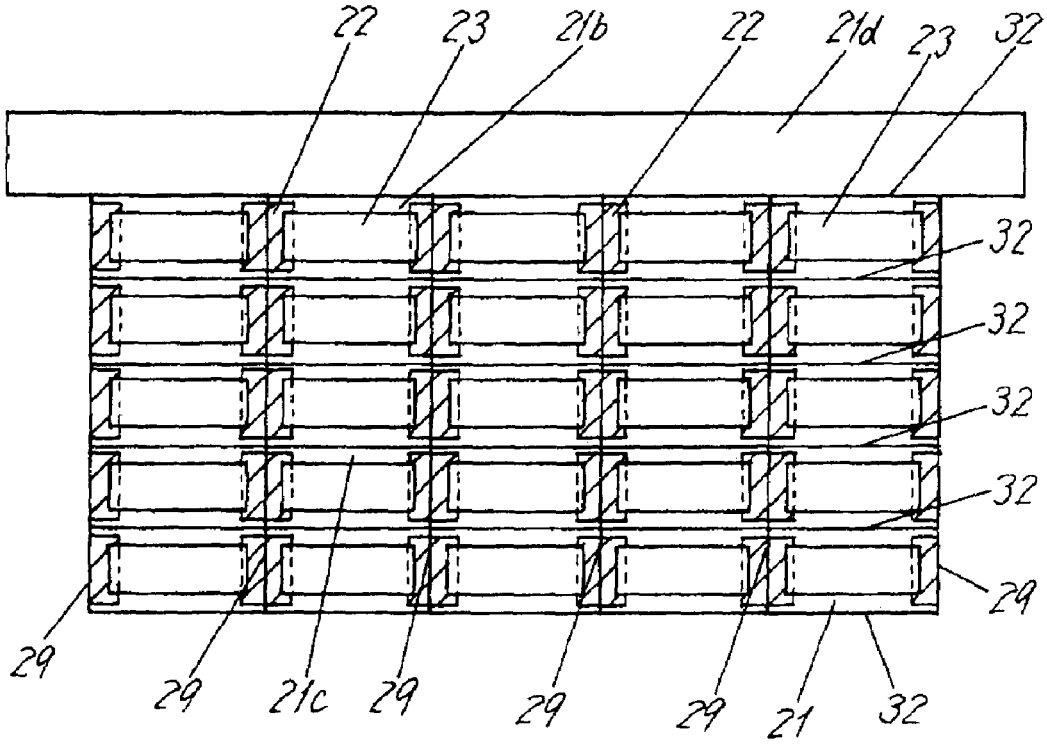
FIG. 9 is a top view illustrating the state in which an ineffective area is formed on one end of the insulated substrate sheet used for manufacturing the resistor in the first exemplary embodiment of the present invention.
Figure 10:
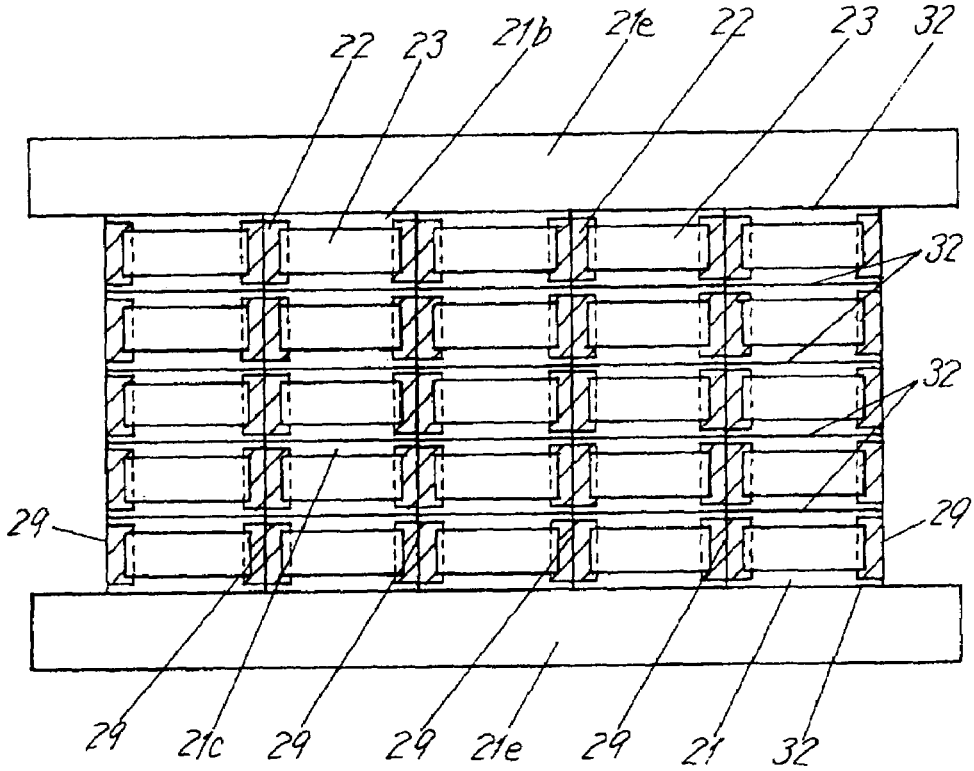
FIG. 10 is a top view illustrating the state in which an ineffective area is formed on both ends of the insulated substrate sheet used for manufacturing the resistor in the first exemplary embodiment of the present invention.
Figure 11:
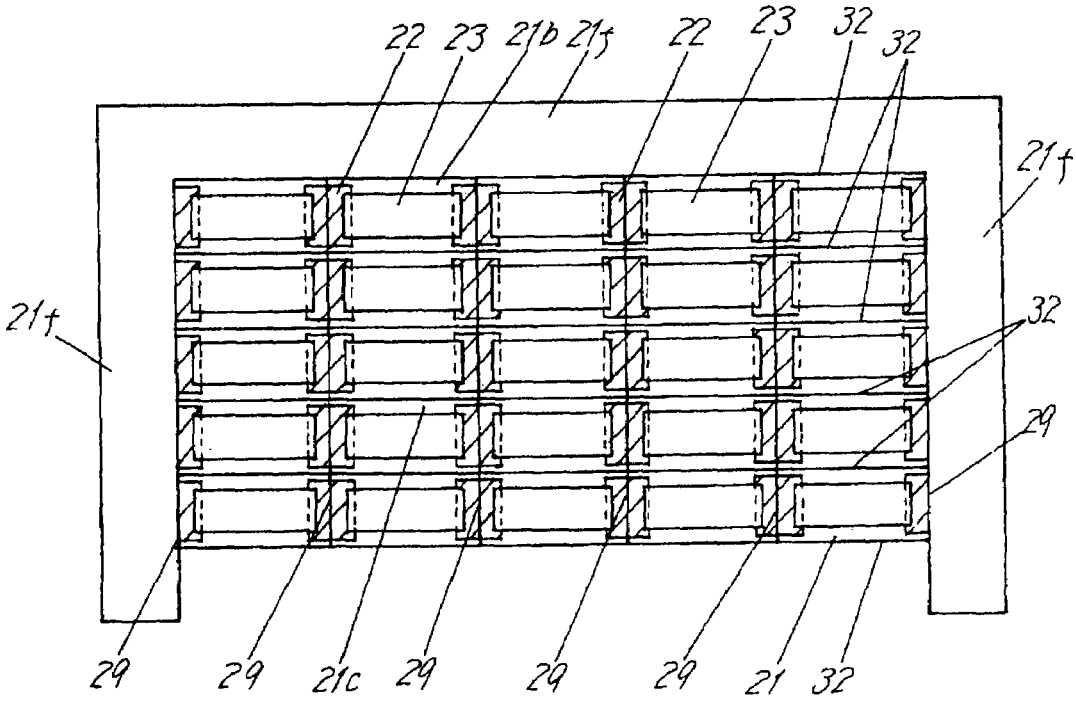
FIG. 11 is a top view illustrating the state in which an ineffective area is formed on three ends of the insulated substrate sheet used for manufacturing the resistor in the first exemplary embodiment of the present invention.

The first exemplary embodiment of the present invention describes the case of forming ineffective area 21*a* which does not become a part of a finished product on the entire periphery of insulated substrate sheet 21 in a shape of a frame. However, ineffective area 21*a* may not need to frame insulated substrate sheet 21. For example, as shown in FIG. 9, ineffective area 21*d* may be formed on one end of insulated substrate sheet 21. Alternatively, as shown in FIG. 10, ineffective area 21*e* may be formed on both ends of insulated substrate sheet 21. Alternatively, as shown in FIG. 11, ineffective area 21*f* may be formed on three ends of insulated substrate sheet 21. All these demonstrate the same effect as that of the first exemplary embodiment of the present invention.

The first exemplary embodiment of the present invention also describes the case of forming second dividing portions 32 by dicing. In other cases, for example, second dividing portions 32 may be formed by cutting the top, rear, or center of insulated substrate sheet 21, using a laser beam or dicing, while retaining a thinned portion in the top, rear, or center parts of insulated substrate sheet 21. In this case, the insulated substrate sheets are not immediately divided into pieces by forming second dividing portions but in two steps.

The first exemplary embodiment also describes the case of forming first slit dividing portions 29 after forming first resist layer 27 and second resist layer 28.

However, first resist layer 27 and second resist layer 28 may be formed after forming first slit dividing portions 29. In this case, however, printing pressure for screen printing need to be reduced because the strength of insulated substrate sheet 21 is reduced when first resist layer 27 and second resist layer 28 are screen-printed after forming first slit dividing portions 29.

Furthermore, second resist layer 28 may be formed immediately after forming the first protective layer, which is precoat glass layers. This also achieves the same effect as that of the first exemplary embodiment.

Still more, the first exemplary embodiment of the present invention describes the case of peeling first resist layer 27 and second resist layer 28 before forming solder layer 31. These resist layers may also be peeled after forming solder layer 31.

Still more, the first exemplary embodiment of the present invention uses a silver material for the top electrode layer 22 and a ruthenium oxide material for resistor layer 23. The use of other materials also achieves the same effect as that of the first exemplary embodiment of the present invention.

The first exemplary embodiment of the present invention also describes the case of forming first slit dividing portions 29 and second dividing portions 32 by dicing. The same effect as that of the first exemplary embodiment is also achievable by using other means such as a laser or water jet for making first slit dividing portions and second dividing portions.

Also in the first exemplary embodiment, a pair of top electrode layers 12 is formed on the top face of discrete substrate 11. Resistor layer 13 is then formed to cover a part of the pair of top electrode layers 12. Conversely, resistor layer 13 may be formed on the top face of discrete substrate 11, and then a pair of top electrode layers 12 is formed to cover a part of resistor layer 13. This also achieves the same effect as that of the first exemplary embodiment of the present invention.

Furthermore, the first exemplary embodiment of the present invention describes the case of forming first slit dividing portions 29 on insulated substrate sheet 21 after forming pairs of top electrode layers 22, resistor layers 23, first protective layers 24, trimming grooves 25, second protective layers 26, first resist layers 27, and second resist layers 28 when first slit dividing portions 29 are formed for dividing the substrate into substrate strips 21*b*. However, the present invention is not limited to processes in this sequence. For example, first slit dividing portions 29 may be formed on insulated substrate sheet 21 first or insulated substrate sheet 21 already provided with first slit dividing portions 29 may be used for manufacture. Alternatively, first slit dividing portions 29 may be formed on insulated substrate sheet 21 after forming pairs of top electrodes layers 22 on insulated substrate sheet 21. Or, first slit dividing portions 29 may be formed on insulated substrate sheet 21 after resistor layers 23 are formed on insulated substrate sheet 21. Or, first slit dividing portions 29 may be formed on insulated substrate sheet 21 after pairs of top electrode layers 22 are formed on insulated substrate sheet 21, and then resistor layers 23 are formed such that a part of resistor layers 23 overlaps pairs of top electrode layers 22. Alternatively, first slit dividing portions 29 may be formed on insulated substrate sheet 21 after forming resistor layers 23 on insulated substrate sheet 21 and then pairs of top electrode layers 22 are formed such that a part of top electrode layers 22 overlaps resistor layers 23. Or, first slit dividing portions 29 may be formed on insulated substrate sheet 21 after pairs of top electrode layers 22 and resistor layers 23 are formed on insulated substrate sheet 21 and trimming is applied to adjust the resistance in these resistor layers 23 between pairs of top electrode layers 22. In all the above cases, the same effect is achievable as that of the first exemplary embodiment of the present invention.

Second Exemplary Embodiment

A method for manufacturing a resistor in a second exemplary embodiment of the present invention is described below with reference to drawings.

Figure 12:
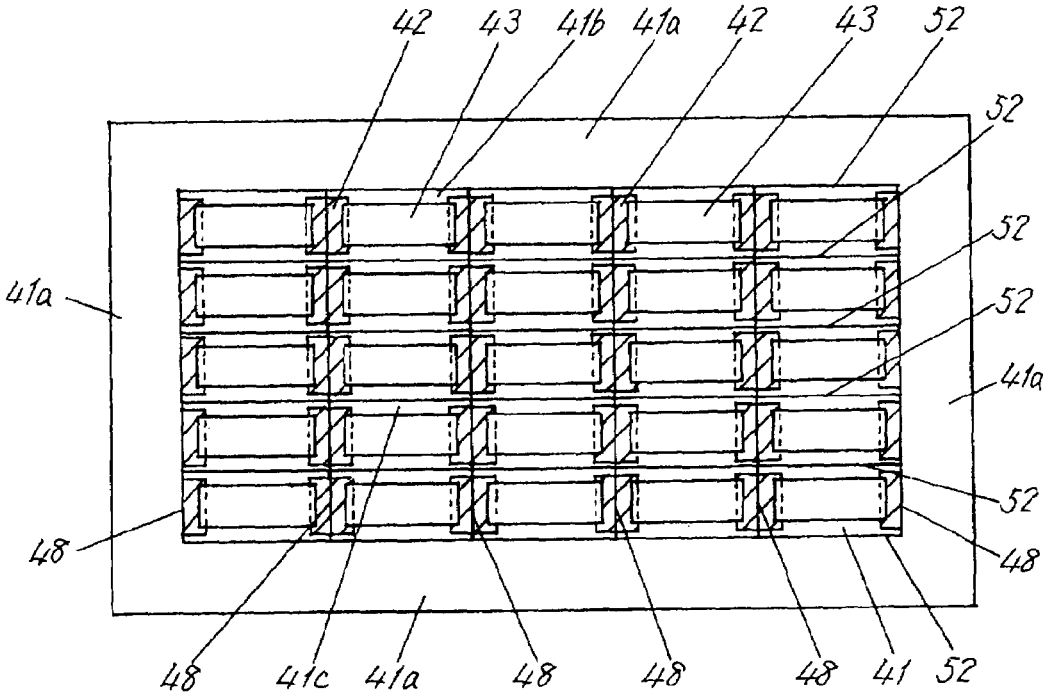
FIG. 12 is a top view illustrating the state in which an ineffective area is formed on the entire periphery of the insulated substrate sheet used for manufacturing a resistor in accordance with a second exemplary embodiment of the present invention.
Figure 13A:
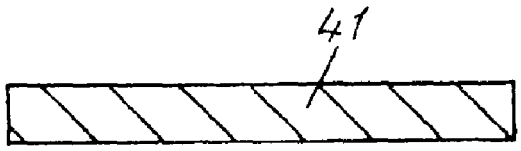
FIGS. 13(*a*) to 13(*e*) are section views illustrating manufacturing processes of the resistor in accordance with the second exemplary embodiment of the present invention.
Figure 13B:
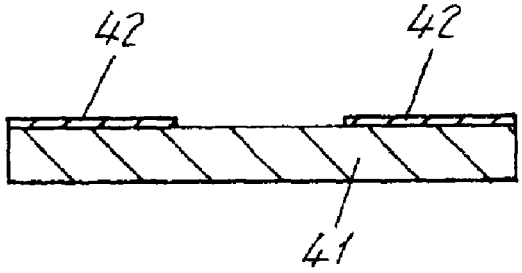
Figure 13C:
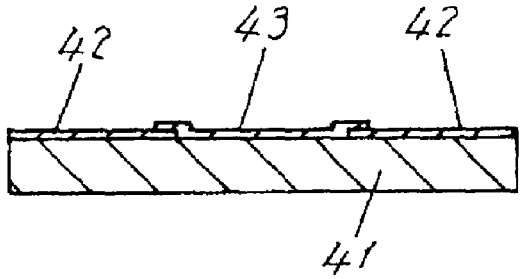
Figure 13D:
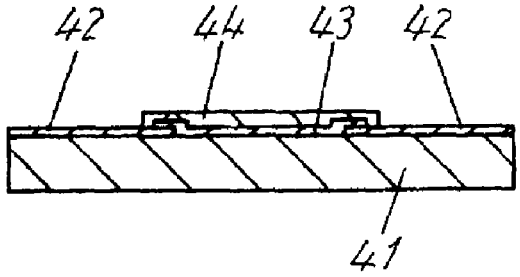
Figure 13E:
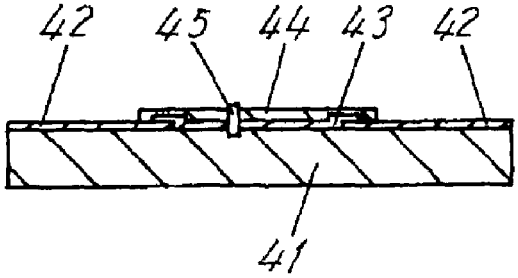
Figure 14A:
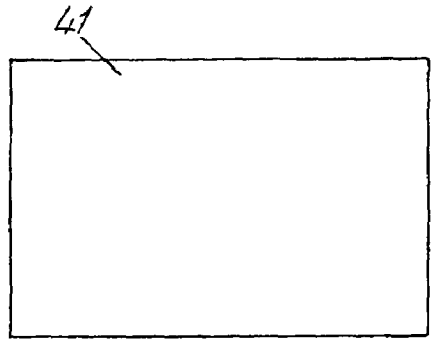
FIGS. 14(*a*) to 14(*e*) are plan views illustrating manufacturing processes of the resistor in accordance with the second exemplary embodiment of the present invention.
Figure 14B:
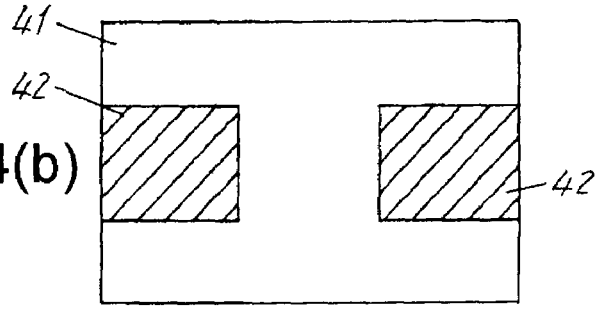
Figure 14C:
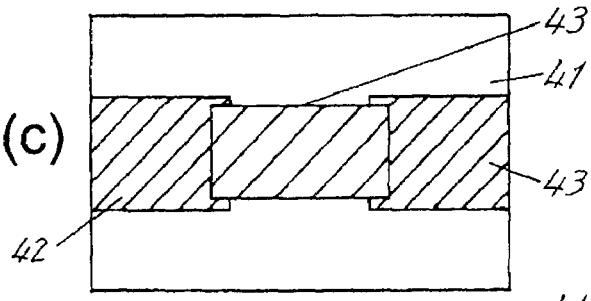
Figure 14D:
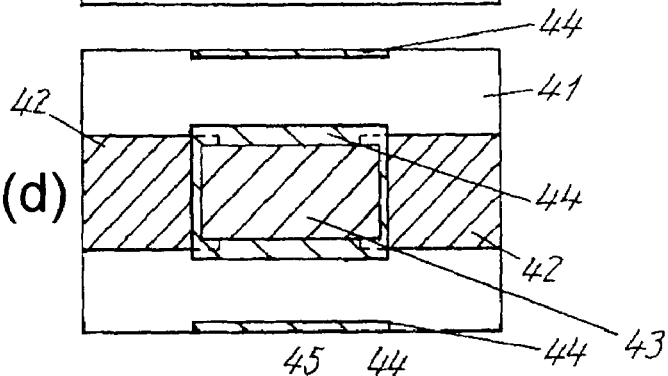
Figure 14E:
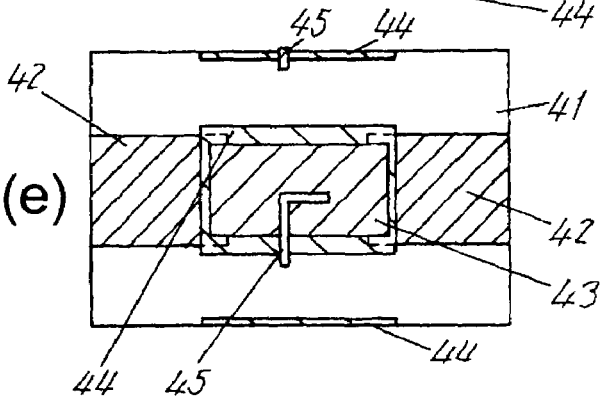
Figure 15A:
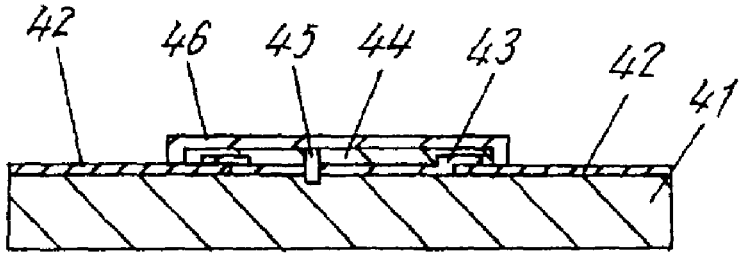
FIGS. 15(*a*) to 15(*d*) are section views illustrating manufacturing processes of the resistor in accordance with the second exemplary embodiment of the present invention.
Figure 15B:
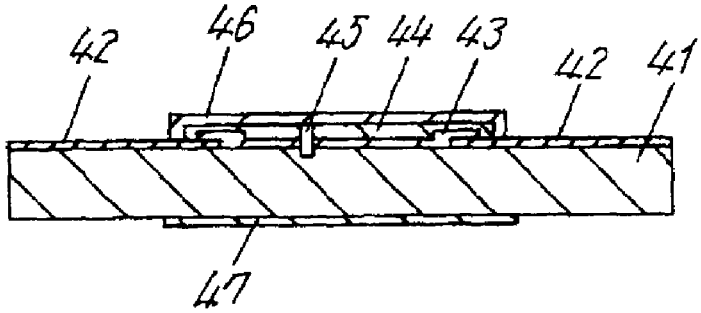
Figure 15C:
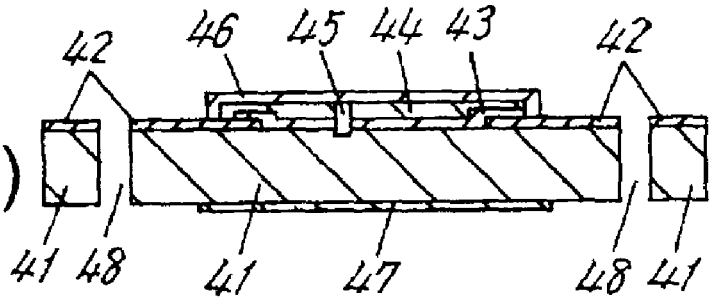
Figure 15D:
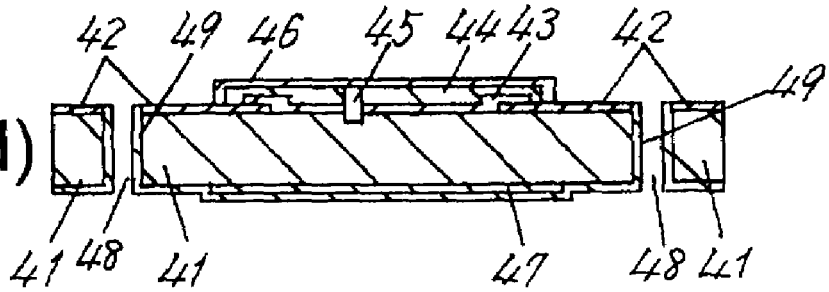
Figure 16A:
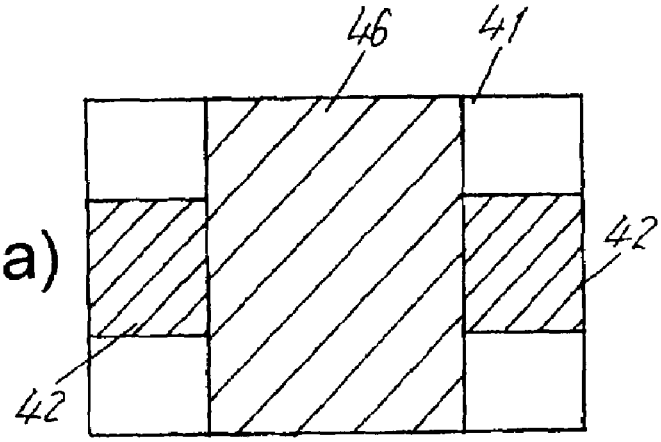
FIGS. 16(*a*) to 16(*d*) are plan views illustrating manufacturing processes of the resistor in accordance with the second exemplary embodiment of the present invention.
Figure 16B:
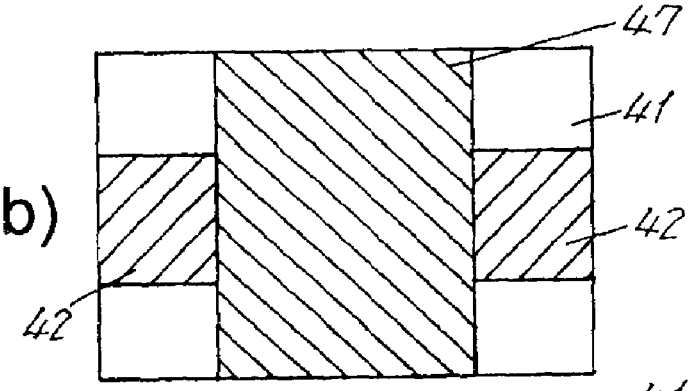
Figure 16C:
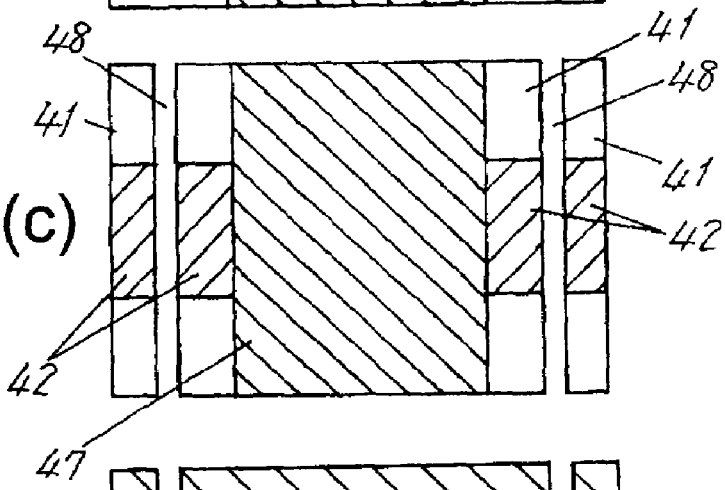
Figure 16D:
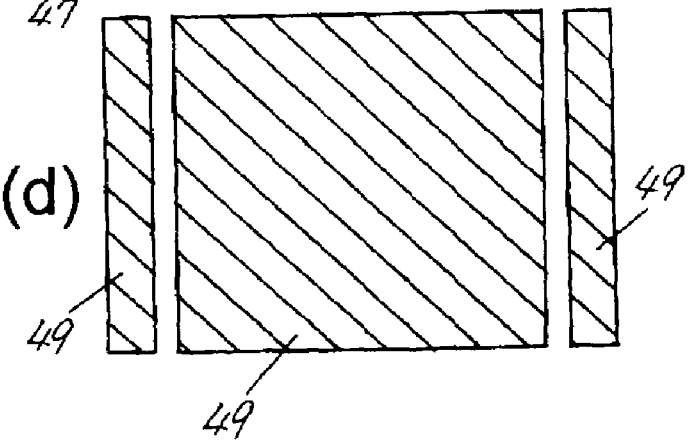

FIG. 12 is a top view illustrating the state in which a ineffective area is formed on the entire periphery of an insulated substrate sheet used for manufacturing the resistor in the second exemplary embodiment of the present invention. FIGS. 13(*a*) to 13(*e*), FIGS. 14(*a*) to 14(*e*), FIG. 15(*a*) to 15(*d*), FIGS. 16(*a*) to 16(*d*), FIGS. 17(*a*) to 17(*c*), and FIGS. 18(*a*) to 18(*c*) are process charts of the manufacturing method of the resistor in the second exemplary embodiment of the present invention.

As shown in FIGS. 12, 13(*a*), and 14(*a*), prebaked insulated substrate sheet 41 which is 0.2 mm thick, made of alumina of 96% purity, is prepared. Here, insulated substrate sheet 41, as shown in FIG. 12, has ineffective area 41*a* which will not become products, on its entire periphery. This ineffective area 41*a* is configured in a frame shape.

Next, as shown in FIGS. 12, 13(*b*), and 14(*b*), two or more pairs of top electrode layers 42, made mainly of silver, are screen-printed on the top face of insulated substrate sheet 41. Insulated substrate sheet 41 is then baked according to a baking profile with a peak temperature of 850° C. to stabilize top electrode layers 42.

Next, as shown in FIGS. 12, 13(*c*), and 14(*c*), two or more resistor layers 43 made of ruthenium oxide system are screen-printed so as to bridge two or more pairs of top electrode layers 42. Insulated substrate sheet 41 is then baked according to a baking profile with a peak temperature of 850° C. to stabilize resistor layers 43.

Then, as shown in FIGS. 13(*d*) and 14(*d*), first protective layer 44 made of two or more precoat glass layers is screen-printed to cover resistor layers 43. Insulated substrate sheet 41 is baked again following a baking profile with a peak temperature of 600° C. to stabilize first protective layer 44 made of the precoat glass layers.

Next, as shown in FIGS. 13(*e*) and 14(*e*), two or more trimming grooves 45 are made using a laser trimming method for adjusting the resistance of resistor layers 43 between pairs of top electrode layers 42 to a predetermined value.

Next, as shown in FIGS. 15(*a*) and 16(*a*), two or more second protective layers 46, mainly made of resin, are screen-printed to cover first protective layer 44, consisting of precoat glass layers, aligned vertically on the drawing. The substrate sheet is cured following a curing profile with a peak temperature of 200° C. for stabilizing second protective layers 46.

Next, as shown in FIG. 15(*b*) and FIG. 16(*b*), two or more resist layers 47 are screen-printed on the rear face of insulated substrate sheet 41, and resist layers 47 are stabilized by UV-ray curing.

Next, as shown in FIGS. 12, 15(*c*), and 16(*c*), two or more first slit dividing portions 48 are formed by dicing on insulated substrate sheet 41, on which resist layers 47 are formed, except on ineffective area 41*a* formed over the entire periphery of insulated substrate sheet 41. First slit dividing portions 48 are used for dividing insulated substrate sheet 41 into substrate strips 41*b* by separating pairs of top electrode layers 42. In this case, first slit dividing portions 48 are formed at a pitch of 700 μm, with a width of 120 μm. In addition, first slit dividing portions 48 are through holes which pass vertically through insulated substrate sheet 41. Insulated substrate sheet 41 still remains as a sheet even after first slit dividing portions 48 are formed by dicing except on ineffective area 41*a*, because substrate strips 41*b* are connected by ineffective area 41*a*.

Next, as shown in FIGS. 15(*d*) and 16(*d*), side electrode layer 49 of about 0.1 to 1 μm thick, made of nickel or nickel alloy such as nickel chrome alloy, is sputtered onto the rear face of insulated substrate sheet 41 and the inner face of first slit dividing portions 48. In this case, side electrode layer 49 formed on an inner face of first slit dividing portions 48 contacts and is electrically coupled to top electrode layer 42 formed on the top face of insulated substrate sheet 41.

Figure 17A:
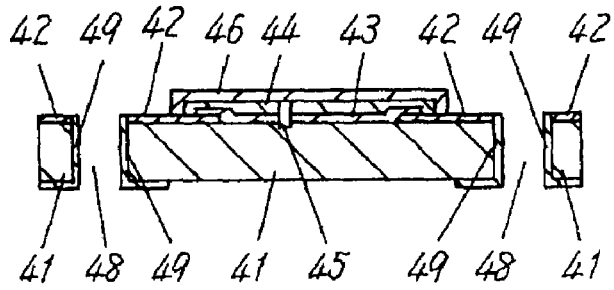
FIGS. 17(*a*) to 17(*c*) are section views illustrating manufacturing processes of the resistor in accordance with the second exemplary embodiment of the present invention.
Figure 17B:
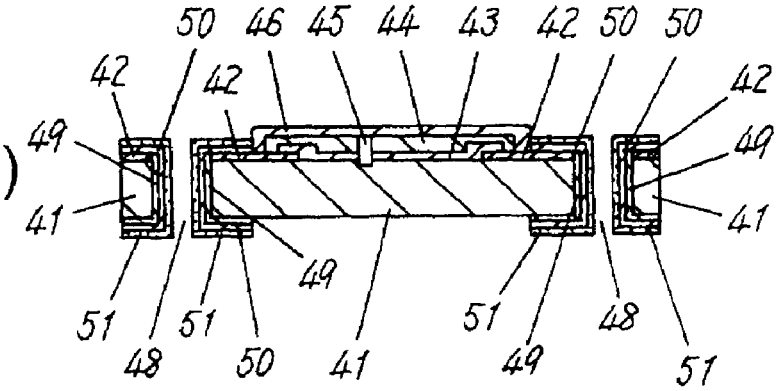
Figure 17C:
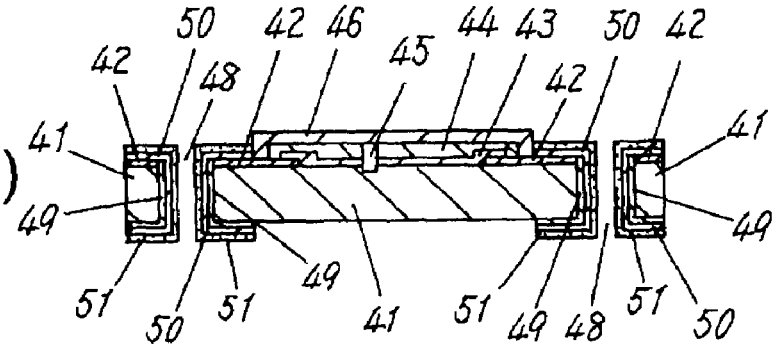
Figure 18A:
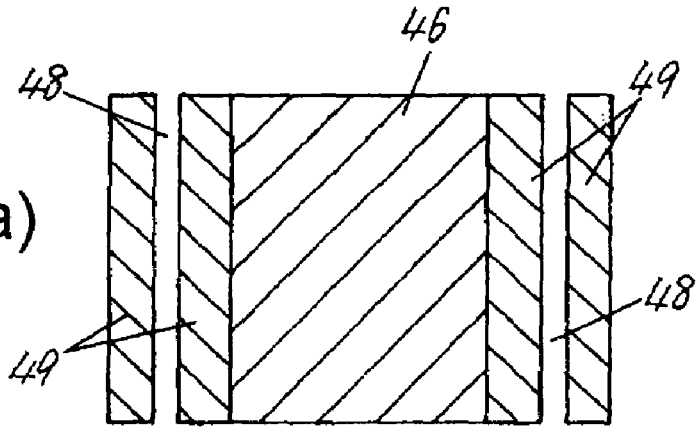
FIGS. 18(*a*) to 18(*c*) are plan views illustrating manufacturing processes of the resistor in accordance with the second exemplary embodiment of the present invention.
Figure 18B:
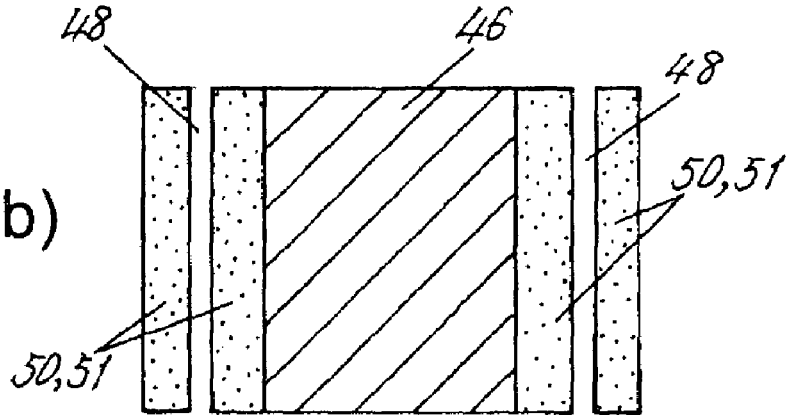
Figure 18C:
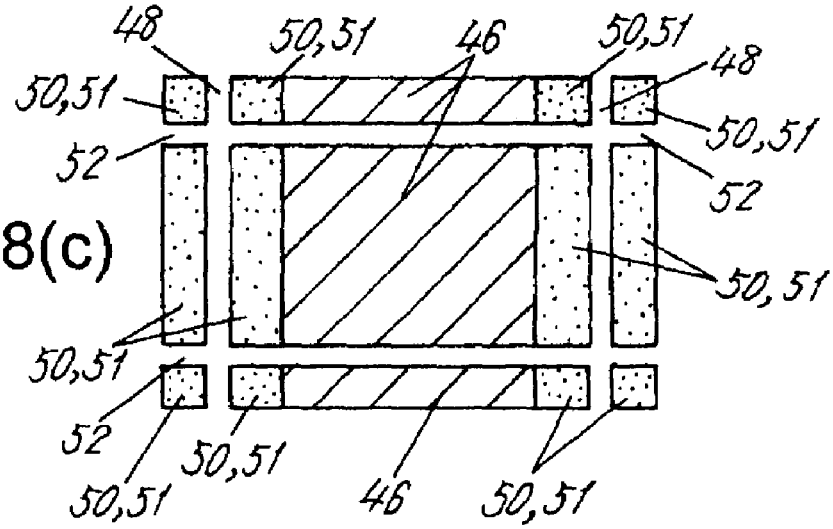

Next, as shown in FIGS. 17(*a*) and 18(*a*), resist layers (not illustrated) are peeled for patterning two or more pairs of side electrode layers 49.

Next, as shown in FIGS. 17(*b*) and 18(*b*), two or more pairs of nickel layers 50, made of nickel, of about 4 to 6 μm in thickness, and two or more pairs of solder layers 51, made of tin, of about 4 to 6 μm in thickness, are electroplated to cover pairs of side electrode layers 49 exposed and a part of pairs of top electrode layers 42 exposed by peeling off resist layers (not illustrated).

Thickness of sputtered side electrode layers 49 is about 0.1 to 1 μm, but this is not limited. Appropriate total thickness of nickel layer 50 and solder layer 51 is 1 to 15 μm.

Solder layer 51 in the second exemplary embodiment is made of tin. However, the present invention is not limited to tin. Solder layer 51 may be made of a tin alloy material. In this case, reliable soldering is achievable by reflow soldering.

Moreover, top electrode layer 42 is made of a silver material and resistor layer 43 is made of a ruthenium oxide material in the second exemplary embodiment. These assure resistance characteristics with good heat resistance and durability.

Furthermore, the protective layer which covers resistor layer 43 is configured with two layers: i) first protective layer 44 which is a precoat glass layer covering resistor layer 43 and ii) second protective layer 46, mainly made of resin, which covers first protective layer 44 and trimming groove 45. First protective layer 44 prevents occurrence of cracking during laser trimming to reduce current noise, and second protective layer 46, mainly comprising resin, secures resistance characteristics with good humidity resistance by covering the entire resistor layer 43.

Lastly, as shown in FIGS. 12, 17(*c*), and 18(*c*), two or more second dividing portions 52 are diced in a direction perpendicular to first slit dividing portions 48 except on ineffective area 41*a* formed over the entire periphery of insulated substrate sheet 41. This allows resistor layers 43 on substrate strips 41*b* in insulated substrate sheet 41 to be separated into individual discrete substrates 41*c*. In this case, second dividing portions 52 are formed at a pitch of 400 μm, with a width of 100 μm. Since these second dividing portions 52 are formed by dicing on substrate strips 41*b* except on ineffective area 41*a*, substrate strips 41*b* are divided into discrete substrates 41*c* every time second dividing portion 52 is formed. Substrate strips divided into individual products are separated from ineffective area 41*a*.

The resistor in the second exemplary embodiment is manufactured using the above processes.

The total length and total width of the resistor, which is a product, made through the above processes are precisely 0.6 mm L×0.3 mm W. This is because the pitch of first slit dividing portions 48 and second dividing portions 52 made by dicing are accurate (within ±0.005 mm) and the thicknesses of side electrode layer 49, nickel layer 50, and solder layer 51 are also accurate. Moreover, the patterning accuracy of top electrode layers 42 and resistor layers 43 eliminates the need for dimensional ranking of discrete substrates, and also the need to take into account dimensional variations in discrete substrates within the same dimensional ranking. The effective area of resistor layer 43 is thus broader than that of the prior art. More specifically, the resistor layer in the prior art is about 0.20 mm L×0.19 mm W. Resistor layer 43 of the resistor in the second exemplary embodiment of the present invention is about 0.25 mm L×0.24 mm W, which is about 1.6 times larger in area.

Since first slit dividing portions 48 and second dividing portions 52 are formed by dicing, insulated substrate sheet 41 which does not require dimensional ranking of discrete substrates may be used. This eliminates the need for classifying discrete substrates by dimensions as in the prior art, thereby eliminating the complicated process of replacing a mask in the prior art. Dicing can also be performed easily using a general dicing machine for semiconductors or the like. Insulated substrate sheet 41 is framed by ineffective area 41*a* which does not become a product. In addition, first slit dividing portions 48 and second dividing portions 52 are not formed on this ineffective area 41*a*. Accordingly, substrate strips 41*b* are connected to ineffective area 41*a* even after forming first slit dividing portions 48. This prevents insulated substrate sheet 41 from being separated into individual substrate strips 41*b*. Remaining processes are thus implemented on insulated substrate sheet 41 with ineffective area 41*a* even after first slit dividing portions 48 are formed, thereby contributing to the simplification of process design. Furthermore, when second dividing portions 52 are formed, insulated substrate sheet 41 is cut into discrete substrates 41*c* every time second dividing portion 52 is formed. Each discrete substrate 41*c*, which is a product, is thus separated from ineffective area 41*a*, thereby eliminating the process of sorting ineffective area 41*a* and products afterwards.

Still more, side electrode layers 49 may be formed on insulated substrate sheet 41 at required areas because pairs of side electrode layers 49, nickel layer 50, and pairs of solder layers 51 are formed on insulated substrate 41 in the form of a sheet before being divided. Potential difference during the formation of nickel layer 50 and solder layers 51 by electroplating may also be reduced, thereby allowing the formation of stable nickel layer 50 and solder layer 51.

Figure 19:
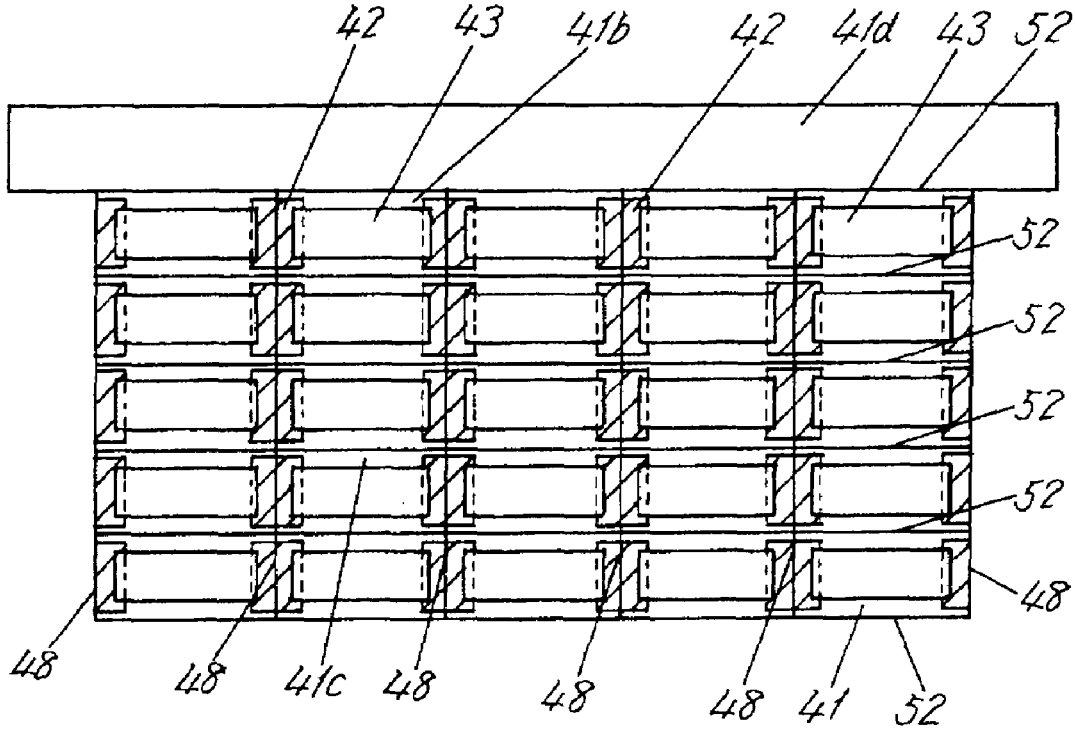
FIG. 19 is a top view illustrating the state in which an ineffective area is formed on one end of the insulated substrate sheet used for manufacturing the resistor in the second exemplary embodiment of the present invention.
Figure 20:
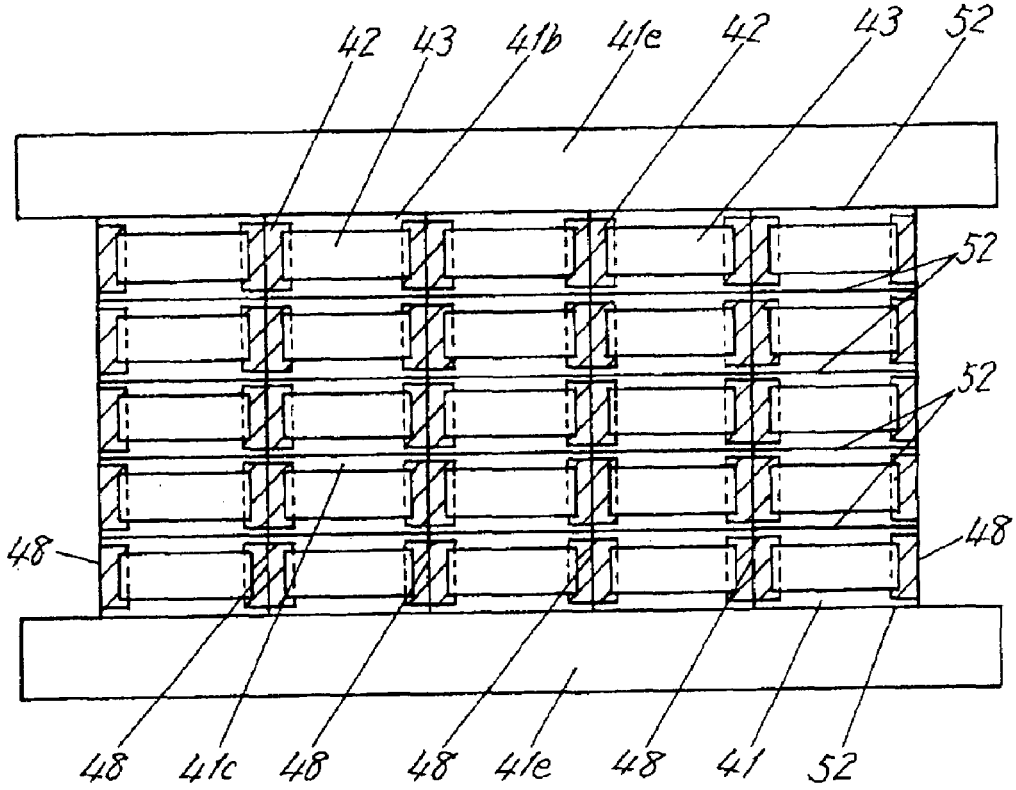
FIG. 20 is a top view illustrating the state in which an ineffective area is formed on both ends of the insulated substrate sheet used for manufacturing the resistor in the second exemplary embodiment of the present invention.
Figure 21:
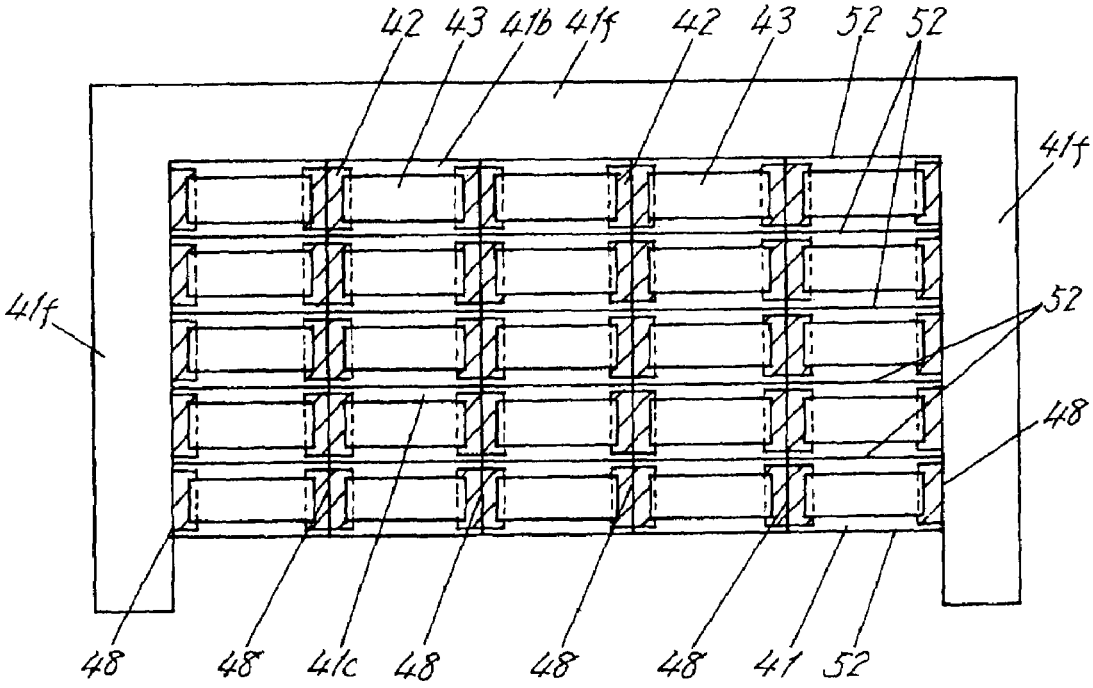
FIG. 21 is a top view illustrating the state in which an ineffective area is formed on three ends of the insulated substrate sheet used for manufacturing the resistor in the second exemplary embodiment of the present invention.

The second exemplary embodiment of the present invention describes the case of forming ineffective area 41*a* which does not become one end of a finished product on the entire periphery of insulated substrate sheet 41 in a shape of a frame. However, ineffective area 41*a* may not need to frame insulated substrate sheet 41. For example, as shown in FIG. 19, ineffective area 41*d* may be formed on a part of insulated substrate sheet 41. Alternatively, as shown in FIG. 20, ineffective area 41*e* may be formed on both ends of insulated substrate sheet 41. Alternatively, as shown in FIG. 21, ineffective area 41*f* may be formed on three ends of insulated substrate sheet 41. All these demonstrate the same effect as that of the second exemplary embodiment of the present invention.

The second exemplary embodiment of the present invention also describes the case of forming second dividing portions 52 by dicing. In other cases, for example, second dividing portions 52 may be formed by cutting the top, rear, or center of insulated substrate sheet 41, using a laser beam or dicing, while retaining a thinned portion in the top, rear, or center parts of insulated substrate sheet 41. In this case, the insulated substrate sheets are not immediately divided into pieces by forming second dividing portions but in two steps.

The second exemplary embodiment also describes the case of forming first slit dividing portions 29 after forming resist layers 47. However, resist layers 47 may be formed after forming first slit dividing portions 48. In this case, however, printing pressure for screen printing need to be reduced because the strength of insulated substrate sheet 41 is reduced when resist layers 47 are screen-printed after forming first slit dividing portions 48.

Furthermore, resist layers 47 may be formed immediately after forming the first protective layer 44, which is precoat glass layers. This also achieves the same effect as that of the second exemplary embodiment.

Still more, the second exemplary embodiment of the present invention describes the case of peeling resist layer 47 before forming nickel layer 50 and solder layer 51. The resist layer may also be peeled after forming solder layer 51.

Still more, the second exemplary embodiment of the present invention uses a silver material for the top electrode layer 42 and a ruthenium oxide material for resistor layer 43. The use of other materials also achieves the same effect as that of the second exemplary embodiment of the present invention.

The second exemplary embodiment of the present invention also describes the case of forming first slit dividing portions 48 and second dividing portions 52 by dicing. The same effect as that of the second exemplary embodiment is also achievable by using other means such as a laser or water jet for making first slit dividing portions and second dividing portions.

Furthermore, the second exemplary embodiment of the present invention describes the case of forming first slit dividing portions 48 on insulated substrate sheet 41 after forming pairs of top electrode layers 42, resistor layers 43, first protective layers 44, trimming grooves 45, second protective layers 46, and resist layers 47 when first slit dividing portions 48 are formed for dividing the substrate into substrate strips 41*b*. However, the present invention is not limited to processes in this sequence. For example, first slit dividing portions 48 may be formed on insulated substrate sheet 41 first or insulated substrate sheet 41 already provided with first slit dividing portions 48 may be used for manufacture. Alternatively, first slit dividing portions 48 may be formed on insulated substrate sheet 41 after forming pairs of top electrode layers 42 on insulated substrate sheet 41. Or, first slit dividing portions 48 may be formed on insulated substrate sheet 41 after resistor layers 43 are formed on insulated substrate sheet 41. Or, first slit dividing portions 48 may be formed on insulated substrate sheet 41 after pairs of top electrode layers 42 are formed on insulated substrate sheet 41 and then resistor layers 43 are formed such that a part of resistor layers 43 overlaps pairs of top electrode layers 42. Alternatively, first slit dividing portions 48 may be formed on insulated substrate sheet 41 after resistor layers 43 are formed on insulated substrate sheet 41 and then pairs of top electrode layers 42 are formed such that a part of top electrode layers 42 overlaps resistor layers 43. Or, first slit dividing portions 48 may be formed on insulated substrate sheet 41 after pairs of top electrode layers 42 and resistor layers 43 are formed on insulated substrate sheet 41 and trimming is applied to adjust the resistance in these resistor layers 43 between pairs of top electrode layers 42. In all the above cases, the same effect is achievable as that of the second exemplary embodiment of the present invention.

Third Exemplary Embodiment

A method for manufacturing a resistor in a third exemplary embodiment of the present invention is described below with reference to drawings.

Figure 22:
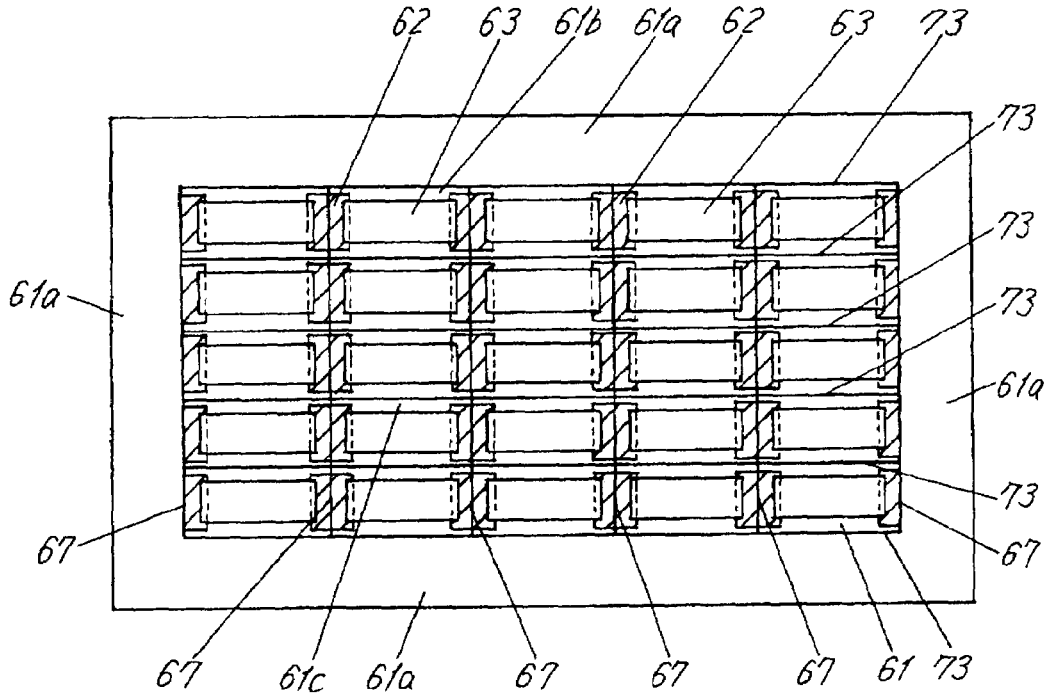
FIG. 22 is a top view illustrating the state in which an ineffective area is formed on the entire periphery of the insulated substrate sheet used for manufacturing a resistor in accordance with a third exemplary embodiment of the present invention.
Figure 23A:
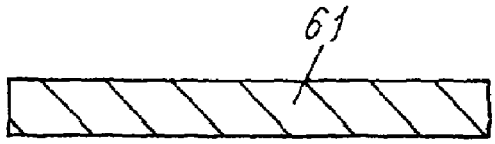
FIGS. 23(*a*) to 23(*e*) are section views illustrating manufacturing processes of the resistor in accordance with the third exemplary embodiment of the present invention.
Figure 23B:
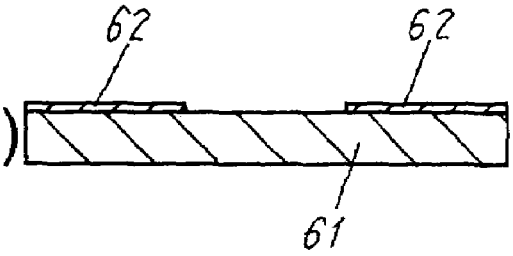
Figure 23C:
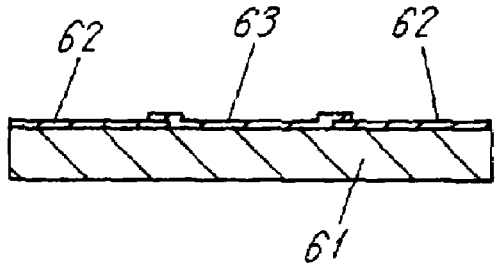
Figure 23D:
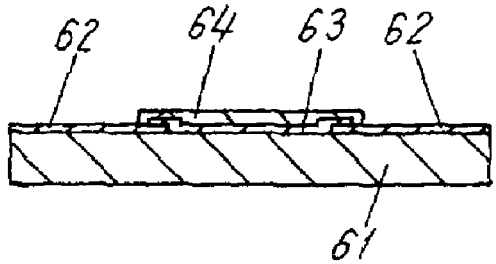
Figure 23E:
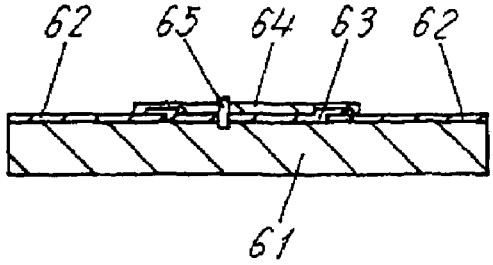
Figure 24A:
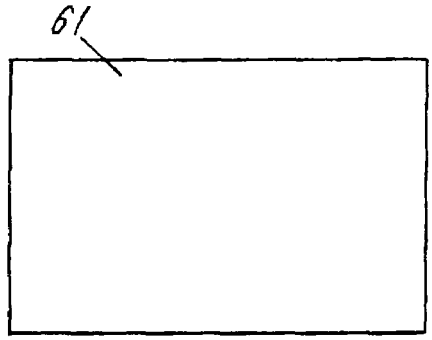
FIGS. 24(*a*) to 24(*e*) are plan views illustrating manufacturing processes of the resistor in accordance with the third exemplary embodiment of the present invention.
Figure 24B:
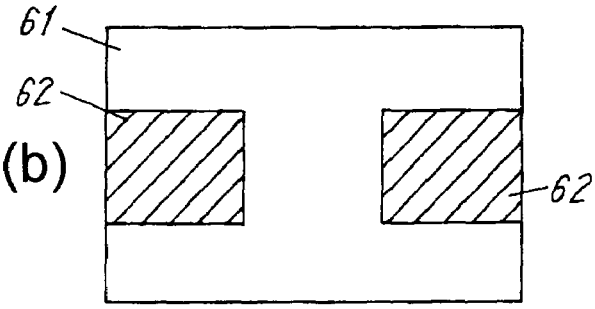
Figure 24C:
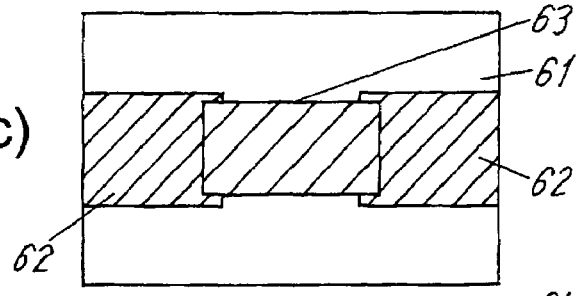
Figure 24D:
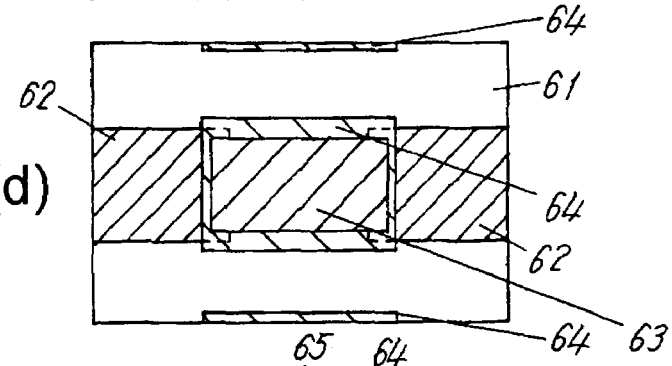
Figure 24E:
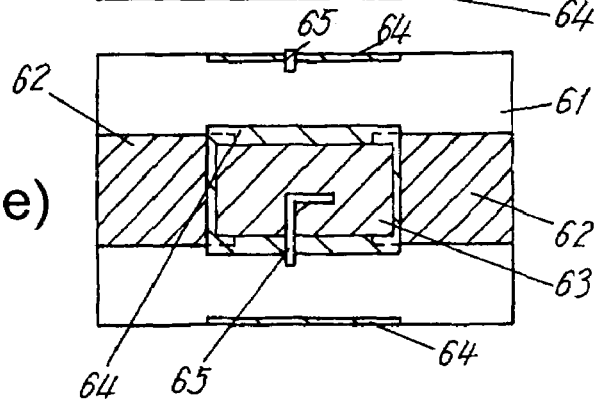
Figure 25A:
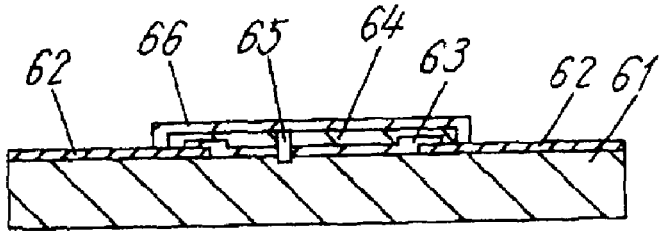
FIGS. 25(*a*) to 25(*d*) are section views illustrating manufacturing processes of the resistor in accordance with the third exemplary embodiment of the present invention.
Figure 25B:
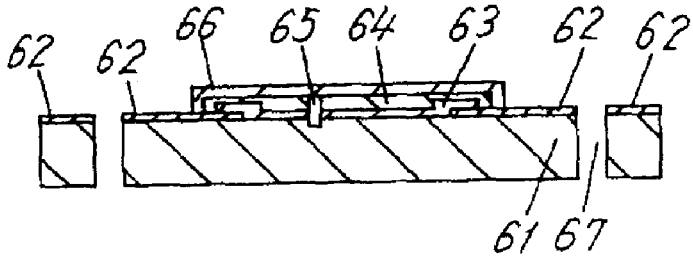
Figure 25C:
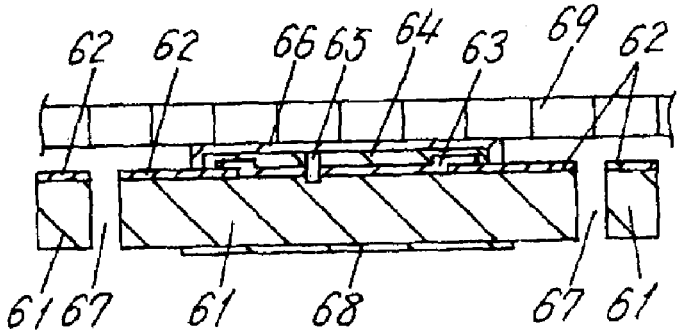
Figure 25D:
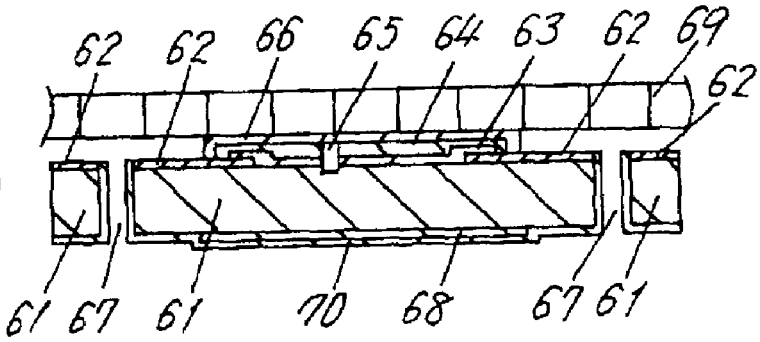
Figure 26A:
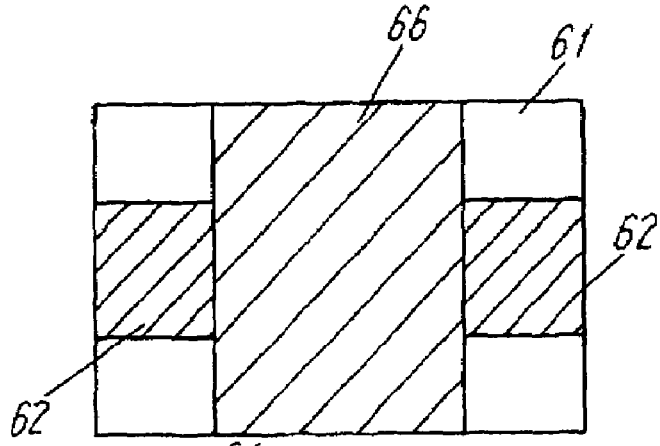
FIGS. 26(*a*) to 26(*d*) are plan views illustrating manufacturing processes of the resistor in accordance with the third exemplary embodiment of the present invention.
Figure 26B:
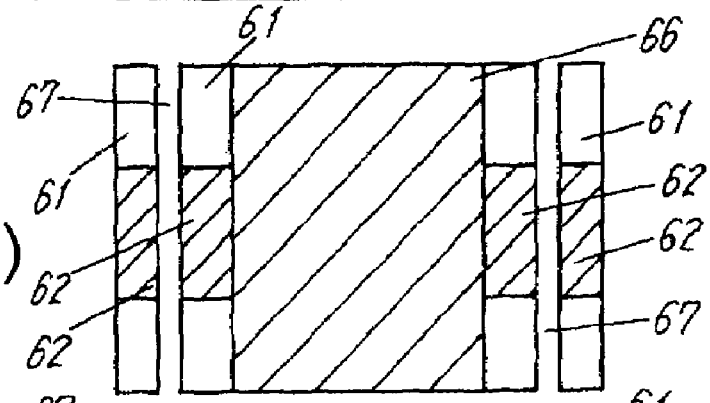
Figure 26C:
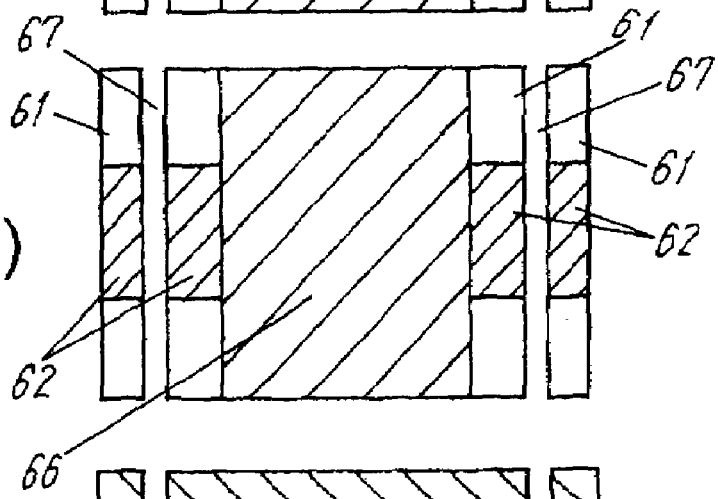
Figure 26D:
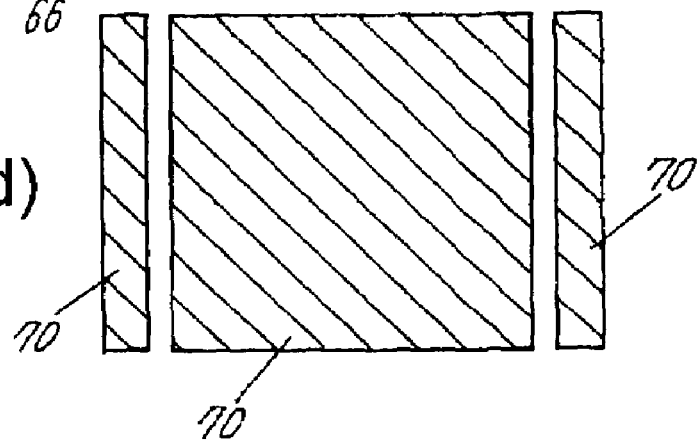

FIG. 22 is a top view illustrating the state in which a ineffective area is formed on the entire periphery of an insulated substrate sheet used for manufacturing the resistor in the third exemplary embodiment of the present invention. FIGS. 23(*a*) to 23(*e*), FIGS. 24(*a*) to 24(*e*), FIGS. 25(*a*) to 25(*d*), FIGS. 26(*a*) to 26(*d*), FIGS. 27 (*a*) to 27(*c*), and FIGS. 28(*a*) to 28(*c*) are process charts of the manufacturing method of the resistor in the third exemplary embodiment of the present invention.

As shown in FIGS. 22, 23(*a*), and 24(*a*), prebaked insulated substrate sheet 61 which is 0.2 mm thick, made of alumina of 96% purity, is prepared. Here, insulated substrate sheet 61, as shown in FIG. 22, has ineffective area 61*a* which will not become products, on its entire periphery. This ineffective area 61*a* is configured in a frame shape.

Next, as shown in FIGS. 22, 23(*b*), and 24(*b*), two or more pairs of top electrode layers 62, made mainly of silver, are screen-printed on the top face of insulated substrate sheet 61. Insulated substrate sheet 61 is then baked according to a baking profile with a peak temperature of 850° C. to stabilize top electrode layers 62.

Next, as shown in FIGS. 22, 23(*c*), and 24(*c*), two or more resistor layers 63 made of ruthenium oxide system are screen-printed so as to bridge two or more pairs of top electrode layers 62. Insulated substrate sheet 61 is then baked according to a baking profile with a peak temperature of 850° C. to stabilize resistor layers 63.

Then, as shown in FIGS. 23(*d*) and 24(*d*), first protective layer 64 made of two or more precoat glass layers is screen-printed to cover resistor layers 63. Insulated substrate sheet 61 is baked again following a baking profile with a peak temperature of 600° C. to stabilize first protective layer 64 made of the precoat glass layers.

Next, as shown in FIGS. 23(*e*) and 24(*e*), two or more trimming grooves 65 are made using a laser trimming method for adjusting the resistance of resistor layers 63 between pairs of top electrode layers 62 to a predetermined value.

Next, as shown in FIGS. 25(*a*) and 26(*a*), two or more second protective layers 66, mainly made of resin, are screen-printed to cover first protective layer 64 consisting of precoat glass layers, aligned vertically on the drawing. The substrate sheet is cured following a curing profile with a peak temperature of 200° C. for stabilizing second protective layers 66.

Next, as shown in FIGS. 22, 25(*b*), and 26(*b*), two or more first slit dividing portions 67 are formed by dicing on insulated substrate sheet 61, except on ineffective area 61*a* formed over the entire periphery of insulated substrate sheet 61. First slit dividing portions 67 are used for dividing insulated substrate sheet 61 into substrate strips 61*b* by separating pairs of top electrode layers 62. In this case, first slit dividing portions 67 are formed at a pitch of 700 μm, with a width of 120 μm. In addition, first slit dividing portions 67 are through holes which pass vertically through insulated substrate sheet 61. Insulated substrate sheet 61 still remains as a sheet even after first slit dividing portions 67 are formed by dicing except on ineffective area 61*a*, because substrate strips 61*b* are connected by ineffective area 61*a*.

As shown in FIGS. 25(*c*) and 26(*c*), mask 68 made of a magnetic metal is disposed on the rear face of insulated substrate sheet 61 on which first slit dividing portions 67 are formed. Magnet 69 is disposed on the top face of insulated substrate sheet 61 for fixing mask 68 in a predetermined position. Then, as shown in FIGS. 25(*d*) and 26(*d*), two or more pairs of side electrode layers 70, about 0.1 to 1 μm thick, typically made of nickel or a nickel alloy such as nickel-chromium alloy are formed on the rear face of insulated substrate sheet 61 and the inner face of first slit dividing portions 67. In this case, side electrode layer 70 formed on the inner face of first slit dividing portions 67 contacts and is electrically coupled to top electrode layer 62 formed on the top face of insulated substrate sheet 61.

Figure 27A:
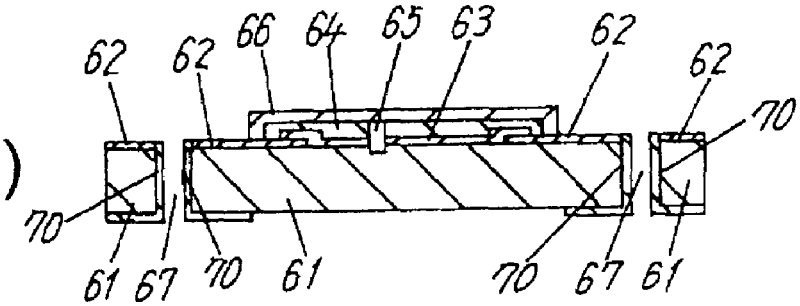
FIGS. 27(*a*) to 27(*c*) are section views illustrating manufacturing processes of the resistor in accordance with the third exemplary embodiment of the present invention.
Figure 27B:
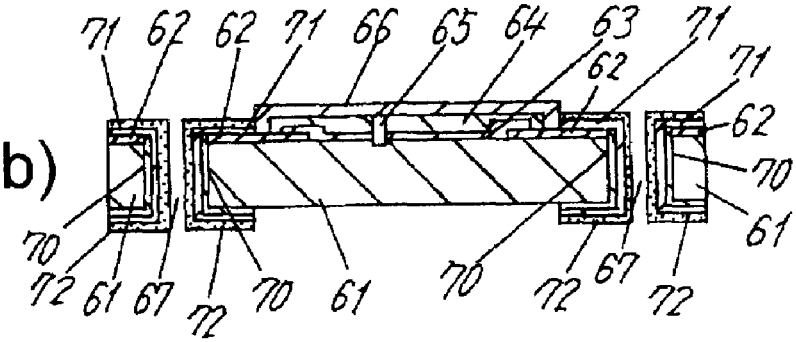
Figure 27C:
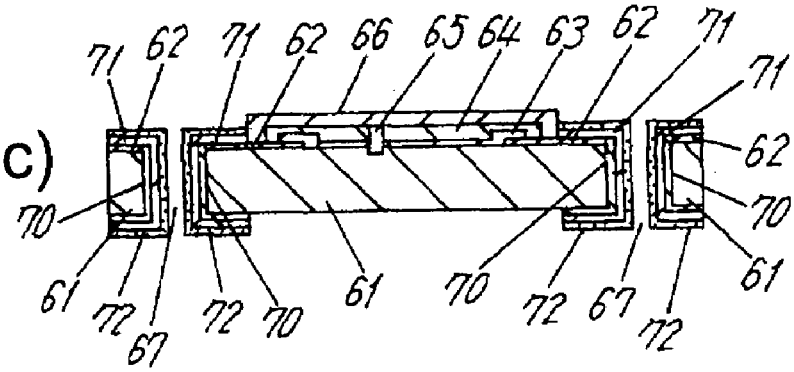

Then, as shown in FIGS. 27(*a*) and 28(*a*), mask 68 and magnet 69 are removed.

Figure 28A:
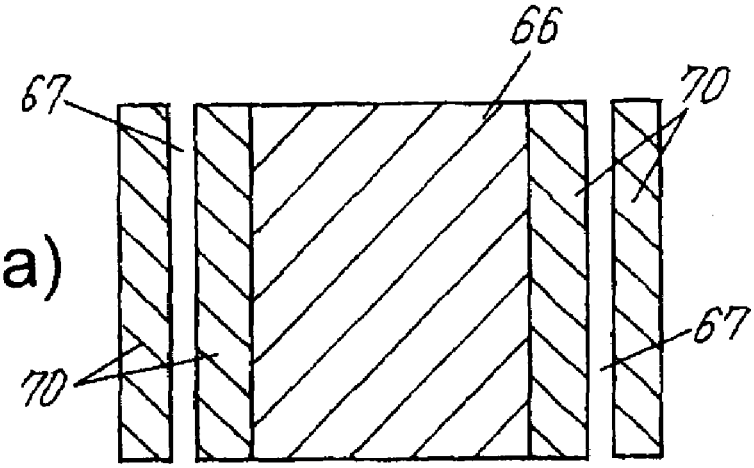
FIGS. 28(*a*) to 28(*c*) are plan views illustrating manufacturing processes of the resistor in accordance with the third exemplary embodiment of the present invention.
Figure 28B:
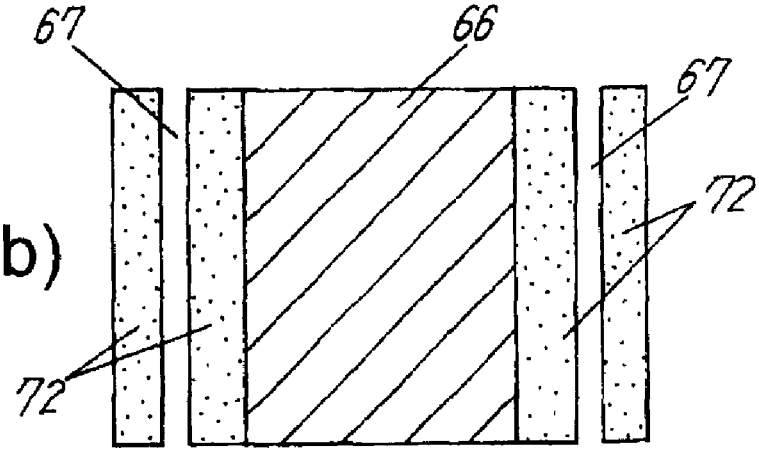
Figure 28C:
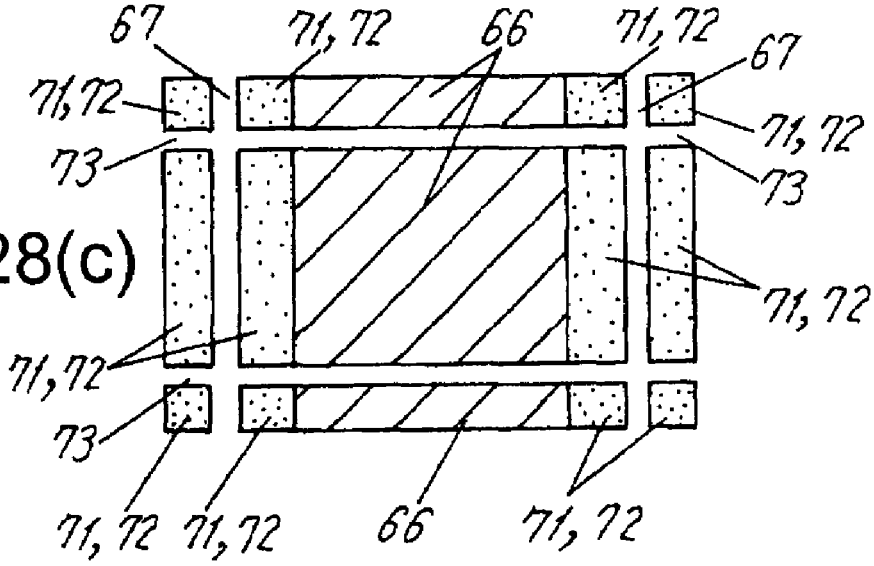

Next, as shown in FIG. 27(*b*) and FIG. 28(*b*), two or more pairs of nickel layers 71 made of nickel, about 4 to 6 μm thick, and two or more pairs of solder layers 72 made of tin, about 4 to 6 μm thick, are electroplated onto pairs of exposed side electrode layers 70 and a part of pairs of top electrode layers 62.

Side electrode layer 70 formed by sputtering is about 0.1 to 1 μm thick, but the thickness is not limited to this range. Appropriate total thickness for nickel layer 71 and solder layer 72 is 1 to 15 μm.

Solder layer 72 in the third exemplary embodiment is made of tin. However, the present invention is not limited to tin. Solder layer 72 may be made of a tin alloy material. In this case, reliable soldering is achievable by reflow soldering.

Moreover, top electrode layer 62 is made of a silver material and resistor layer 63 is made of a ruthenium oxide material. These assure resistance characteristics with good heat resistance and durability.

Furthermore, the protective layer which covers resistor layer 63 is configured with two layers: i) first protective layer 64 which is a precoat glass layer covering resistor layer 63 and ii) second protective layer 66, mainly made of resin, which covers first protective layer 64 and trimming groove 65. First protective layer 64 prevents occurrence of cracking during laser trimming to reduce current noise, and second protective layer 66, mainly comprising resin, secures resistance characteristics with good humidity resistance by covering the entire resistor layer 63.

Lastly, as shown in FIGS. 22, 27(*c*), and 28(*c*), two or more second dividing portions 73 are diced in a direction perpendicular to first slit dividing portions 67 except on ineffective area 61*a* formed over the entire periphery of insulated substrate sheet 61. This allows resistor layers 63 on substrate strips 61*b* in insulated substrate sheet 61 to be separated into individual discrete substrates 61*c*. In this case, second dividing portions 73 are formed at a pitch of 400 μm, with a width of 100 μm. Since these second dividing portions 73 are formed by dicing on substrate strips 61*b* except on ineffective area 61*a*, substrate strips 61*b* are divided into discrete substrates 61*c* every time second dividing portion 73 is formed. Substrate strips divided into individual products are separated from ineffective area 61*a*.

The resistor in the third exemplary embodiment is manufactured using the above processes.

The total length and total width of the resistor, which is a product, made through the above processes are precisely 0.6 mm L×0.3 mm W. This is because the pitch of first slit dividing portions 67 and second dividing portions 73 made by dicing are accurate (within ±0.005 mm) and the thicknesses of side electrode layer 70, nickel layer 71, and solder layer 72 are also accurate. Moreover, the patterning accuracy of top electrode layers 62 and resistor layers 63 eliminates the need for dimensional ranking of discrete substrates and also the need to take into account dimensional variations of discrete substrates within the same dimensional ranking. The effective area of resistor layer 63 is thus broader than that of the prior art. More specifically, the resistor layer in the prior art is about 0.20 mm L×0.19 mm W. Resistor layer 63 of the resistor in the third exemplary embodiment of the present invention is about 0.25 mm L×0.24 mm W, which is about 1.6 times larger in area.

Since first slit dividing portions 67 and second dividing portions 73 are formed by dicing, insulated substrate sheet 61 which does not require dimensional ranking of discrete substrates may be used. This eliminates the need for classifying discrete substrates by dimensions as in the prior art, thereby eliminating the complicated process of replacing a mask in the prior art. Dicing can also be performed easily using a general dicing machine for semiconductors or the like.

Insulated substrate sheet 61 is framed by ineffective area 61*a* which does not become a product. In addition, first slit dividing portions 67 and second dividing portions 73 are not formed on this ineffective area 61*a*. Accordingly, substrate strips 61*b* are connected to ineffective area 61*a* even after forming first slit dividing portions 67. This prevents insulated substrate sheet 61 from being separated into individual substrate strips 61*b*. Remaining processes are thus implemented on insulated substrate sheet 61 with ineffective area 61*a* even after first slit dividing portions 67 are formed, thereby contributing to the simplification of process design. Furthermore, when second dividing portions 73 are formed, insulated substrate sheet 61 is cut into discrete substrates 61*c* every time second dividing portion 73 is formed. Each discrete substrate 61*c*, which is a product, is thus separated from ineffective area 61*a*, thereby eliminating the process of sorting ineffective area 61*a* and products afterwards.

Still more, side electrode layers 70 may be formed on insulated substrate sheet 61 at required areas because pairs of side electrode layers 70, nickel layer 71, and pairs of solder layers 72 are formed on insulated substrate 61 in the form of a sheet before being divided. Potential difference during the formation of nickel layer 71 and solder layers 72 by electroplating may also be reduced, thereby allowing the formation of stable nickel layer 71 and solder layer 72.

Figure 29:
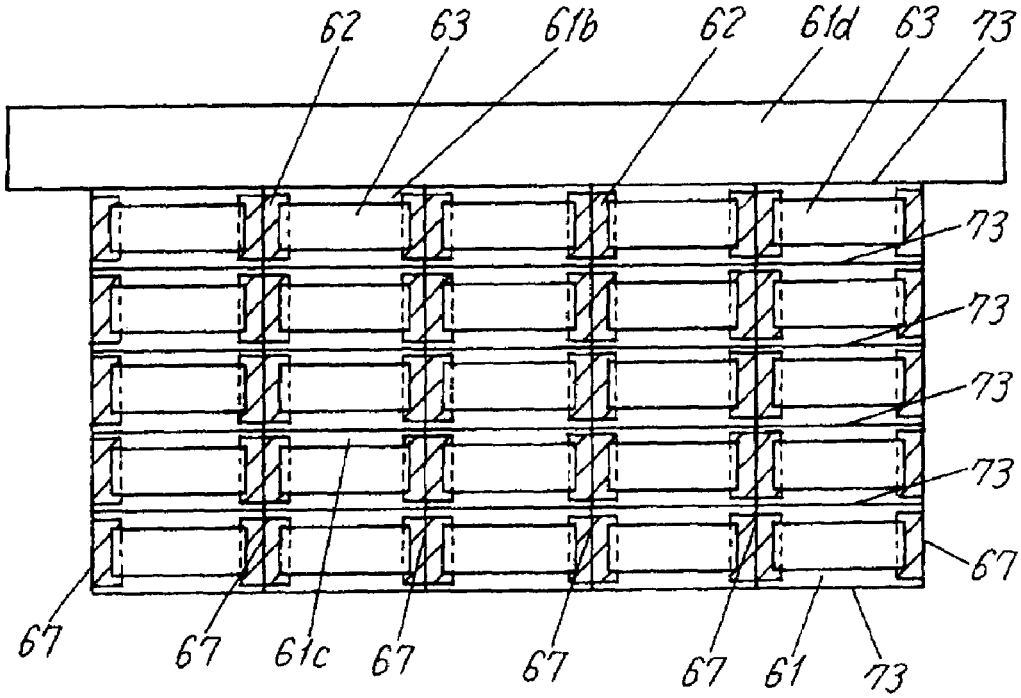
FIG. 29 is a top view illustrating the state in which an ineffective area is formed on one end of the insulated substrate sheet used for manufacturing the resistor in the third exemplary embodiment of the present invention.
Figure 30:
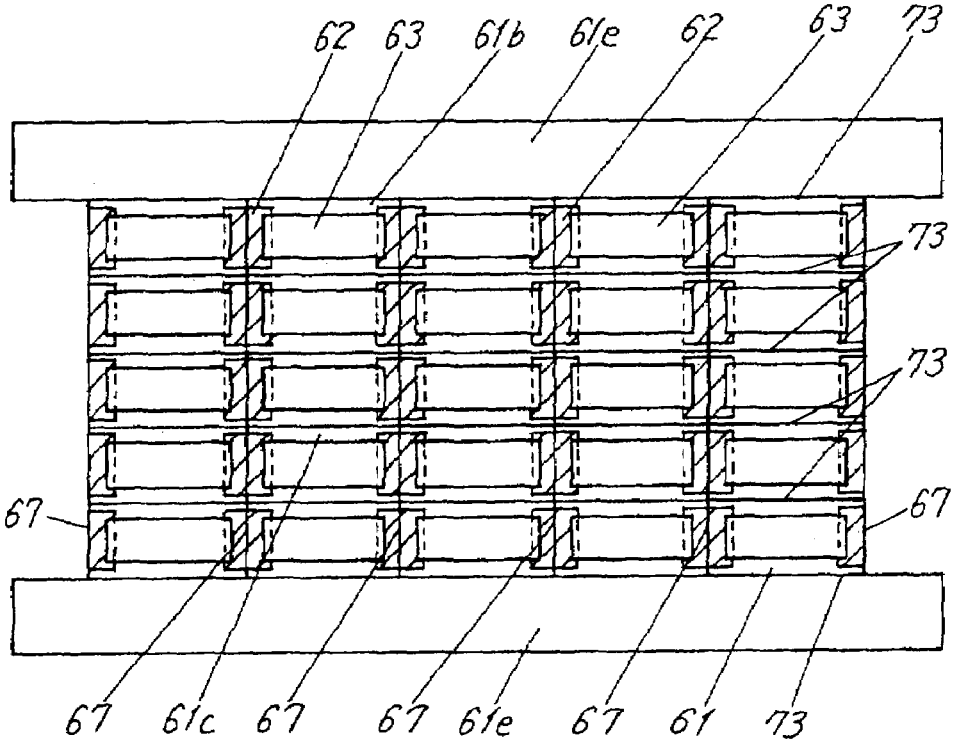
FIG. 30 is a top view illustrating the state in which an ineffective area is formed on both ends of the insulated substrate sheet used for manufacturing the resistor in the third exemplary embodiment of the present invention.
Figure 31:
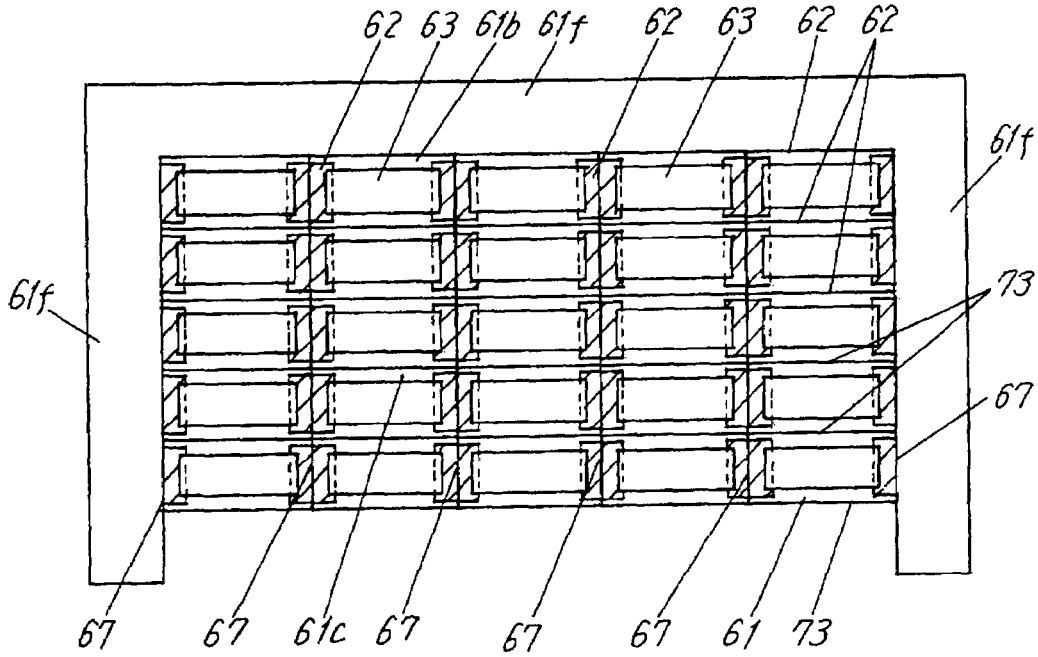
FIG. 31 is a top view illustrating the state in which an ineffective area is formed on three ends of the insulated substrate sheet used for manufacturing the resistor in the third exemplary embodiment of the present invention.

The third exemplary embodiment of the present invention describes the case of forming ineffective area 61*a* which does not become a part of a finished product on the entire periphery of insulated substrate sheet 61 in a shape of a frame. However, ineffective area 61*a* may not need to frame insulated substrate sheet 61. For example, as shown in FIG. 29, ineffective area 61*d* may be formed on one end of insulated substrate sheet 61. Alternatively, as shown in FIG. 30, ineffective area 61*e* may be formed on both ends of insulated substrate sheet 61. Alternatively, as shown in FIG. 31, ineffective area 61*f* may be formed on three ends of insulated substrate sheet 61. All these demonstrate the same effect as that of the third exemplary embodiment of the present invention.

The third exemplary embodiment of the present invention also describes the case of forming second dividing portions 73 by dicing. In other cases, for example, second dividing portions 73 may be formed by cutting the top, rear, or center of insulated substrate sheet 61, using a laser beam or dicing, while retaining a thinned portion in the top, rear, or center parts of insulated substrate sheet 61. In this case, the insulated substrate sheets are not immediately divided into pieces by forming second dividing portions but in two steps.

The third exemplary embodiment of the present invention also describes the case of using a silver material for top electrode layer 62 and a ruthenium oxide material for resistor layer 63. However, other materials may be used for achievement the same effect as that of the third exemplary embodiment of the present invention.

The third exemplary embodiment of the present invention also describes the case of forming first slit dividing portions 67 and second dividing portions 73 by dicing. The same effect as the third exemplary embodiment is also achievable by using other means such as a laser or water jet for making first slit dividing portions and second dividing portions.

Furthermore, the third exemplary embodiment of the present invention describes the case of forming first slit dividing portions 67 on insulated substrate sheet 61 after forming pairs of top electrode layers 62, resistor layers 63, first protective layers 64, trimming grooves 65, and second protective layers 66, when first slit dividing portions 67 are formed for dividing the substrate into substrate strips 61*b*. However, the present invention is not limited to processes in this sequence. For example, first slit dividing portions 67 may be formed on insulated substrate sheet 61 first or insulated substrate sheet 61 already provided with first slit dividing portions 29 may be used for manufacture. Alternatively, first slit dividing portions 67 may be formed on insulated substrate sheet 61 after forming pairs of top electrode layers 62 on insulated substrate sheet 61. Or, first slit dividing portions 67 may be formed on insulated substrate sheet 61 after resistor layers 63 are formed on insulated substrate sheet 61. Or, first slit dividing portions 67 may be formed on insulated substrate sheet 61 after pairs of top electrode layers 62 are formed, and then resistor layers 63 are formed such that a part of resistor layers 63 overlaps these pairs of top electrode layers 62. Alternatively, first slit dividing portions 67 may be formed on insulated substrate sheet 61 after resistor layers 63 are formed on insulated substrate sheet 61 and then pairs of top electrode layers 62 are formed such that a part of these top electrode layers overlaps resistor layers 63. Or, first slit dividing portions 67 may be formed on insulated substrate sheet 61 after pairs of top electrode layers 62 and resistor layers 63 are formed on insulated substrate sheet 61 and trimming is applied to adjust the resistance in these resistor layers 63 between pairs of top electrode layers 62. In all the above cases, the same effect is achievable as that of the third exemplary embodiment of the present invention.

Fourth Exemplary Embodiment

A method for manufacturing a resistor in a fourth exemplary embodiment of the present invention is described below with reference to drawings.

Figure 32:
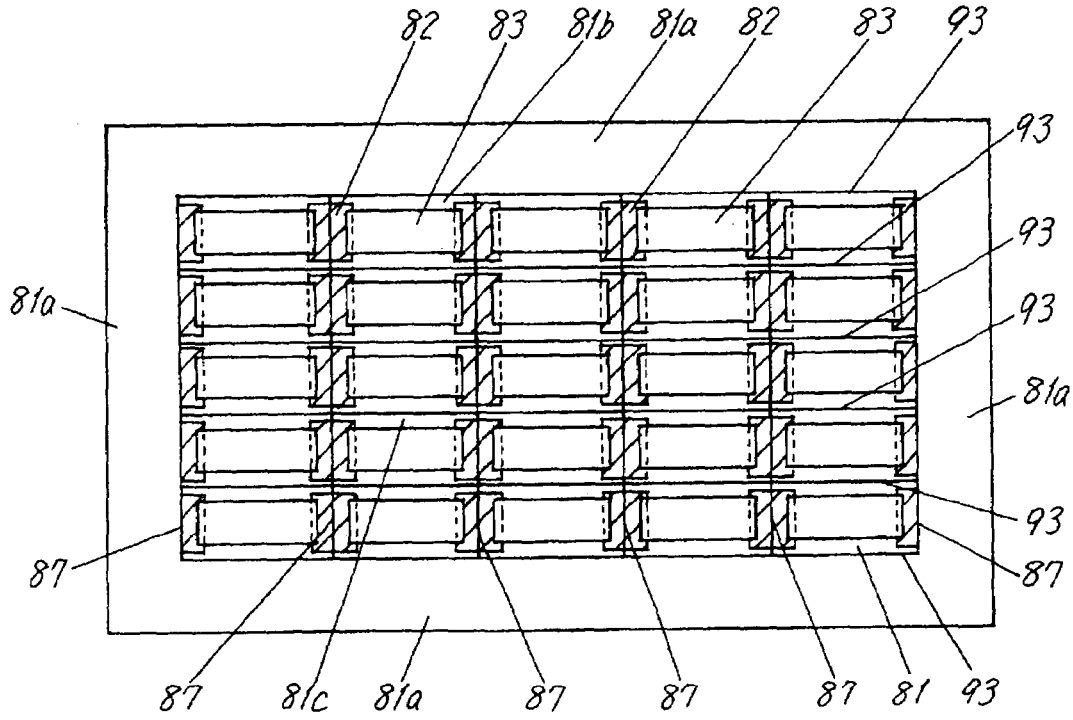
FIG. 32 is a top view illustrating the state in which an ineffective area is formed on the entire periphery of the insulated substrate sheet used for manufacturing a resistor in accordance with a fourth exemplary embodiment of the present invention.
Figure 33A:
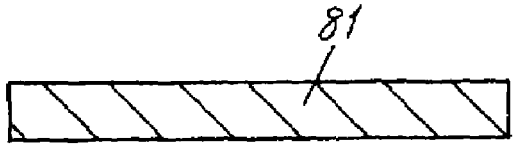
FIGS. 33(*a*) to 33(*e*) are section views illustrating manufacturing processes of the resistor in accordance with the fourth exemplary embodiment of the present invention.
Figure 33B:
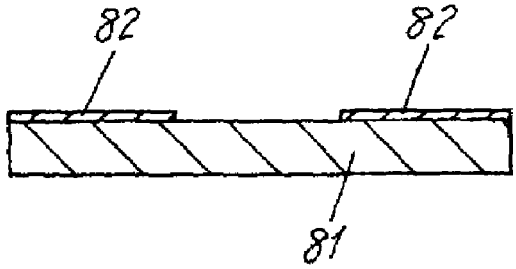
Figure 33C:
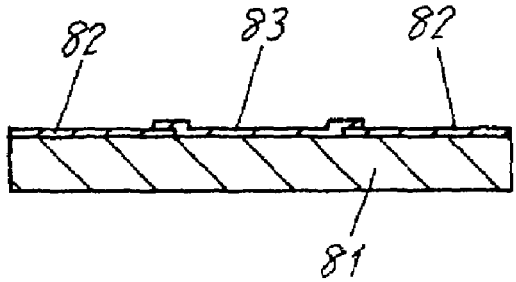
Figure 33D:
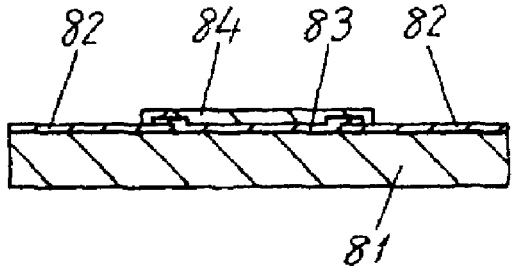
Figure 33E:
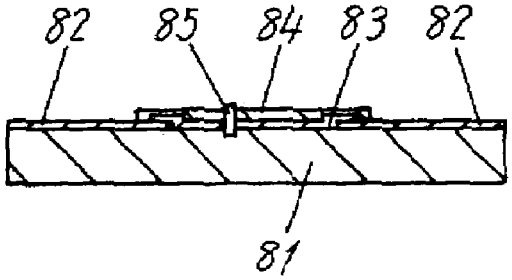
Figure 34A:
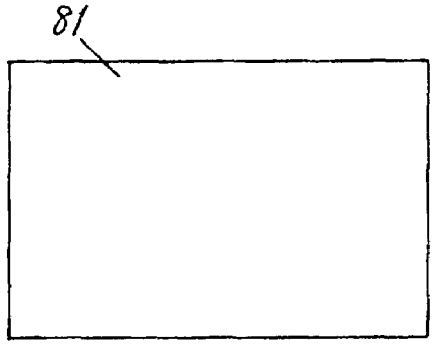
FIGS. 34(*a*) to 34(*e*) are plan views illustrating manufacturing processes of the resistor in accordance with the fourth exemplary embodiment of the present invention.
Figure 34B:
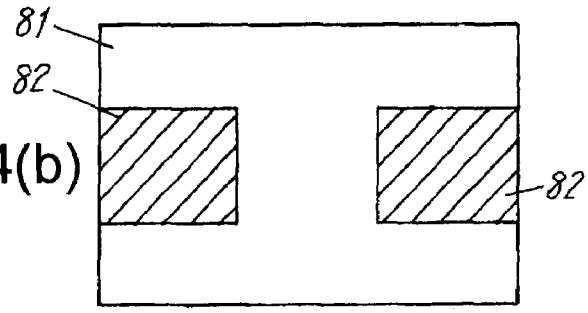
Figure 34C:
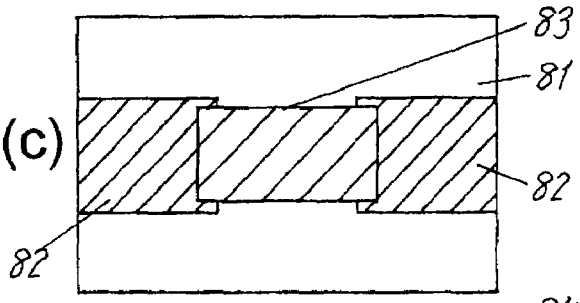
Figure 34D:
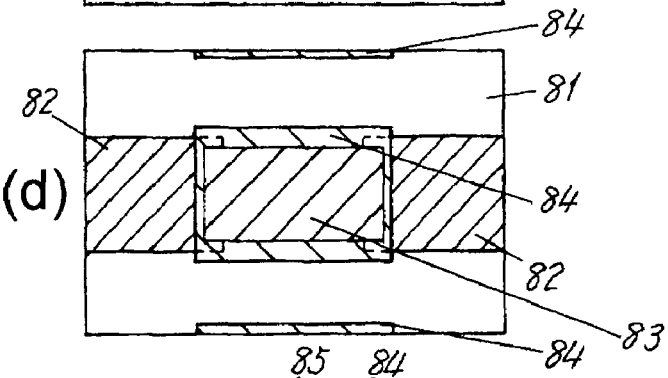
Figure 34E:
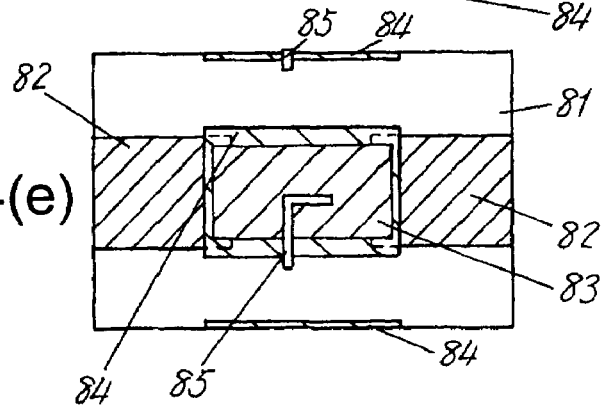
Figure 36A:
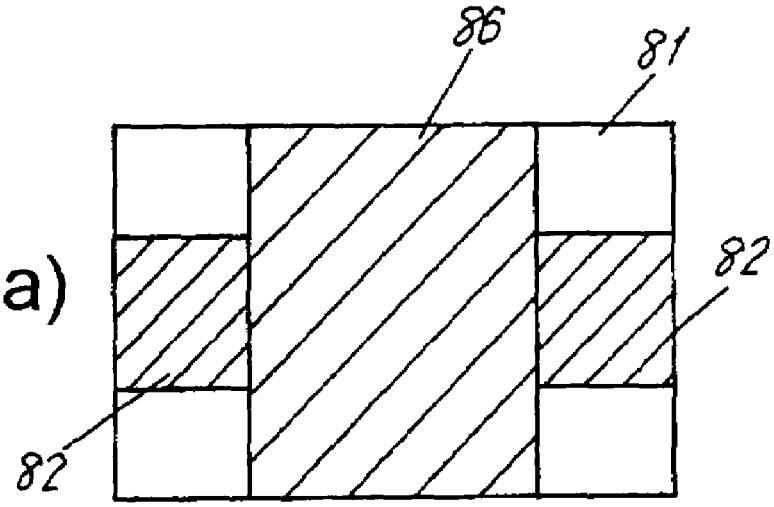
FIGS. 36(*a*) to 36(*c*) are plan views illustrating manufacturing processes of the resistor in accordance with the fourth exemplary embodiment of the present invention.
Figure 36B:
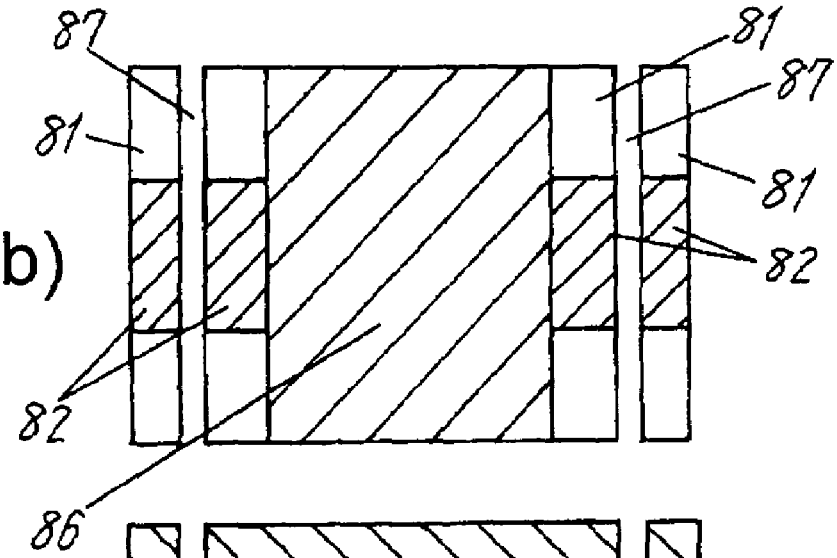
Figure 36C:
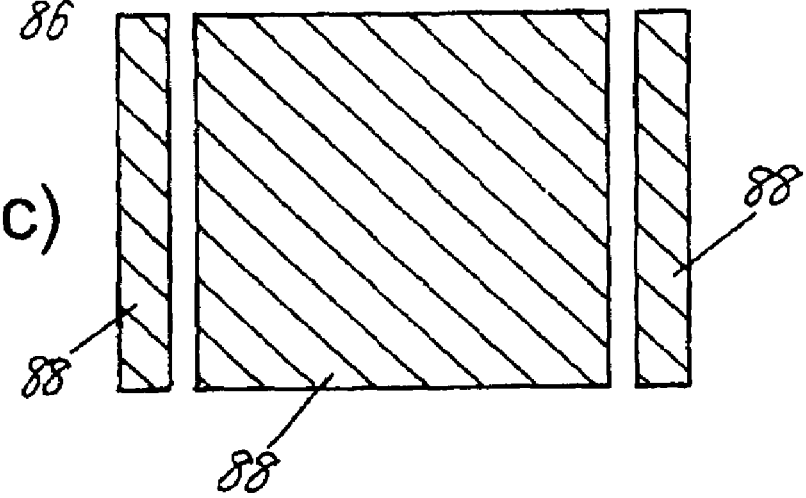

FIG. 32 is a top view illustrating the state in which a ineffective area is formed on the entire periphery of an insulated substrate sheet used for manufacturing the resistor in the fourth exemplary embodiment of the present invention. FIGS. 33 (*a*) to 33(*e*), FIGS. 34(*a*) to 34(*e*), FIG. 35(*a*) to 35(*c*), FIGS. 36(*a*) to 36(*c*), FIGS. 37 (*a*) to 37(*c*), and FIGS. 38(*a*) to 38(*c*) are process charts illustrate the manufacturing method of the resistor in the fourth exemplary embodiment of the present invention.

As shown in FIGS. 32, 33(*a*), and 34(*a*), prebaked insulated substrate sheet 81 which is 0.2 mm thick, made of alumina of 96% purity, is prepared. Here, insulated substrate sheet 81, as shown in FIG. 32, has ineffective area 81*a* which will not become products, on its entire periphery. This ineffective area 81*a* is configured in a frame shape.

Next, as shown in FIGS. 32, 33(*b*), and 34(*b*), two or more pairs of top electrode layers 82, made mainly of silver, are screen-printed on the top face of insulated substrate sheet 81. Insulated substrate sheet 81 is then baked according to a baking profile with a peak temperature of 850° C. to stabilize top electrode layers 82.

Next, as shown in FIGS. 32, 33(*c*), and 34(*c*), two or more resistor layers 83 made of ruthenium oxide system are screen-printed so as to bridge two or more pairs of top electrode layers 82. Insulated substrate sheet 81 is then baked according to a baking profile with a peak temperature of 850° C. to stabilize resistor layers 83.

Then, as shown in FIGS. 33(*d*) and 34(*d*), first protective layer 84 made of two or more precoat glass layers is screen-printed to cover resistor layers 83. Insulated substrate sheet 81 is baked again following a baking profile with a peak temperature of 600° C. to stabilize first protective layer 84 made of the precoat glass layers.

Next, as shown in FIGS. 33(*e*) and 34(*e*), two or more trimming grooves 85 are made, using a laser trimming method, for adjusting the resistance of resistor layers 83 between pairs of top electrode layers 82 to a predetermined value.

Next, as shown in FIGS. 35(*a*) and 36(*a*), two or more second protective layers 86, mainly made of resin, are screen-printed to cover first protective layer 84 consisting of precoat glass layers, aligned vertically on the drawing. The substrate sheet is cured following a curing profile with a peak temperature of 200° C. for stabilizing second protective layers 86.

Next, as shown in FIGS. 32, 35(*b*), and 36(*b*), two or more first slit dividing portions 87 are formed by dicing on insulated substrate sheet 81, except on ineffective area 81*a* formed over the entire periphery of insulated substrate sheet 81. First dividing portions 87 are used for dividing insulated substrate sheet 81 into substrate strips 81*b* by separating pairs of top electrode layers 82. In this case, first slit dividing portions 87 are formed at a pitch of 700 μm, with a width of 120 μm. In addition, first slit dividing portions 87 are formed using through holes which pass vertically through insulated substrate sheet 81. Insulated substrate sheet 81 still remains as a sheet even after first slit dividing portions 87 are formed by dicing except on ineffective area 81*a*, because substrate strips 81*b* are connected by ineffective area 81*a*.

Next, as shown in FIGS. 35(*c*) and 36(*c*), metal layer 88, made of nickel or nickel alloy, is typically sputtered or electroplated over the entire rear face of insulated substrate sheet 81 on which first slit dividing portions 87 are formed. In addition, two or more pairs of side electrode layers 89 made of nickel or nickel alloy are typically sputtered or electroplated onto the inner face of slitted first electrode layers 89. In this case, side electrode layer 89 formed on the inner face of first slit dividing portions 87 contacts and is electrically coupled to top electrode layer 82 formed on the top face of insulated substrate sheet 81.

Figure 37A:
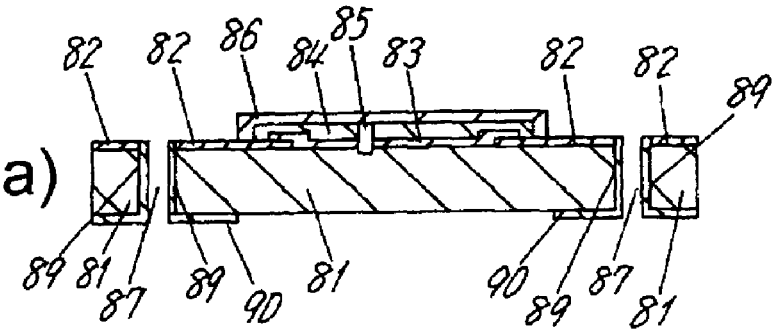
FIGS. 37(*a*) to 37(*c*) are section views illustrating manufacturing processes of the resistor in accordance with the fourth exemplary embodiment of the present invention.
Figure 37B:
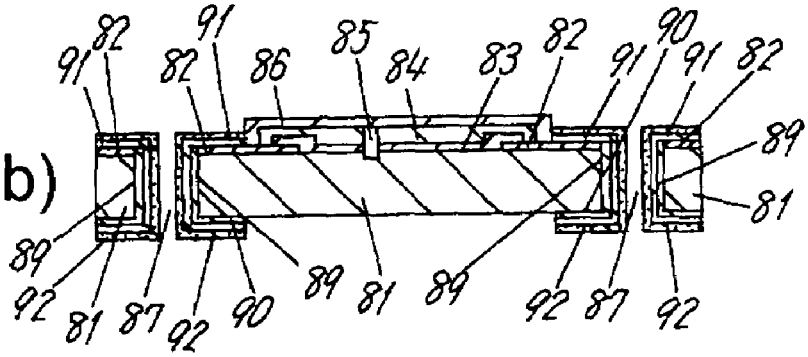
Figure 37C:
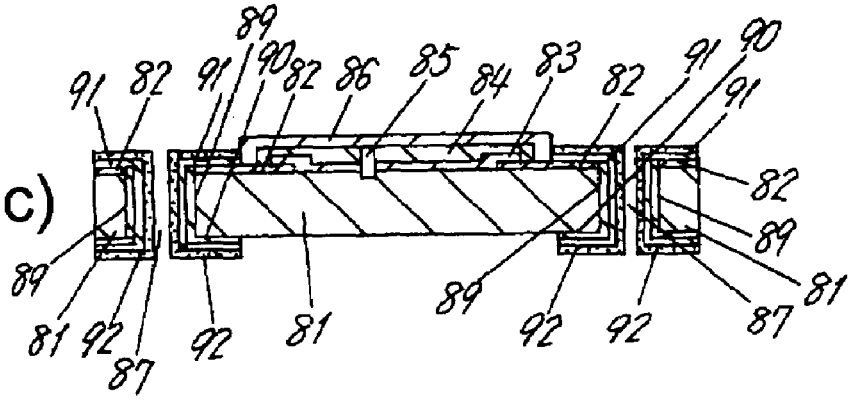

Next, as shown in FIGS. 37(*a*) and 38(*a*), the redundant portion of metal film 88 formed on the entire rear face of insulated substrate sheet 81 is removed by laser to form two or more pairs of rear electrode layers 90.

Figure 38A:
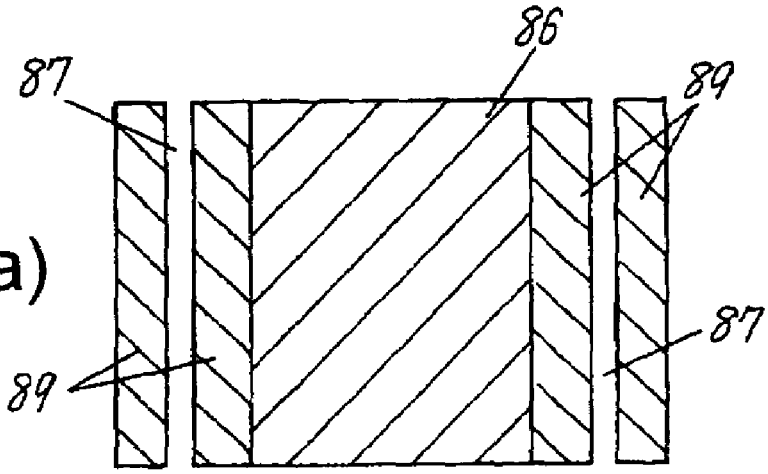
FIGS. 38(*a*) to 38(*c*) are plan views illustrating manufacturing processes of the resistor in accordance with the fourth exemplary embodiment of the present invention.
Figure 38B:
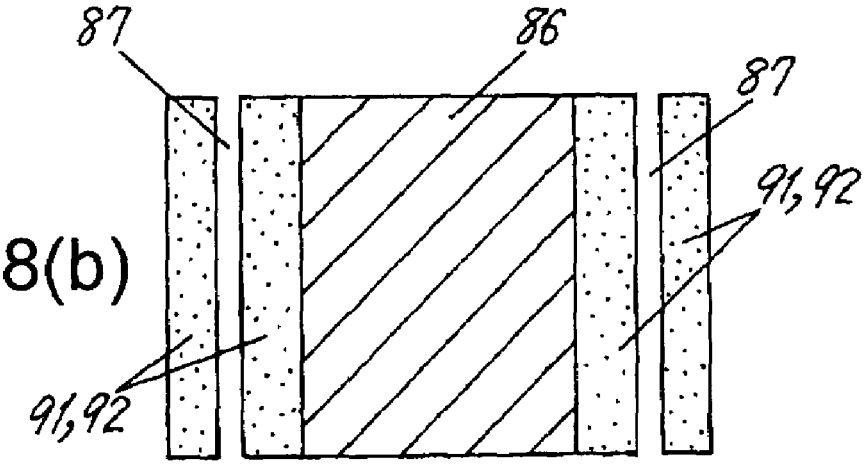
Figure 38C:
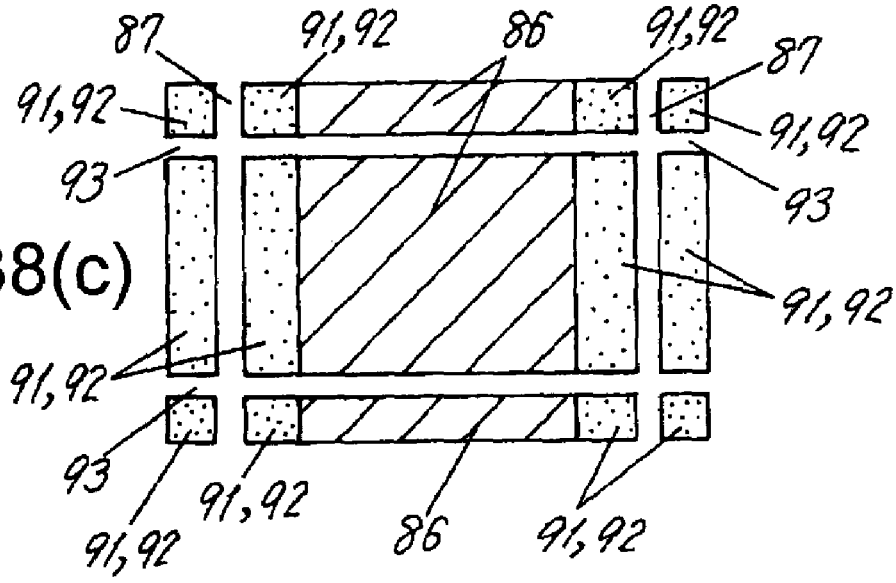

Next, as shown in FIG. 37(*b*) and FIG. 38(*b*), two or more pairs of nickel layers 91 of about 4 to 6 μm thick, made of nickel, and two or more pairs of solder layers 92 of about 4 to 6 μm thick, made of tin, are formed to cover pairs of exposed side electrode layers 89 and a part of pairs of top electrode layers 82. When pairs of side electrode layers 89 are sputtered, the thickness of side electrode layers 89 is about 0.1 to 1 μm. This requires the formation of nickel layer 91 and solder layer 92. If pairs of side electrode layer 89 are electroplated, the formation of only solder layer 92 is sufficient because the thickness of side electrode layer 89 is about 4 to 6 μm.

Solder layer 92 in the fourth exemplary embodiment is made of tin. However, the present invention is not limited to tin. Solder layer 92 may be made of a tin alloy material. In this case, reliable soldering is achievable by reflow soldering.

Moreover, top electrode layer 82 is made of a silver material and resistor layer 83 is made of a ruthenium oxide material. These assure a resistance characteristic with good heat resistance and durability.

Furthermore, the protective layer which covers resistor layer 83 is configured with two layers: i) first protective layer 84 which is a precoat glass layer covering resistor layer 83 and ii) second protective layer 86, mainly made of resin, which covers first protective layer 84 and trimming groove 85. First protective layer 84 prevents occurrence of cracking during laser trimming to reduce current noise, and second protective layer 86, mainly comprising resin, secures resistance characteristics with good humidity resistance by covering the entire resistor layer 83.

Lastly, as shown in FIGS. 32, 37(*c*), and 38(*c*), two or more second dividing portions 93 are diced on substrate strips 81*b* in insulated substrate sheet 81 in a direction perpendicular to first slit dividing portions 87 except on ineffective area 81*a* formed over the entire periphery of insulated substrate sheet 81. This separates resistor layers 83, and divides insulated substrate sheet 81 into discrete substrates 81*c*. In this case, second dividing portions 93 are formed at a pitch of 400 μm, with a width of 100 μm. Since these second dividing portions 93 are formed by dicing on substrate strips 81*b* except on ineffective area 81*a*, substrate strips 81*b* are divided into discrete substrates 81*c* every time second dividing portion 93 is formed. Substrate strips divided into individual products are separated from ineffective area 81*a*.

The resistor in the fourth exemplary embodiment is manufactured using the above processes.

The total length and total width of the resistor, which is a product, made through the above processes are precisely 0.6 mm L×0.3 mm W. This is because the pitch of first slit dividing portions 87 and second dividing portions 93 made by dicing are accurate (within ±0.005 mm) and the thicknesses of side electrode layer 89, nickel layer 91, and solder layer 92 are also accurate. Moreover, the patterning accuracy of top electrode layers 82 and resistor layers 83 eliminates the need for dimensional ranking of discrete substrates in addition to the need to take into account dimensional variations within the same dimensional ranking of the discrete substrates. The effective area of resistor layer 83 is thus broader than that of the prior art. More specifically, the resistor layer in the prior art is about 0.20 mm L×0.19 mm W. Resistor layer 83 of the resistor in the fourth exemplary embodiment of the present invention is about 0.25 mm L×0.24 mm W, which is about 1.6 times larger in area.

Since first slit dividing portions 87 and second dividing portions 93 are formed by dicing, insulated substrate sheet 81 which does not require dimensional ranking of discrete substrates is usable. This eliminates the need for classifying discrete substrates by dimensions as in the prior art, thereby eliminating the complicated process of replacing a mask in the prior art. Dicing can also be performed easily using a general dicing machine for semiconductors.

Insulated substrate sheet 81 is framed by ineffective area 81*a* which does not become a product. In addition, first slit dividing portions 87 and second dividing portions 93 are not formed on this ineffective area 81*a*. Accordingly, substrate strips 81*b* are connected to ineffective area 81*a* even after forming first slit dividing portions 87. This prevents insulated substrate sheet 81 from being separated into substrate strips 81*b*. Remaining processes are thus implemented on insulated substrate sheet 81 with ineffective area 81*a* even after first slit dividing portions 87 are formed, thereby contributing to the simplification of process design. Furthermore, when second dividing portions 93 are formed, insulated substrate sheet 81 is cut into discrete substrates 81*c* every time second dividing portion 93 is formed. Each discrete substrate 81*c*, which is a product, is thus separated from ineffective area 81*a*, thereby eliminating the process of sorting ineffective area 81*a* and products afterwards.

Still more, side electrode layers 89 may be formed on insulated substrate sheet 81 at required areas because pairs of side electrode layers 89, nickel layer 91, and pairs of solder layers 92 are formed on insulated substrate 81 in the form of a sheet before being divided. Potential difference during the formation of nickel layer 91 and solder layers 92 by electroplating may also be reduced, thereby allowing the formation of stable nickel layer 91 and solder layer 92.

Figure 39:
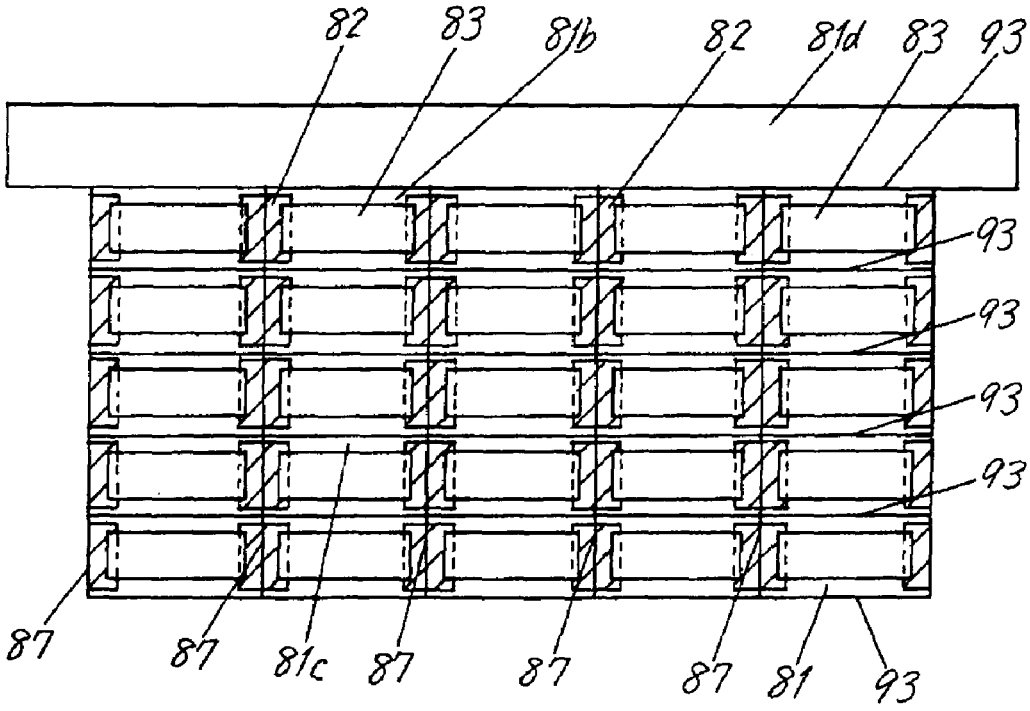
FIG. 39 is a top view illustrating the state in which an ineffective area is formed on one end of the insulated substrate sheet used for manufacturing the resistor in the fourth exemplary embodiment of the present invention.
Figure 40:
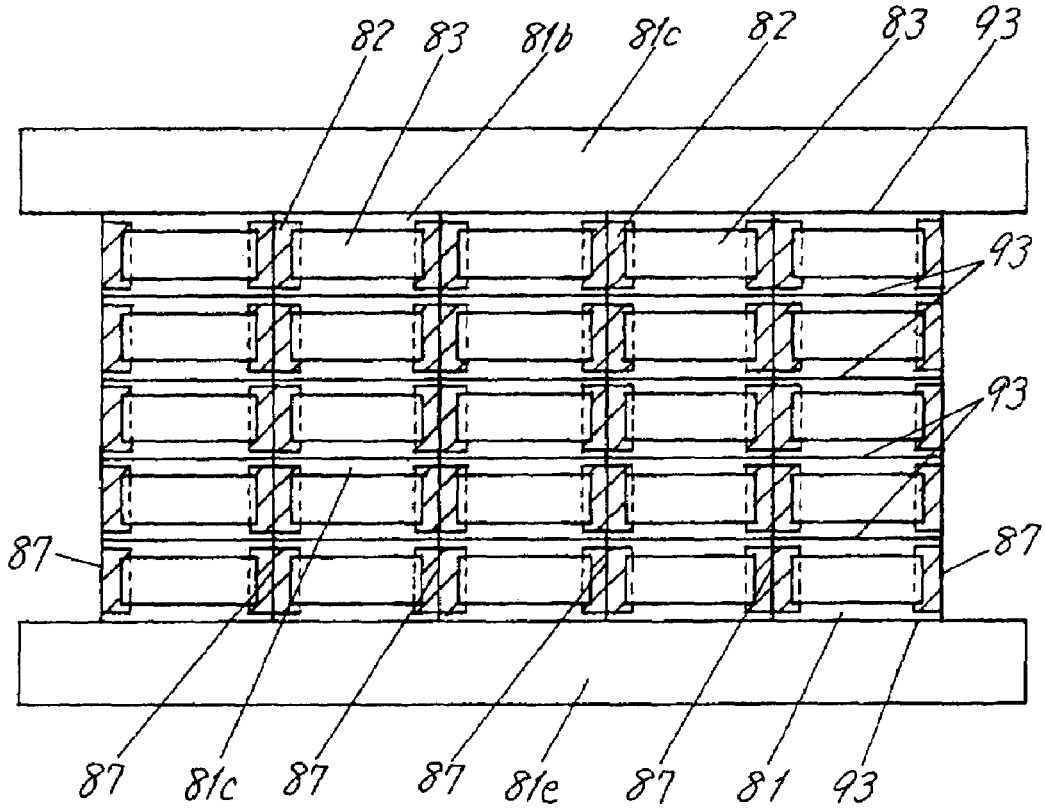
FIG. 40 is a top view illustrating the state in which an ineffective area is formed on both ends of the insulated substrate sheet used for manufacturing the resistor in the fourth exemplary embodiment of the present invention.
Figure 41:
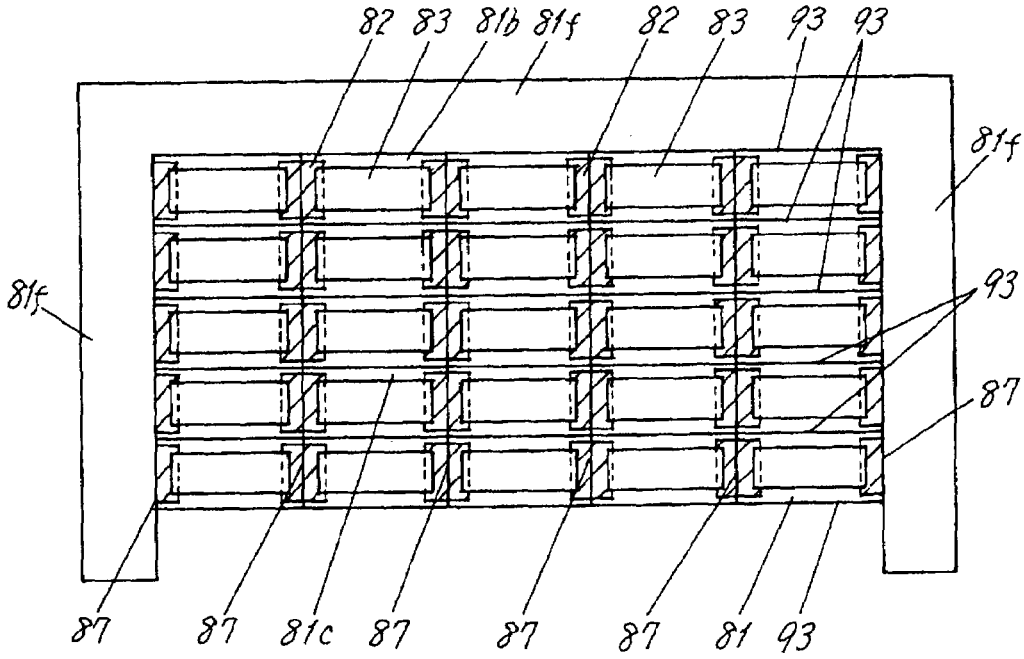
FIG. 41 is a top view illustrating the state in which an ineffective area is formed on three ends of the insulated substrate sheet used for manufacturing the resistor in the fourth exemplary embodiment of the present invention.

The fourth exemplary embodiment of the present invention describes the case of form ing ineffective area 81*a* which does not become a part of a finished product on the entire periphery of insulated substrate sheet 81 in a shape of a frame. However, ineffective area 81*a* may not need to frame insulated substrate sheet 81. For example, as shown in FIG. 39, ineffective area 81*d* may be formed on end of insulated substrate sheet 81. Alternatively, as shown in FIG. 40, ineffective area 81*e* may be formed on both ends of insulated substrate sheet 81. Alternatively, as shown in FIG. 41, ineffective area 81*f* may be formed on three ends of insulated substrate sheet 81. All these demonstrate the same effect as that of the fourth exemplary embodiment of the present invention.

The fourth exemplary embodiment of the present invention also describes the case of forming second dividing portions 93 by dicing. In other cases, for example, second dividing portions 93 may be formed by cutting the top, rear, or center of insulated substrate sheet 81 using a laser beam or dicing, while retaining a thinned portion in the top, rear, or center parts of insulated substrate sheet 81. In this case, the insulated substrate sheets are not immediately divided into pieces by forming second dividing portions 93 but in two steps.

The fourth exemplary embodiment of the present invention also describes the case of using a silver material for top electrode layer 82 and a ruthenium oxide material for resistor layer 83. However, other materials may be used for achieving the same effect as that of the fourth exemplary embodiment of the present invention.

The fourth exemplary embodiment of the present invention also describes the case of forming first slit dividing portions 87 and second dividing portions 93 by dicing. The same effect as that of the fourth exemplary embodiment is also achievable by using other dividing portion-forming means such as a laser or water jet for making first slit dividing portions 87 and second dividing portions 93.

Furthermore, the fourth exemplary embodiment of the present invention describes the case of forming first slit dividing portions 87 on insulated substrate sheet 81 after forming pairs of top electrode layers 82, resistor layers 83, first protective layers 84, trimming grooves 85, and second protective layers 86 when first slit dividing portions 87 are formed for dividing the substrate into substrate strips 81*b*. However, the present invention is not limited to processes in this sequence. For example, first slit dividing portions 87 may be formed on insulated substrate sheet 81 first or insulated substrate sheet 81 already provided with first slit dividing portions 87 may be used for manufacture. Alternatively, first slit dividing portions 87 may be formed on insulated substrate sheet 81 after pairs of top electrode layers 82 are formed on insulated substrate sheet 81. Or, first slit dividing portions 87 may be formed on insulated substrate sheet 81 after resistor layers 83 are formed on insulated substrate sheet 81. Alternatively, first slit dividing portions 87 may be formed on insulated substrate sheet 81 after pairs of top electrode layers 82 are formed on insulated substrate sheet 81 and then resistor layers 83 are formed such that a part of resistor layers 83 overlap these pairs of top electrode layers 82. Or, first slit dividing portions 87 may be formed on insulated substrate sheet 81 after resistor layers 83 are formed on insulated substrate sheet 81 and then pairs of top electrode layers 82 are formed such that a part of top electrode layers 82 overlaps resistor layers 83. Or, first slit dividing portions 87 may be formed on insulated substrate sheet 81 after pairs of top electrode layers 82 and resistor layers 83 are formed on insulated substrate sheet 81 and trimming is applied to adjust the resistance in these resistor layers 83 between pairs of top electrode layers 82. In all the above cases, the same effect is achievable as that of the fourth exemplary embodiment of the present invention.

Fifth Exemplary Embodiment

A method for manufacturing a resistor in a fifth exemplary embodiment of the present invention is described below with reference to drawings.

Figure 42:
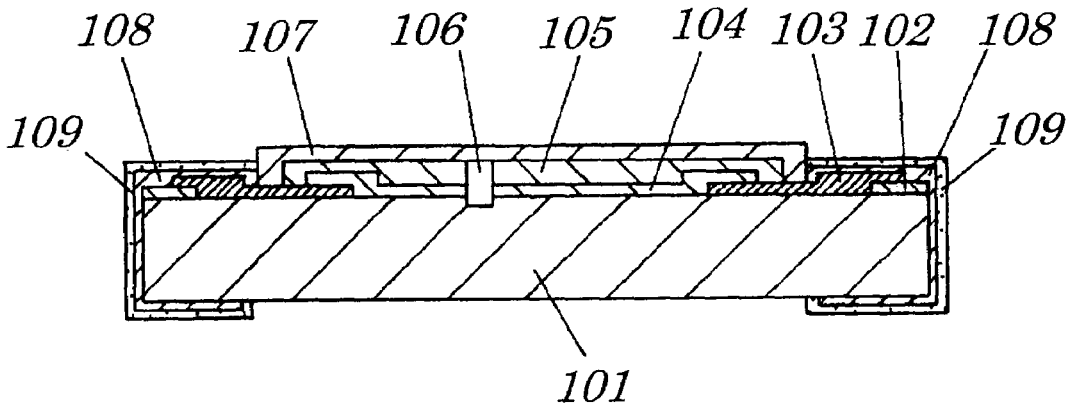
FIG. 42 is a section view of a resistor manufactured using a method for manufacturing a resistor in a fifth exemplary embodiment of the present invention.

FIG. 42 is a section view of the resistor in the fifth exemplary embodiment of the present invention.

In FIG. 42, a prebaked insulated substrate sheet is made of alumina of 96% purity. Discrete substrate 101 is made by dividing this substrate sheet into individual pieces along a first slit dividing portion and a second dividing portion perpendicular to the first dividing portion. A pair of metal layers 102, made mainly of gold, is formed on the top face of discrete substrate 101. A pair of top electrode layers 103, made mainly of silver, is formed on the top face of discrete substrate 101 such that a part of top electrode layers 103 overlaps the pair of metal layer 102. Resistor layer 104, made of ruthenium oxide system, is formed on the top face of discrete substrate 101 such that a part of resistor layer 104 overlaps the pair of top electrode layers 103. First protective layer 105, which is a precoat glass layer, is formed on the top face of resistor layer 104. Trimming groove 106 is provided to adjust a resistance of resistor layer 104 between the pair of top electrode layers 103. Second protective layer 107, made mainly of resin, is formed to cover first protective layer 105 which is a precoat glass layer. A pair of side electrode layers 108 is formed such that a part of side electrode layers 108 overlaps the pair of top electrode layers 103. Solder layer 109, made of tin, is formed so as to cover the pair of side electrode layers 108 and a part of the pair of top electrode layers 103.

A method for manufacturing the resistor in the fifth exemplary embodiment as configured above is described next with reference to drawings.

Figure 43:
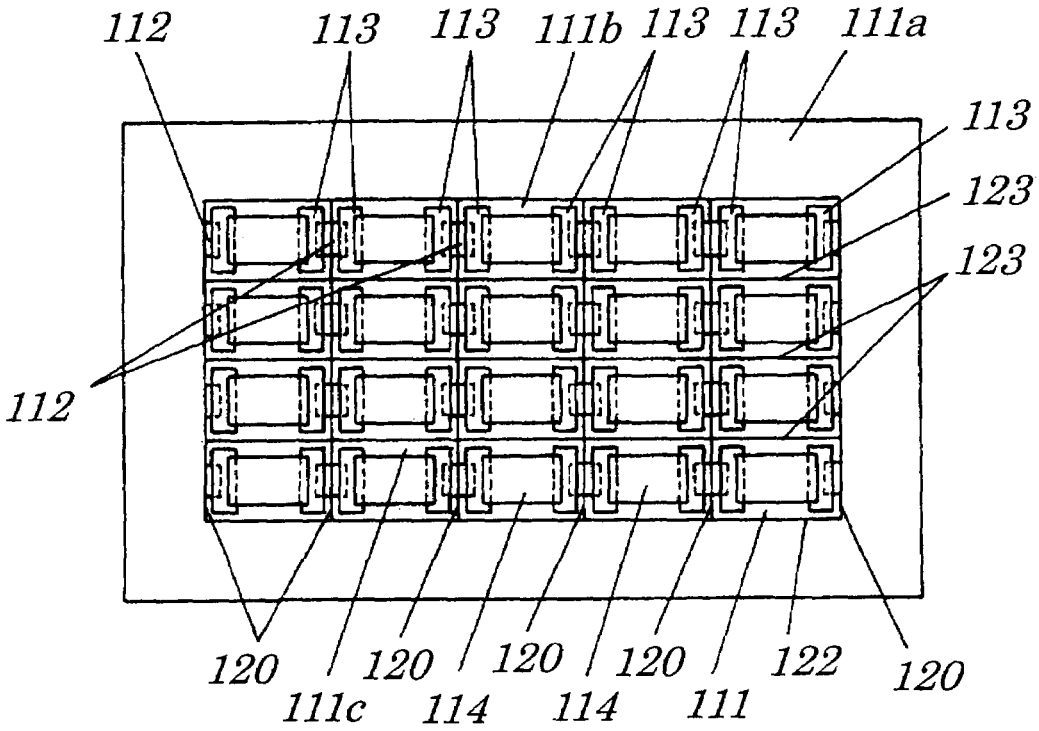
FIG. 43 is a top view illustrating the state in which an ineffective area is formed on the entire periphery of the insulated substrate sheet used for manufacturing the resistor in accordance with the fifth exemplary embodiment of the present invention.
Figure 44A:
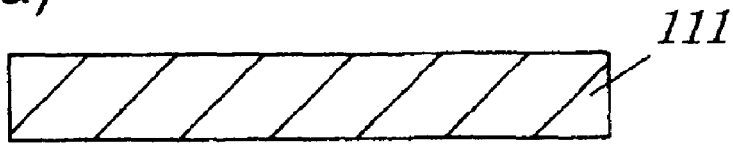
FIGS. 44(*a*) to 44(*f*) are section views illustrating manufacturing processes of the resistor in accordance with the fifth exemplary embodiment of the present invention.
Figure 44B:
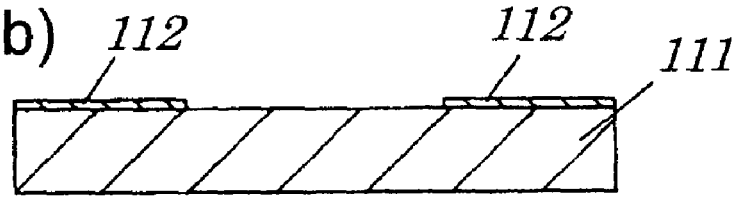
Figure 44C:
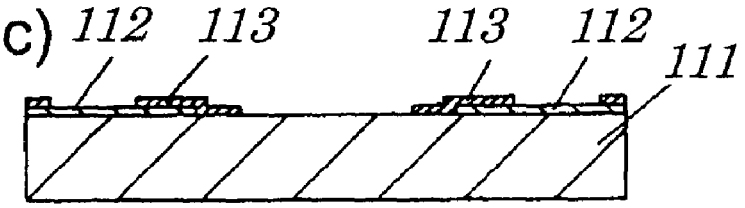
Figure 44D:
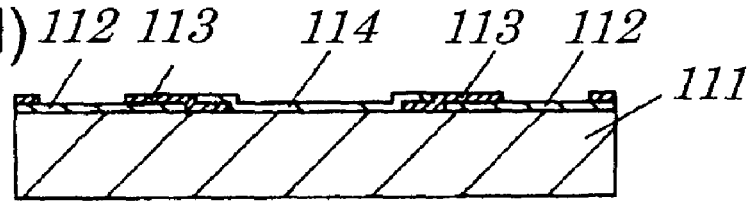
Figure 44E:
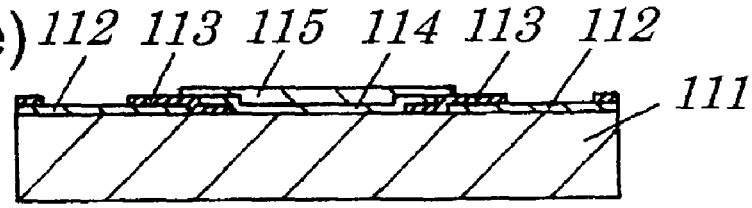
Figure 44F:
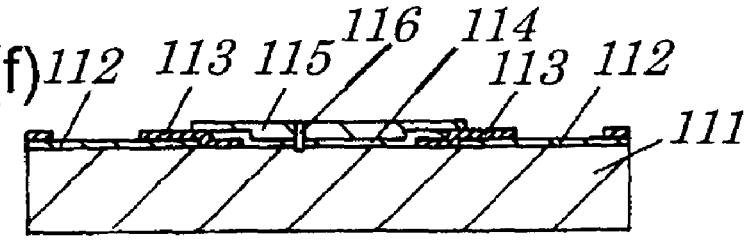
Figure 46A:
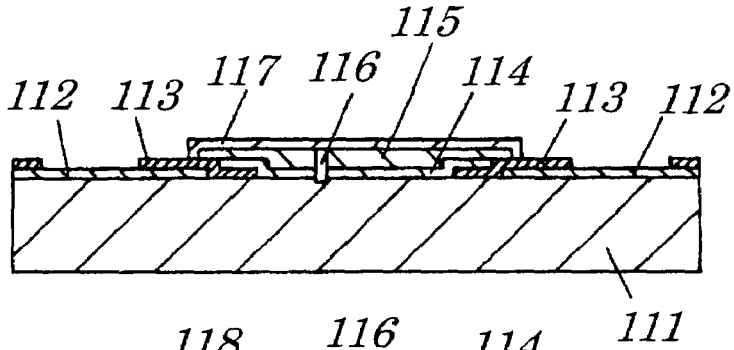
FIGS. 46(*a*) to 46(*d*) are section views illustrating manufacturing processes of the resistor in accordance with the fifth exemplary embodiment of the present invention.
Figure 46B:
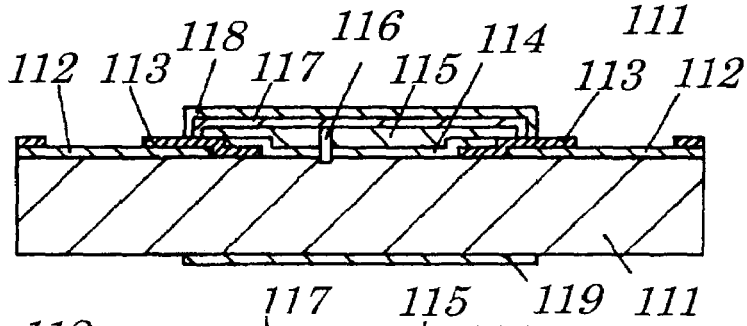
Figure 46C:
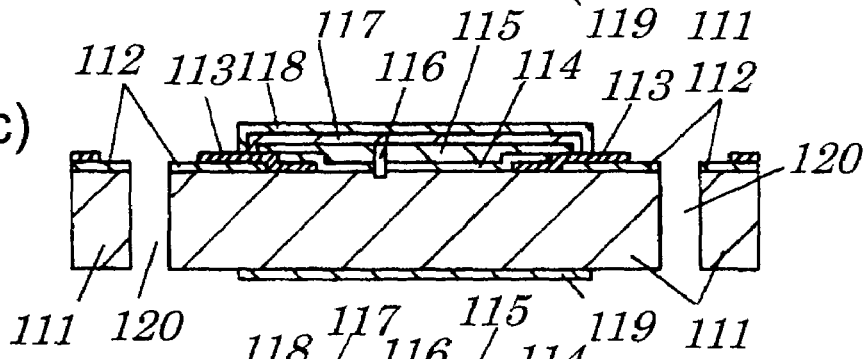
Figure 46D:
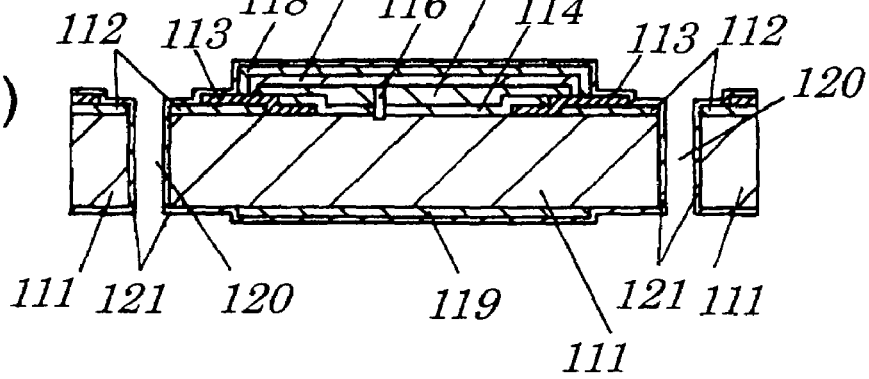
Figure 47A:
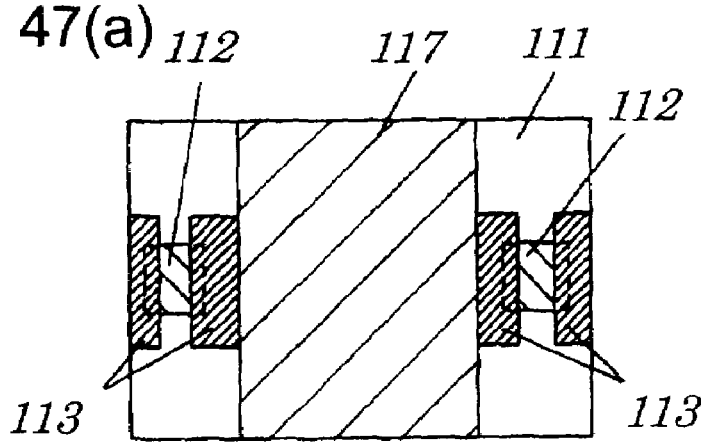
FIGS. 47(*a*) to 47(*d*) are plan views illustrating manufacturing processes of the resistor in accordance with the fifth exemplary embodiment of the present invention.
Figure 47B:
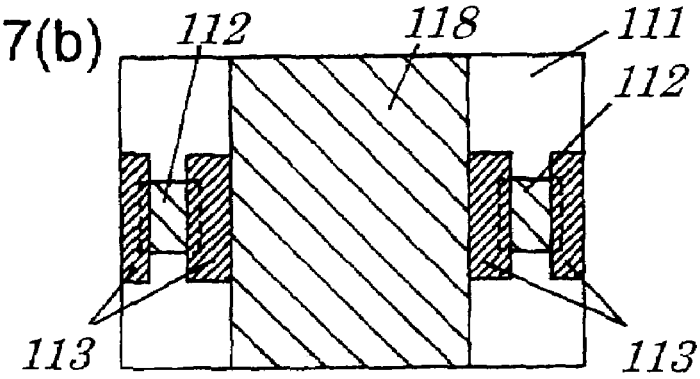
Figure 47C:
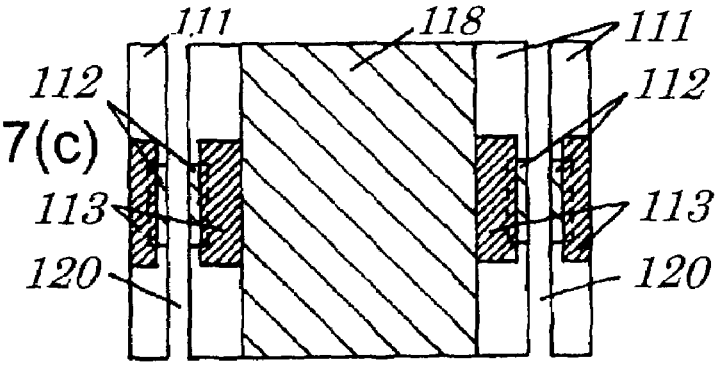
Figure 47D:
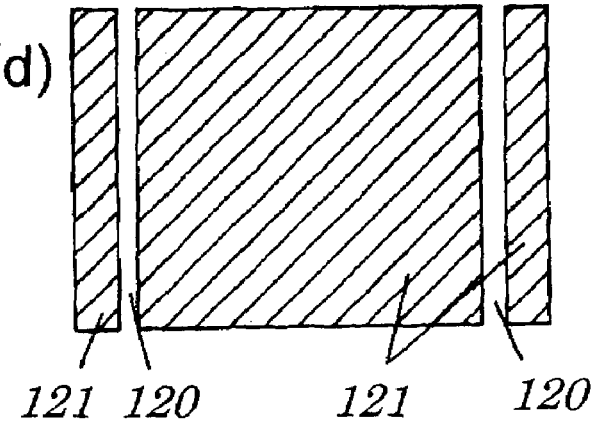

FIG. 43 is a top view illustrating the state in which a ineffective area is formed on the entire periphery of the insulated substrate sheet used for manufacturing the resistor in the fifth exemplary embodiment of the present invention. FIGS. 44 (A) to 44(*f*), FIGS. 45(*a*) to 45(*f*), FIG. 46(*a*) to 46(*d*), FIGS. 47(*a*) to 47(*d*), FIGS. 48(*a*) to 48(*c*), and FIGS. 49(*a*) to 49(*c*) are process charts illustrating the manufacturing method of the resistor in the fifth exemplary embodiment of the present invention.

As shown in FIG. 43, FIG. 44(*a*), and FIG. 45(*a*), prebaked insulated substrate sheet 111 which is 0.2 mm thick, made of alumina of 96% purity, is prepared. Here, insulated substrate sheet 111, as shown in FIG. 43, has ineffective area 11*a*, which will not become products, on its periphery. This ineffective area 111*a* is configured in a frame shape.

Next, as shown in FIG. 43, FIG. 44(*b*), and FIG. 45(*b*), two or more pairs of metal layer 112, made mainly of gold, are screen-printed on the top face of insulated substrate sheet 111 so as to bridge first dividing portions. Insulated substrate sheet 111 is then baked according to a baking profile with a peak temperature of 850° C. to stabilize metal layers 112.

Next, as shown in FIGS. 43, 44(*c*), and 45(*c*), two or more pairs of top electrode layers 113, made mainly of silver, are screen-printed on the top face of insulated substrate sheet 111 such that they are electrically coupled to pairs of metal layers 112. Insulated substrate sheet 111 is then baked according to a baking profile with a peak temperature of 850° C. to stabilize top electrode layers 113.

Next, as shown in FIGS. 43, 44(*d*), and 45(*d*), two or more resistor layers 114 made of ruthenium oxide system are screen-printed so as to bridge pairs of top electrode layers 113. Insulated substrate sheet 111 is then baked according to a baking profile with a peak temperature of 850° C. to stabilize resistor layers 114.

Then, as shown in FIGS. 44(*e*) and 45(*e*), first protective layer 115 made of two or more precoat glass layers is screen-printed to cover resistor layers 114. Insulated substrate sheet 111 is baked again following a baking profile with a peak temperature of 600° C. to stabilize first protective layer 115 made of the precoat glass layers.

Next, as shown in FIGS. 44(*f*) and 45(*f*), two or more trimming grooves 116 are made using a trimming method for adjusting a resistance of resistor layers 114 between pairs of top electrode layers 113 to a predetermined value.

Next, as shown in FIGS. 46(*a*) and 47(*a*), two or more second protective layers 117, mainly made of resin, are screen-printed to cover first protective layer 115, consisting of precoat glass layers, aligned vertically on the drawing. The substrate sheet is cured following a curing profile with a peak temperature of 200° C. for stabilizing second protective layers 117.

Next, as shown in FIG. 46(*b*) and FIG. 47(*b*), two or more first resist layers 118 are screen-printed to cover second protective layers 117, and first resist layers 118 are stabilized by UV-ray curing. Furthermore, two or more second resist layers 119 are screen-printed on the rear face of insulated substrate sheet 111, and second resist layers 119 are stabilized also by UV-ray curing.

Next, as shown in FIGS. 43, 46(*c*), and 47(*c*), two or more first slit dividing portions 120 are formed by dicing on insulated substrate sheet 111, except on ineffective area 111*a* formed over the entire periphery of insulated substrate sheet 111 on which first resist layers 118 and second resist layers 119 are formed. First dividing portions 120 are used for dividing insulated substrate sheet 111 into substrate strips 111*b* by separating only pairs of metal layers 112. In this case, first slit dividing portions 120 are formed at a pitch of 700 μm, with a width of 120 μm. In addition, first slit dividing portions 120 are formed using through holes which pass vertically through insulated substrate sheet 111. Insulated substrate sheet 111 still remains as a sheet even after first slit dividing portions 120 are formed by dicing except on ineffective area 111*a*, because substrate strips 111*b* are connected by ineffective area 111*a*.

Next, as shown in FIGS. 46(*d*) and 47(*d*), insulated substrate sheet 111 is entirely plated with nickel, using electroless plating, by dipping insulated substrate sheet 111 into a plating bath to form side electrode layer 121 of about 4 to 6 μm thick. When side electrode layer 121 is formed by plating nickel onto the entire face of insulated substrate sheet 111 by electroless plating, side electrode layer 121 is also formed on the rear face of insulated substrate sheet 111 through the entire inner face of first slit dividing portions 120 which is a through hole from the top face of insulated substrate sheet 111. This is because first slit dividing portions 120 are through holes which pass vertically through insulated substrate sheet 111. In addition, side electrode layer 121 covers a part of exposed top electrode layer 113 and first resist layer 118 on the top face of insulated substrate sheet 111. On the rear face of insulated substrate sheet 111, side electrode layer 121 is formed to cover second resist layer 119.

Figure 48A:
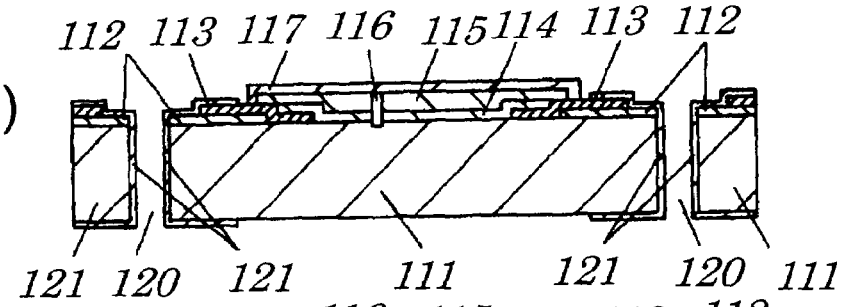
FIGS. 48(*a*) to 48(*c*) are section views illustrating manufacturing processes of the resistor in accordance with the fifth exemplary embodiment of the present invention.
Figure 48B:
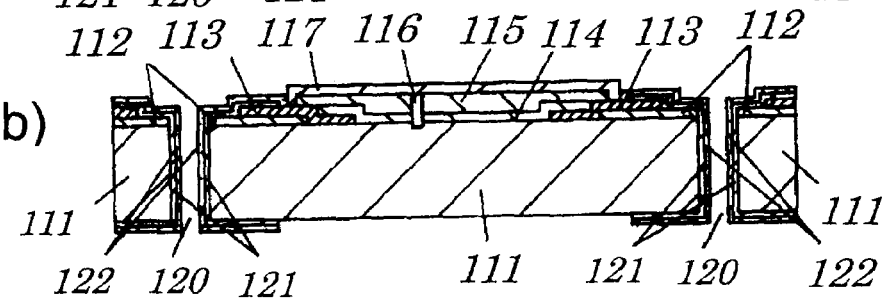
Figure 48C:
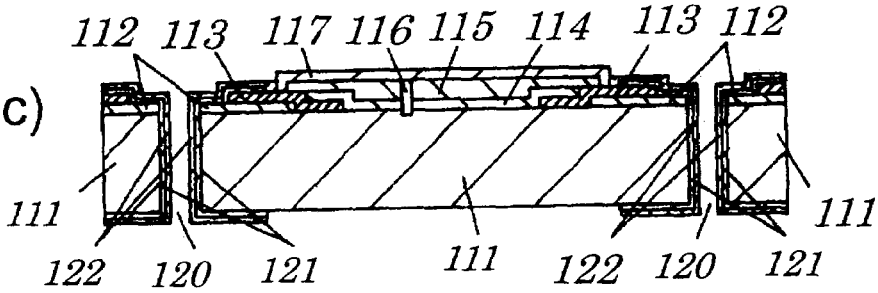
Figure 49A:
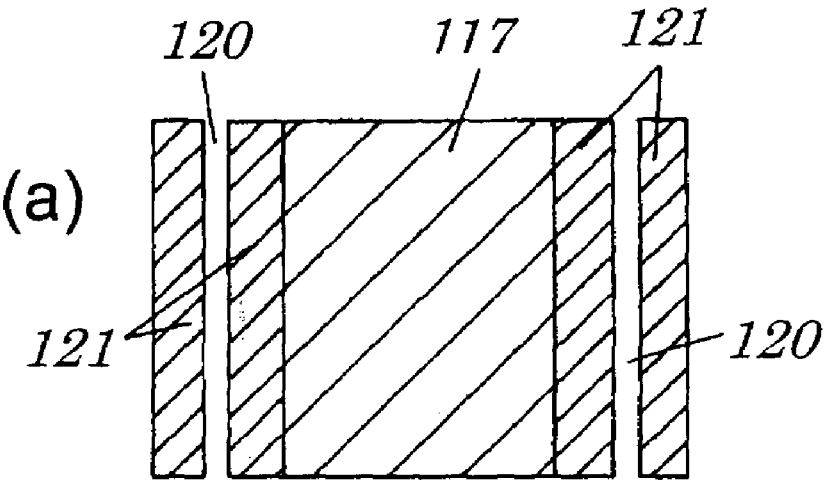
FIGS. 49(*a*) to 49(*c*) are plan views illustrating manufacturing processes of the resistor in accordance with the fifth exemplary embodiment of the present invention.
Figure 49B:
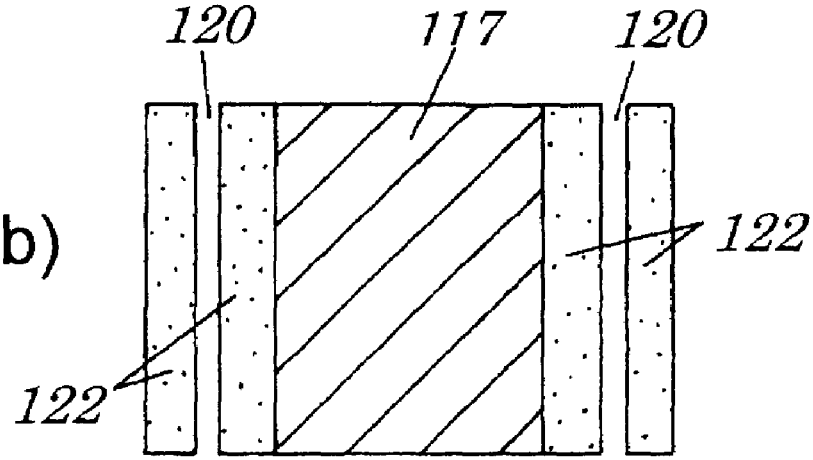
Figure 49C:
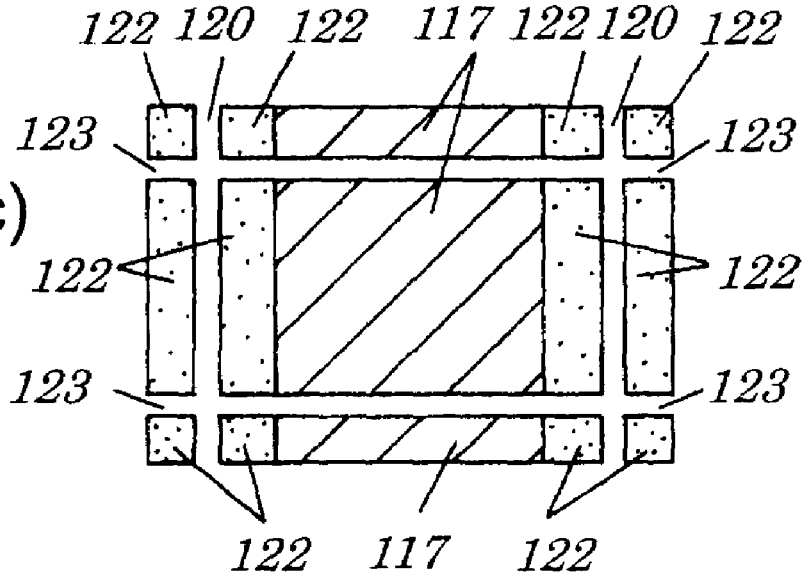

Next, as shown in FIGS. 48(*a*) and 49(*a*), first resist layers (not illustrated) and second resist layers (not illustrated) are peeled for patterning two or more pairs of side electrode layers 121.

Next, as shown in FIGS. 48(*b*) and 49(*b*), two or more pairs of solder layers 122, made of tin, of about 4 to 6 μm in thickness, are electroplated to cover pairs of side electrode layers 121 exposed and a part of pairs of top electrode layers 113 exposed by peeling off first resist layers (not illustrated).

Thickness of side electrode layer 121 is about 4 to 6 μm, but this is not limited. Appropriate thickness of side electrode layer 121 is 1 to 15 μm. The configuration in the fifth exemplary embodiment achieves extremely high dimensional accuracy.

Solder layer 122 in the fifth exemplary embodiment is made of tin. However, the present invention is not limited to tin. Solder layer 122 may be made of a tin alloy material. In this case, reliable soldering is achievable by reflow soldering.

Moreover, metal layer 112 in the fifth exemplary embodiment is made of a gold material, top electrode layer 113 is made of a silver material, and resistor layer 114 is made of a ruthenium oxide material in the fifth exemplary embodiment. These assure a resistance characteristic with good heat resistance and durability.

Furthermore, the protective layer which covers resistor layer 114 is configured with two layers: i) first protective layer 115 which is a precoat glass layer covering resistor layer 114 and ii) second protective layer 117, mainly made of resin, which covers first protective layer 115 and trimming groove 116. First protective layer 115 prevents occurrence of cracking during laser trimming to reduce current noise, and second protective layer 117, mainly comprising resin, secures resistance characteristics with good humidity resistance by covering the entire resistor layer 114.

Lastly, as shown in FIGS. 43, 48(*c*), and 49(*c*), two or more second dividing portions 123 are diced in a direction perpendicular to first slit dividing portions 120 except on ineffective area 111*a*. This allows resistor layers 114 on substrate strips 111*b* in insulated substrate sheet 111 to be separated into individual discrete substrates 111*c*. In this case, second dividing portions 123 are formed at a pitch of 400 μm, with a width of 100 μm. Since these second dividing portions 123 are formed by dicing on substrate strips 111*b* except on ineffective area 111*a*, substrate strips 111*b* are divided into discrete substrates 111*c* every time second dividing portion 123 is formed. Substrate strips divided into individual products are separated from ineffective area 111*a*.

The resistor in the fifth exemplary embodiment is manufactured using the above processes.

The total length and total width of the resistor, which is a product, made through the above processes are precisely 0.6 mm L×0.3 mm W. This is because the pitch of first slit dividing portions 120 and second dividing portions 123 made by dicing are accurate (within ±0.005 mm) and the thicknesses of side electrode layer 121 and solder layer 122 are also accurate. Moreover, the patterning accuracy of metal layer 112, top electrode layers 113 and resistor layers 114 eliminates the need for dimensional ranking of discrete substrates, eliminating the need to take into account dimensional variations within the same dimensional ranking of the discrete substrates as well as dimensional ranking of discrete substrates. The effective area of resistor layer 114 is thus broader than that of the prior art. More specifically, the resistor layer in the prior art is about 0.20 mm L×0.19 mm W. Resistor layer 114 of the resistor in the fifth exemplary embodiment of the present invention is about 0.25 mm L×0.24 mm W, which is about 1.6 times larger in area.

Since first slit dividing portions 120 and second dividing portions 123 are formed by dicing, insulated substrate sheet 111 which does not require dimensional ranking of discrete substrates may be used. This eliminates the need for classifying discrete substrates by dimensions as in the prior art, eliminating the complicated process of replacing a mask in the prior art. Dicing can also be performed easily using a general dicing machine for semiconductors or the like.

Insulated substrate sheet 111 is framed by ineffective area 111*a* which does not become a product. In addition, first slit dividing portions 120 and second dividing portions 123 are not formed on this ineffective area 111*a*. Accordingly, substrate strips 111*b* are connected to ineffective area 111*a* even after forming first slit dividing portions 120. This prevents insulated substrate sheet 111 from being separated into substrate strips 111*b*. Remaining processes are thus implemented on insulated substrate sheet 111 with ineffective area 111*a* even after first slit dividing portions 120 are formed, thereby contributing to the simplification of process design.

Furthermore, when second dividing portions 123 are formed, insulated substrate sheet 111 is cut into discrete substrates 111*c* every time second dividing portion 123 is formed. Each discrete substrate 111*c*, which is a product, is thus separated from ineffective area 111*a*, thereby eliminating the process of sorting ineffective area 111*a* and products afterwards.

Still more, side electrode layers 121 are formed on insulated substrate sheet 111 because pairs of side electrode layers 121 and pairs of solder layers 122 are formed on insulated substrate 111 in the form of a sheet before being divided. Potential difference during the formation of solder layers 122 by electroplating may also be reduced, thereby allowing the formation of stable solder layer 122.

Figure 50:
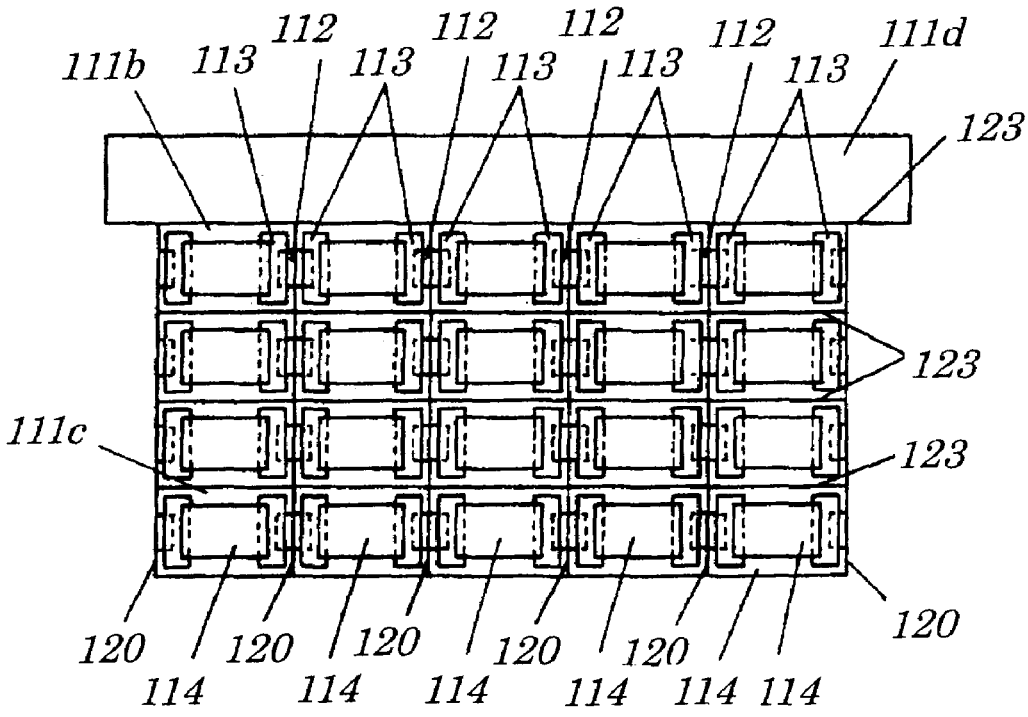
FIG. 50 is a top view illustrating the state in which an ineffective area is formed on one end of the insulated substrate sheet used for manufacturing the resistor in the fifth exemplary embodiment of the present invention.
Figure 51:
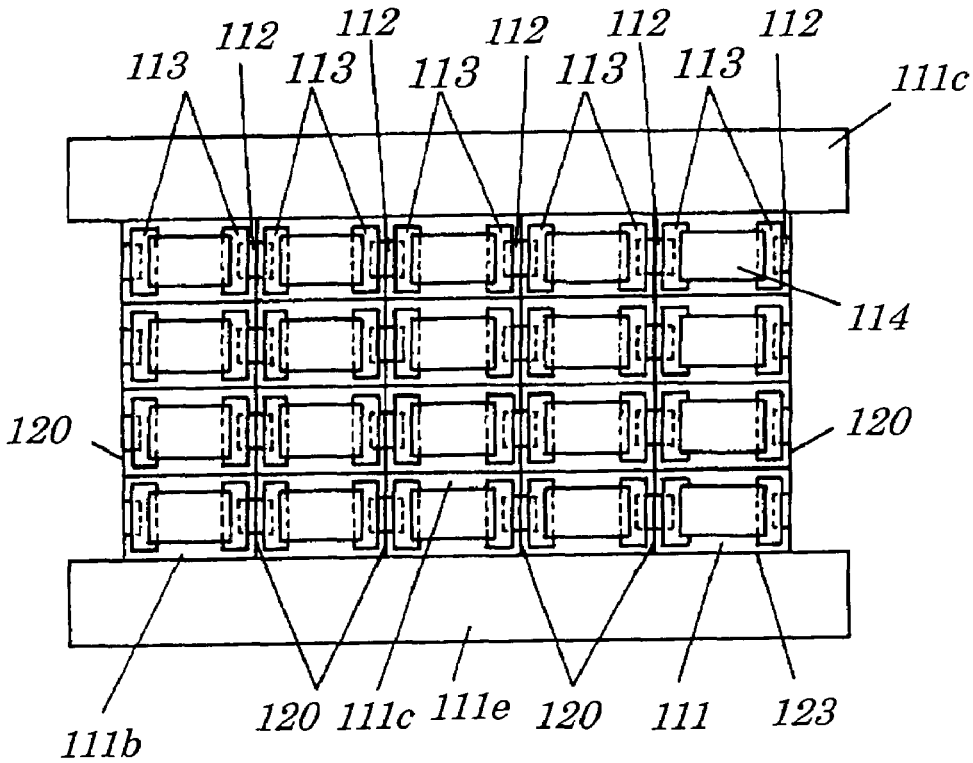
FIG. 51 is a top view illustrating the state in which an ineffective area is formed on both ends of the insulated substrate sheet used for manufacturing the resistor in the fifth exemplary embodiment of the present invention.
Figure 52:
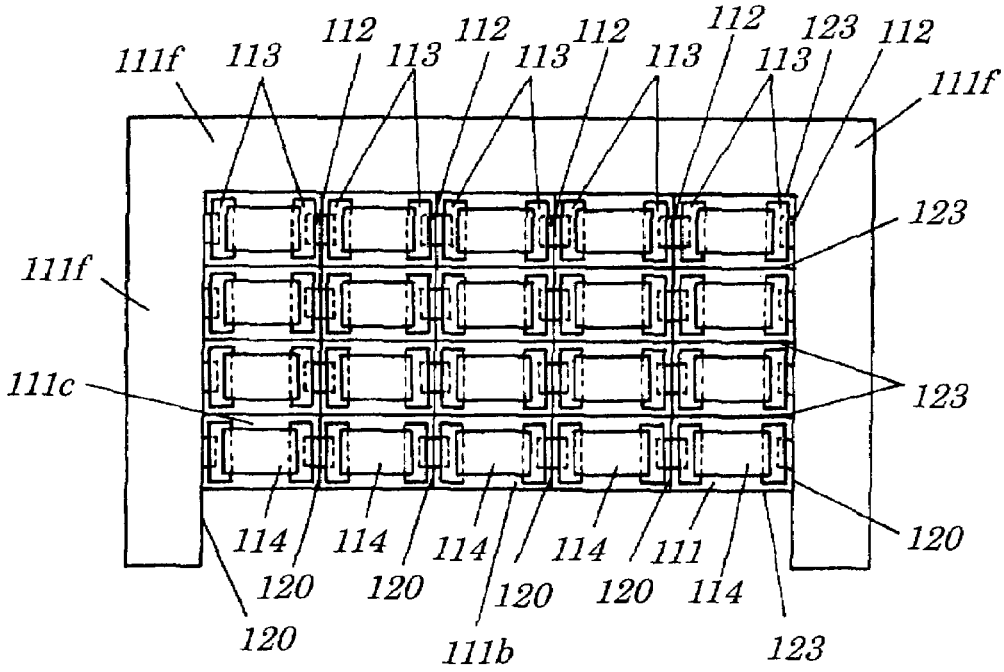
FIG. 52 is a top view illustrating the state in which an ineffective area is formed on three ends of the insulated substrate sheet used for manufacturing the resistor in the fifth exemplary embodiment of the present invention.
Figure 53:
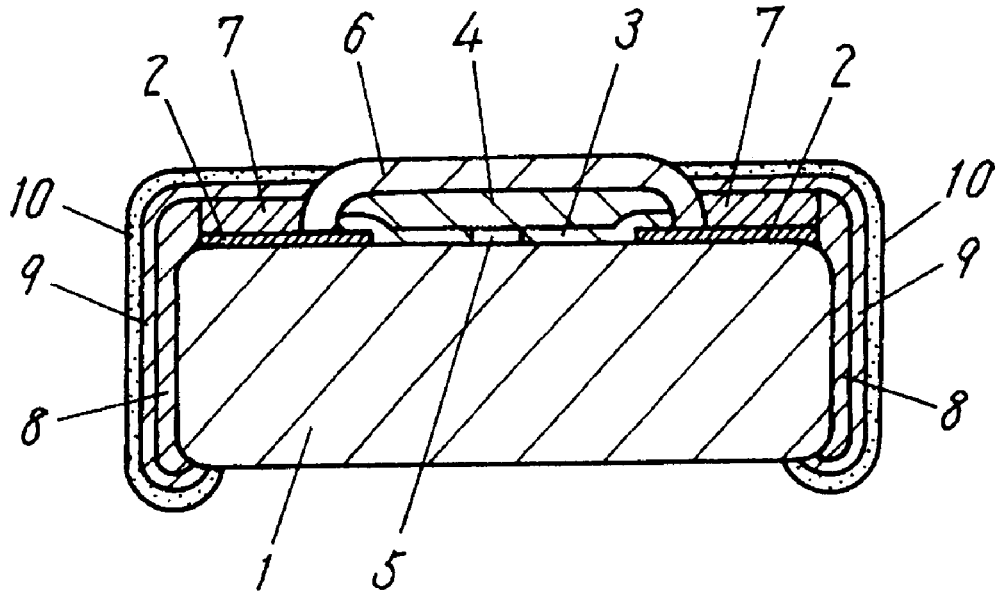
FIG. 53 PRIOR ART
FIG. 53 is a section view of a conventional resistor.
Figure 54A:
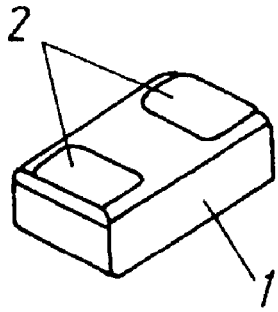
FIG. 54(a) PRIOR ART
FIGS. 54(*a*) to 54(*f*) are perspective views illustrating manufacturing processes of the conventional resistor.
Figure 54B:
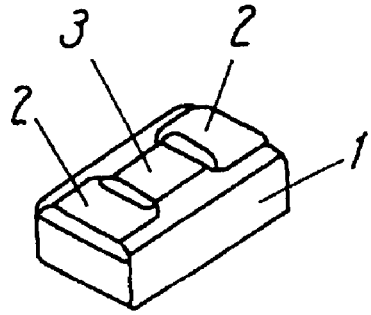
FIG. 54(b) PRIOR ART
Figure 54C:
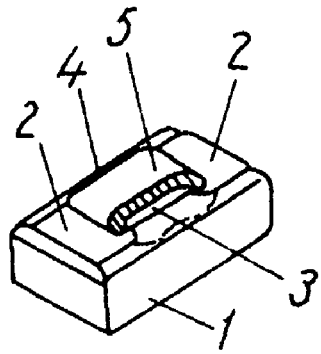
FIG. 54(c) PRIOR ART
Figure 54D:
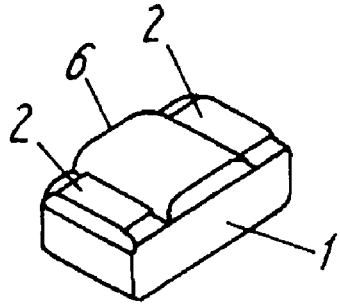
FIG. 54(d) PRIOR ART
Figure 54E:
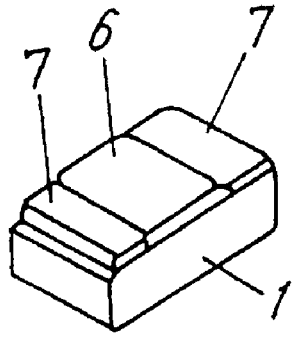
FIG. 54(e) PRIOR ART
Figure 54F:
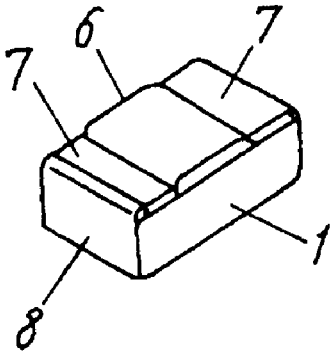
FIG. 54(f) PRIOR ART

The fifth exemplary embodiment of the present invention describes the case of forming ineffective area 111*a* which does not become a part of a finished product on the entire periphery of insulated substrate sheet 111 in a shape of a frame. However, ineffective area 111*a* may not need to frame insulated substrate sheet 111. For example, as shown in FIG. 50, ineffective area 111*d* may be formed on a part of insulated substrate sheet 111. Alternatively, as shown in FIG. 51, ineffective area 111*e* may be formed on both ends of insulated substrate sheet 111. Alternatively, as shown in FIG. 52, ineffective area 111*f* may be formed on three sides of insulated substrate sheet 111. All these demonstrate the same effect as that of the fifth exemplary embodiment of the present invention.

The fifth exemplary embodiment of the present invention also describes the case of forming second dividing portions 123 by dicing. In other cases, for example, second dividing portions 123 may be formed by cutting the top, rear, or center of insulated substrate sheet 111, using a laser beam or dicing, while retaining a thinned portion in the rear, top, or center parts of insulated substrate sheet 111. In this case, the insulated substrate sheets are not immediately divided into pieces by forming second dividing portions 123 but in two steps.

The fifth exemplary embodiment also describes the case of forming first slit dividing portions 120 after forming first resist layers 118 and second resist layers 119. However, first resist layers 118 and second resist layers 119 may be formed after forming first slit dividing portions 120. In this case, however, printing pressure for screen printing need to be reduced because the strength of insulated substrate sheet 111 is reduced when first resist layers 118 and second resist layers 119 are screen-printed after forming first slit dividing portions 120.

Furthermore, second resist layer 119 may be formed immediately after forming the first protective layer, which is precoat glass layers. This also achieves the same effect as that of the fifth exemplary embodiment.

Still more, the fifth exemplary embodiment of the present invention describes the case of peeling first resist layer 118 and second resist layer 119 before forming solder layer 122. These resist layers may also be peeled after forming solder layer 122.

Still more, the fifth exemplary embodiment of the present invention uses a gold material for metal layer 112, a silver material for top electrode layer 113 and a ruthenium oxide material for resistor layer 114. The use of other materials also achieves the same effect as that of the fifth exemplary embodiment of the present invention.

The fifth exemplary embodiment of the present invention also describes the case of forming first slit dividing portions 120 and second dividing portions 123 by dicing. The same effect as that of the fifth exemplary embodiment is also achievable by using other dividing portions creating means such as a laser or water jet for making first slit dividing portions 120 and second dividing portions 123.

Moreover, the fifth exemplary embodiment describes the case of forming resistor layers 114 such that they bridge pairs of top electrode layers 113 after forming pairs of top electrode layers 113 on the top face of insulated substrate sheet 111. The same effect as that of the fifth exemplary embodiment is also achievable by forming pairs of top electrode layers 113 such that a part of top electrode layers 113 overlaps resistor layers 114 after forming resistor layers 114 on the top face of insulated substrate sheet 111.

Furthermore, the fifth exemplary embodiment describes the case of forming first slit dividing portions 120, for dividing insulated substrate sheet 111 into substrate strips 111*b* by separating pairs of metal layers 112, only on these pairs of metal layer 112 when pairs of metal layers 112, pairs of top electrode layers 113, resistor layers 114, first protective layers 115, trimming grooves 116, second protective layers 117, first resist layers 118, and second resist layers 119 are formed on insulated substrate sheet 111. However, the present invention is not limited to this configuration. For example, the same effect as that of the fifth exemplary embodiment of the present invention is achievable when first slit dividing portions 120, for dividing insulated substrate sheet 111 into substrate strips 111*b* by separating pairs of metal layers 112, are formed only on these pairs of metal layers 112 on insulated substrate sheet 111 after forming pairs of metal layers 112, pairs of top electrode layers 113, and resistor layers 114 on insulated substrate sheet 111, and adjusting a resistance in resistor layers 114 between pairs of top electrode layers 113 by trimming.

The fifth exemplary embodiment of the present invention also describes the case of forming first slit dividing portions 120, for dividing insulated substrate sheet 111 into substrate strips 111*b* by separating pairs of metal layers 112, only on these pairs of metal layers 112 after the steps of forming pairs of metal layers 112 on the top face of insulated substrate sheet 111; forming pairs of top electrode layers 113 electrically coupled to metal layers and resistor layers 114 on the top face of insulated substrate sheet 111; trimming for adjusting a resistance in resistor layers 114 between pairs of top electrode layers 113; and forming protective layers 115 so as to cover at least resistor layers 114. This manufacturing method electrically couples pairs of metal layers 112 and pairs of top electrode layers 113 formed on the top face of insulated substrate sheet 111. Accordingly, adjacent metal layer 112 other than top electrode layer 113 concerned may be used for measuring a resistance during trimming for adjusting the resistance between a pair of top electrode layers 113. This facilitates a contact of a trimming test pin to the top electrode particularly in fine resistors. In addition, since only metal layers 112 are cut, without top electrode layers 113, when first slit dividing portions 120 are formed on insulated substrate sheet 111, occurrence of burrs is preventable. The top face of the resistor is thus smoothed, improving the mounting efficiency.

INDUSTRIAL APPLICABILITY

As described above, the resistor of the present invention includes a discrete substrate which is made by dividing an insulated substrate sheet along first slit dividing portions and second dividing portions perpendicular to first dividing portions; a pair of top electrode layers formed on the top face of the discrete substrate; a resistor layer formed such that a part of the resistor layer overlaps the pair of top electrode layers; a protective layer formed to cover the resistor layer; and a pair of side electrode layers which are nickel electrodes formed on a side face of the discrete substrate so as to form an electrical contact with the pair of top electrode layers. Since the substrate sheet is made into individual pieces by dividing the insulated substrate sheet along the first slit dividing portions and the second dividing portions perpendicular to the first dividing portions, the need for dimensional classification of discrete substrates is eliminated. Consequently, the process required in the prior art of replacing the mask according to the dimensional ranking of each discrete substrate is eliminated, offering an inexpensive fine resistor.

The invention claimed is:

1. A method for manufacturing a resistor, said method comprising:

forming a plurality of pairs of layers made mainly of gold on an insulated substrate sheet;

forming a plurality of pairs of top electrode layers made mainly of silver, said top electrode layers being electrically coupled to said plurality of pairs of layers made mainly of gold;

forming a plurality of resistor layers being electrically coupled to said plurality of pairs of top electrode layers; and dividing said insulated substrate sheet into a plurality of substrate strips, by cutting through said insulated substrate sheet and said plurality of pairs of layers made mainly of gold along portions of said insulated substrate sheet having said plurality of pairs of layers made mainly of gold formed thereon, by a dicing process, such that said top electrode layers are not cut.

2. The method of claim 1, further comprising the step of plating a metal layer on top, side and bottom surfaces of each of the plurality of substrate strips using the cut through portions of said insulated substrate sheet.

3. The method of claim 2, further comprising the steps of:

applying a solder layer on exposed portions of the plated metal layer; and controlling a dimension from one side of each respective substrate strip to an opposite side of the respective substrate strip according to at least thicknesses of the plated metal layer and solder layer on each side of the respective substrate strip.

* * * * *